US012181251B2

(12) United States Patent
Campbell

(10) Patent No.: US 12,181,251 B2
(45) Date of Patent: Dec. 31, 2024

(54) VIDEO CAMERA SIGHT SCOPES WITH EXTERNAL RETICLES

(71) Applicant: Robert Marshall Campbell, Miami, FL (US)

(72) Inventor: Robert Marshall Campbell, Miami, FL (US)

( * ) Notice: Subject to any disclaimer, the term of this patent is extended or adjusted under 35 U.S.C. 154(b) by 0 days.

(21) Appl. No.: 17/829,274

(22) Filed: May 31, 2022

(65) Prior Publication Data

US 2023/0272999 A1 Aug. 31, 2023

Related U.S. Application Data

(60) Provisional application No. 63/314,456, filed on Feb. 27, 2022.

(51) Int. Cl.

| | |
|---|---|
| ***F41G 1/42*** | (2006.01) |
| ***F41G 3/16*** | (2006.01) |
| *F41G 3/06* | (2006.01) |

(52) U.S. Cl.

CPC ..... *F41G 3/165* (2013.01); *F41G 3/06* (2013.01)

(58) Field of Classification Search

CPC ... F41G 3/165; F41G 1/00; F41G 1/42; F41G 1/14

See application file for complete search history.

(56) References Cited

U.S. PATENT DOCUMENTS

| | | | | |
|---|---|---|---|---|
| 9,163,902 | B1 * | 10/2015 | Cheng | F41G 1/38 |
| 10,006,742 | B1 * | 6/2018 | Campbell | F41G 3/165 |
| 2006/0010759 | A1 * | 1/2006 | Penney | F41G 11/001 42/126 |
| 2016/0245621 | A1 * | 8/2016 | Kintzing | F41G 11/003 |
| 2023/0142324 | A1 * | 5/2023 | Campbell | H04N 23/56 42/113 |

* cited by examiner

*Primary Examiner* — J. Woodrow Eldred

(74) *Attorney, Agent, or Firm* — Javier Sobrado; The Brickell IP Group, PLLC

(57) ABSTRACT

A camera sighting device for a firearm including a targeting reticle unit mounted in a first position on the weapons rail of a firearm and a video camera unit comprising a field of view separately mounted in a second position on the weapons rail of the firearm at a distance behind the targeting reticle mounted in the first position, and a surveillance unit attachable to a helmet and with both the video camera unit and the surveillance unit capable of digital video communication with a digital display remotely mounted in a display mount in a third position.

17 Claims, 30 Drawing Sheets

FIG-7
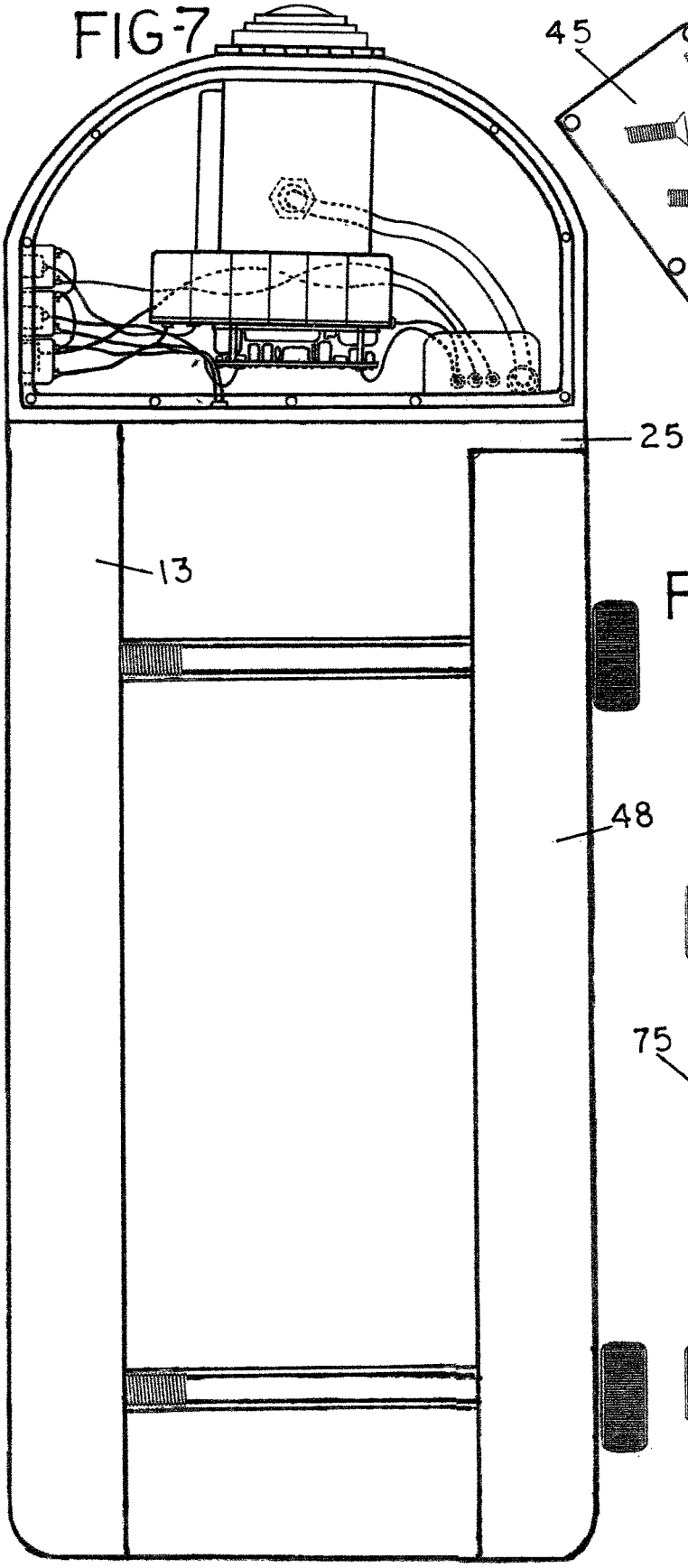
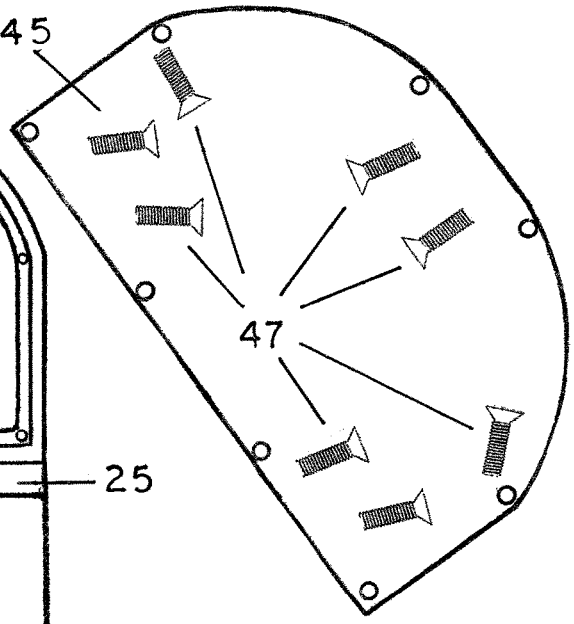
FIG.8
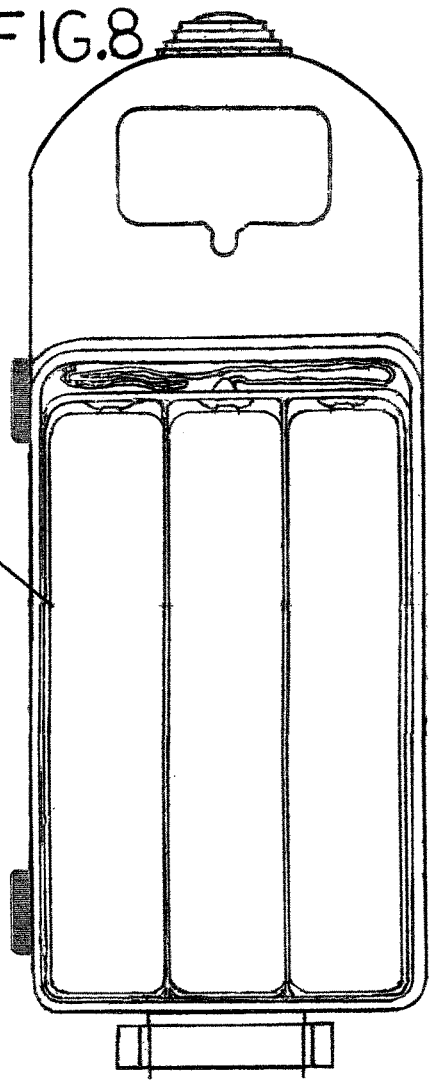

FIG.11-A
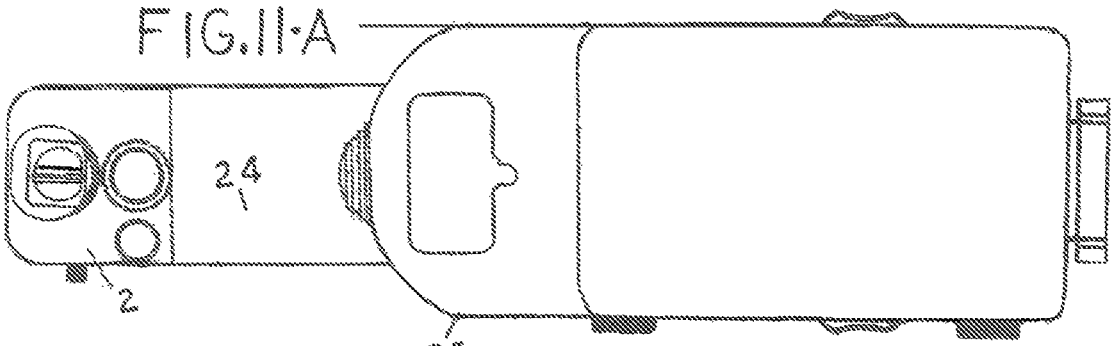
FIG.11-B
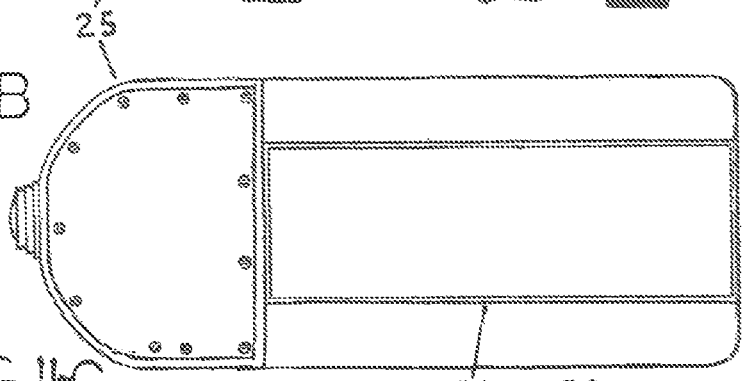
FIG.11-C
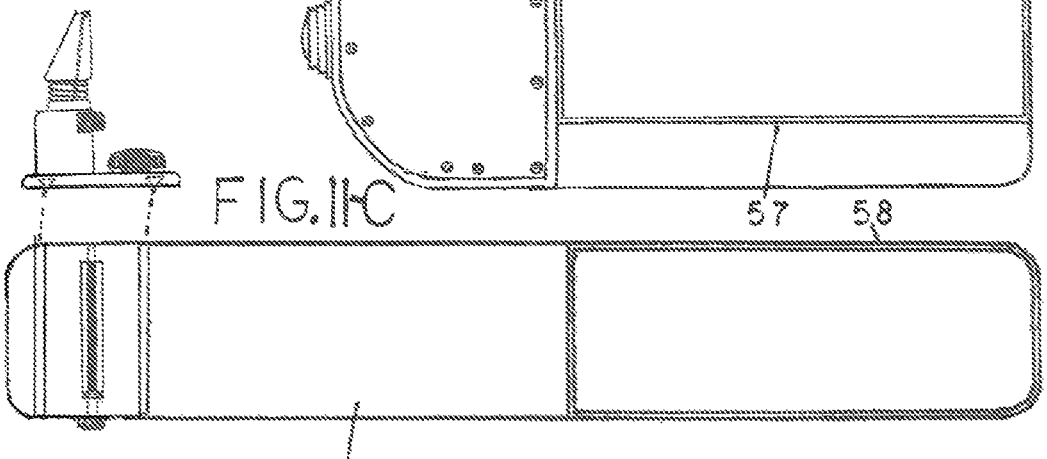
FIG.11-D
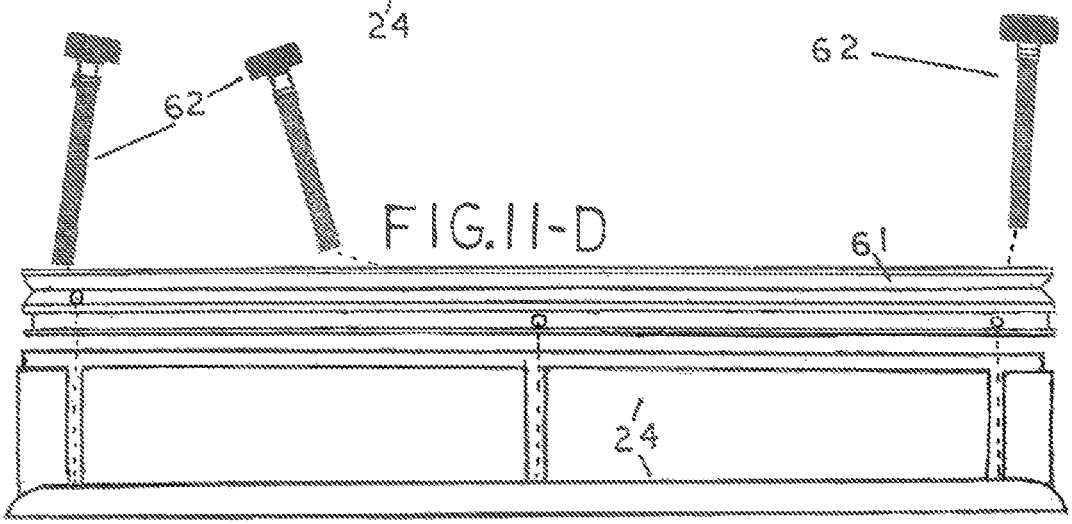

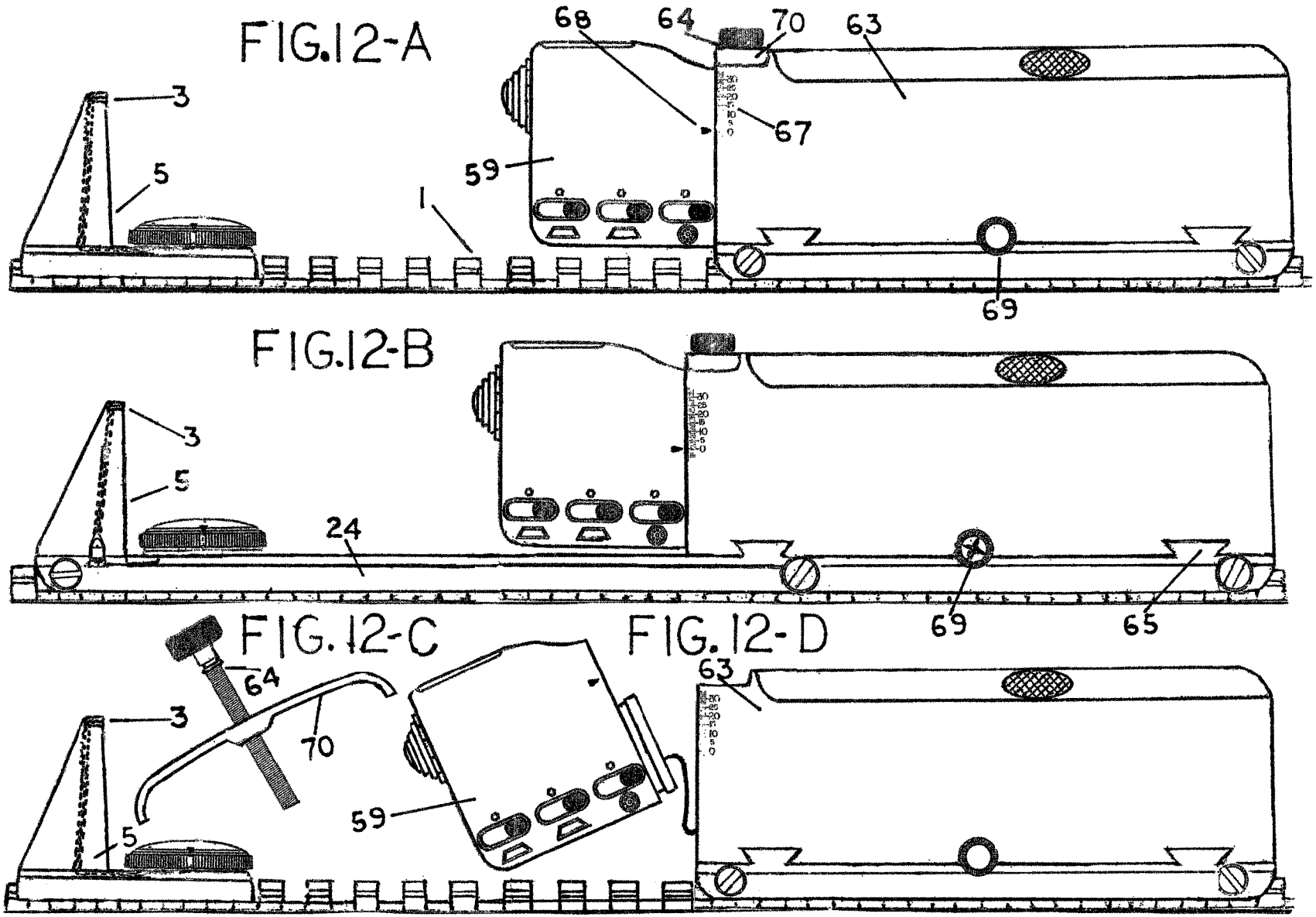
FIG.12-A
FIG.12-B
FIG.12-C
FIG.12-D

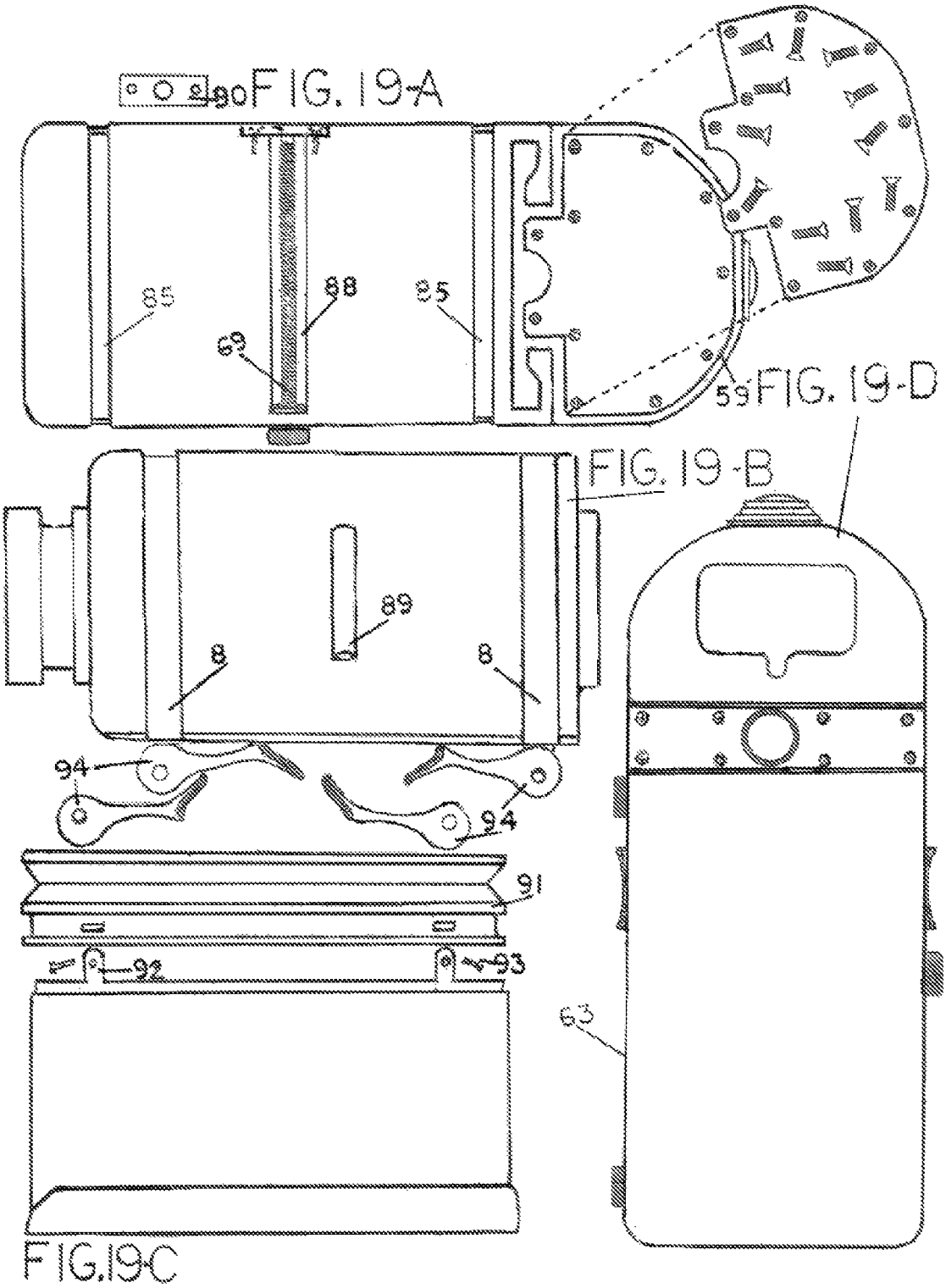
90
FIG. 19-A
85
88
85
69
59
FIG. 19-D
FIG. 19-B
89
8
8
94
94
91
92
93
63
FIG. 19-C

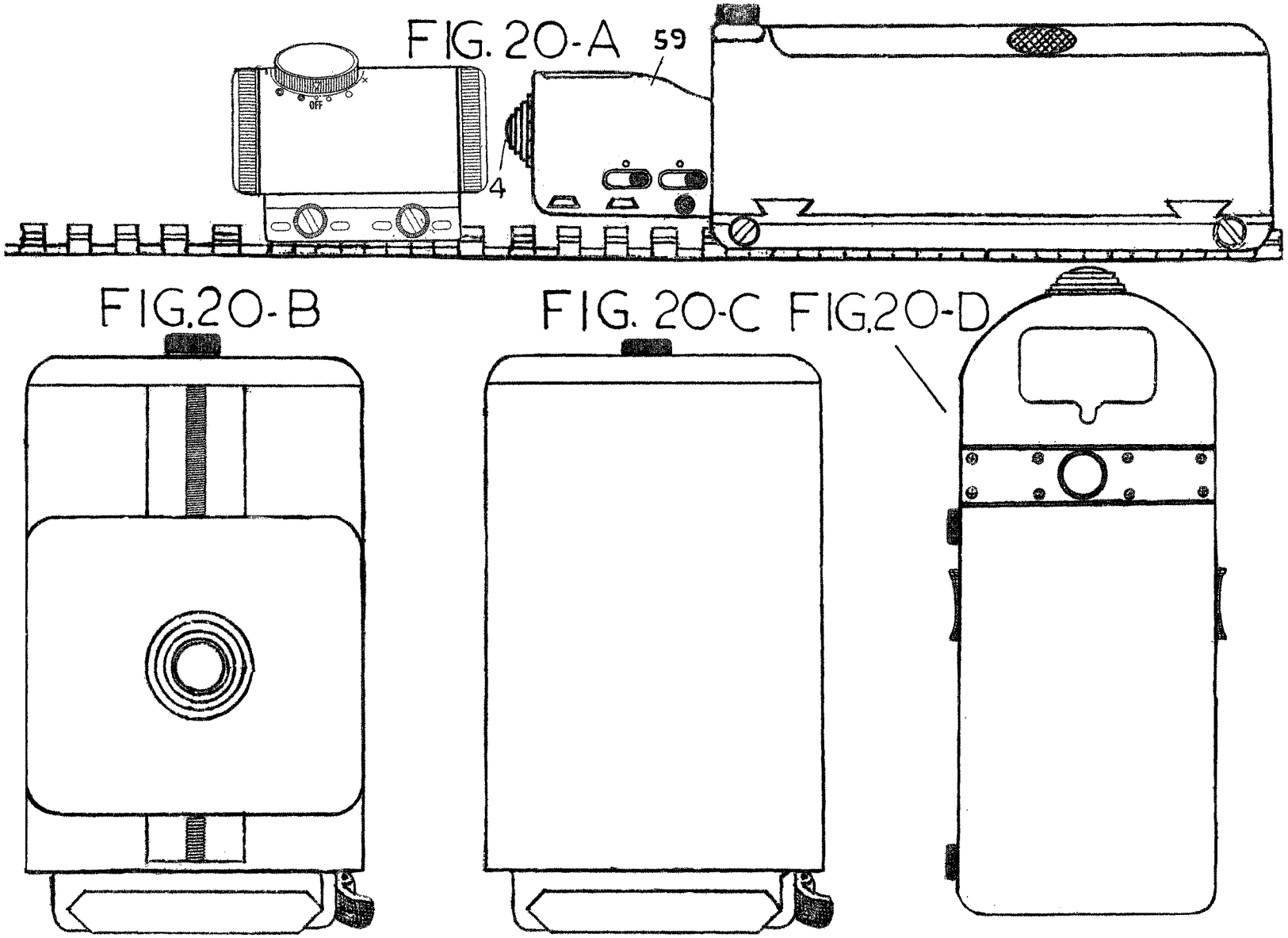
FIG. 20-A
FIG. 20-B
FIG. 20-C
FIG. 20-D

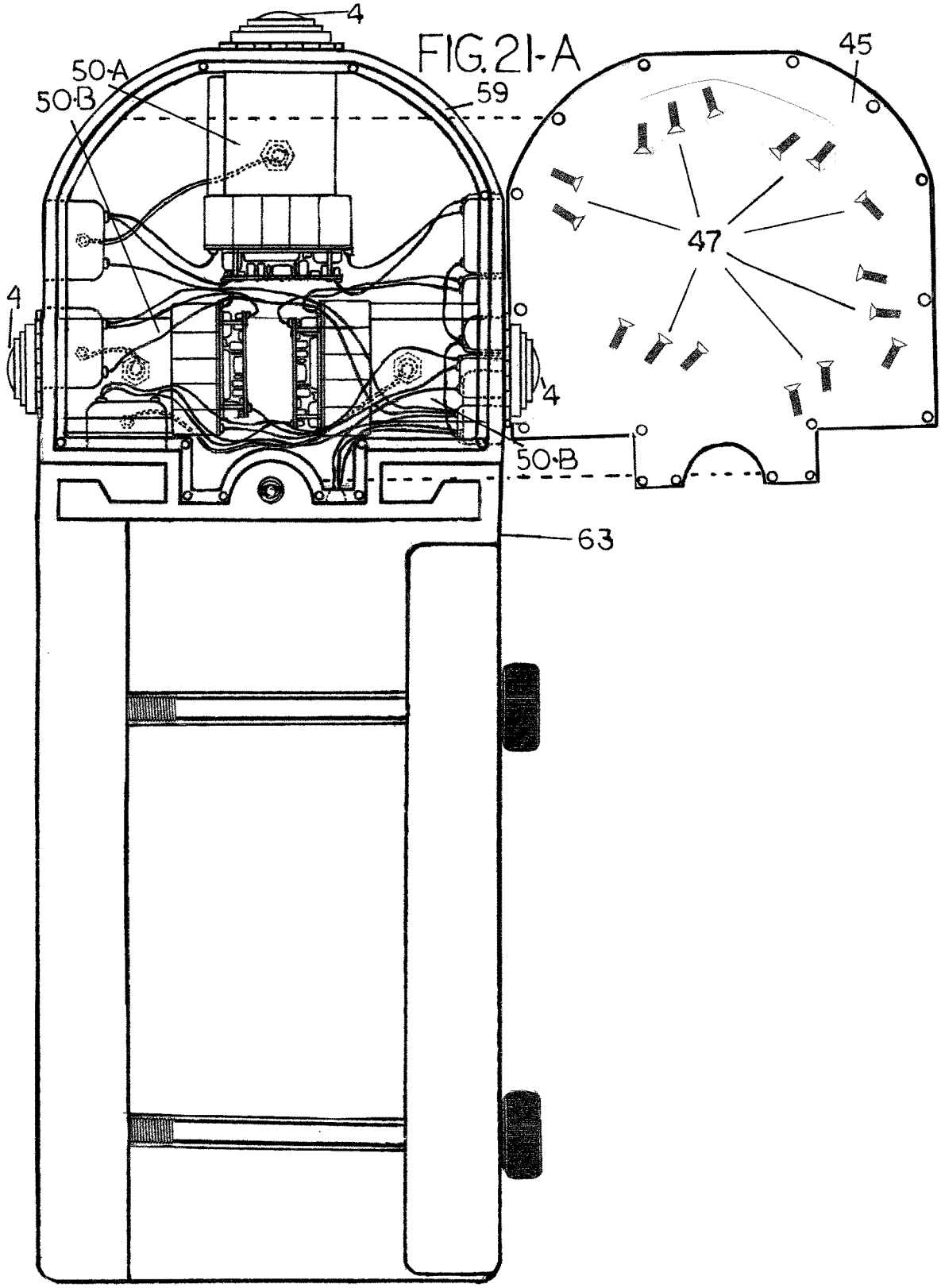
FIG. 21-A
4
50-A
50-B
59
45
47
4
4
50-B
63

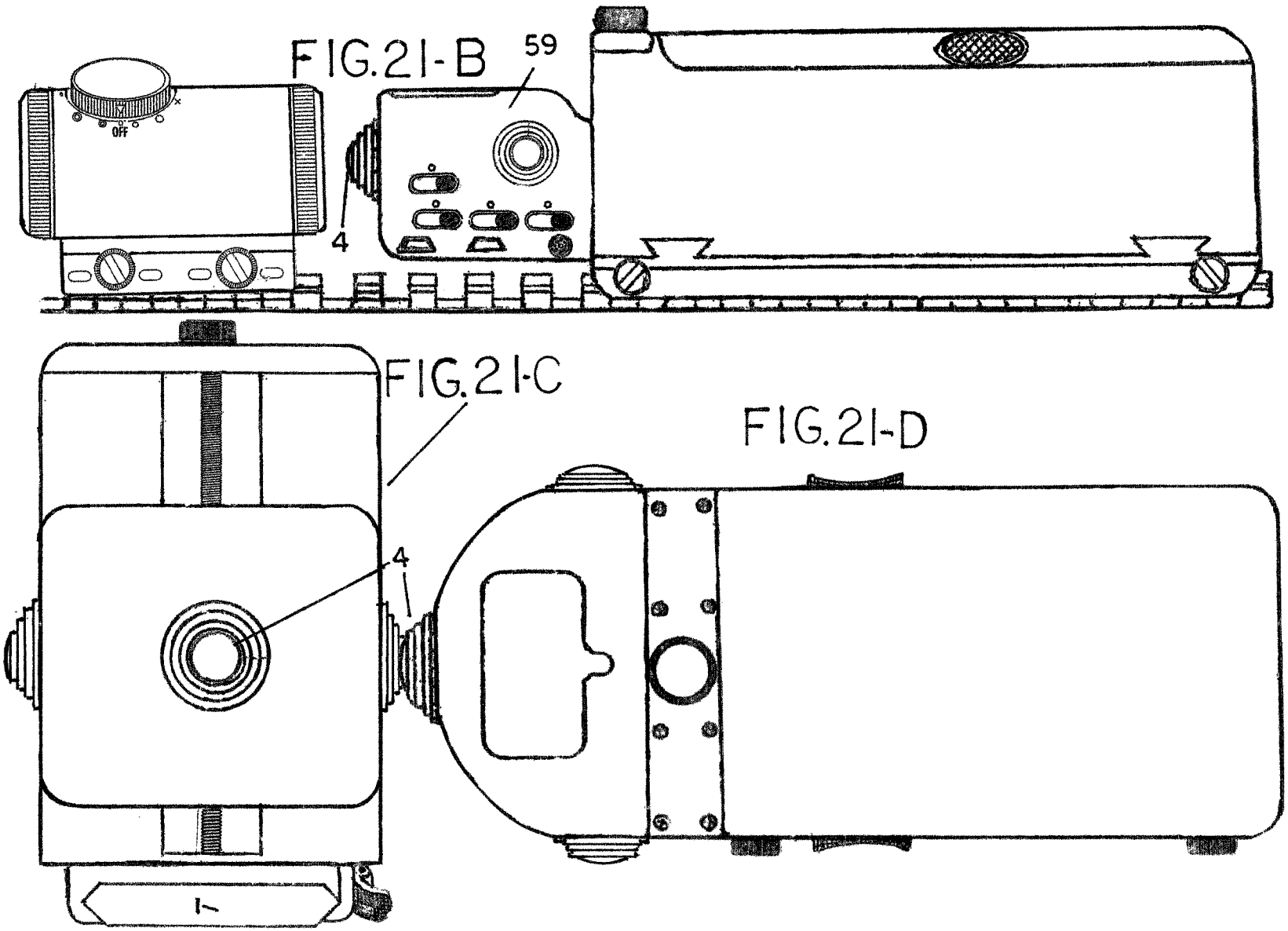
FIG.21-B
59
4
OFF
FIG.21-C
4
FIG.21-D
1

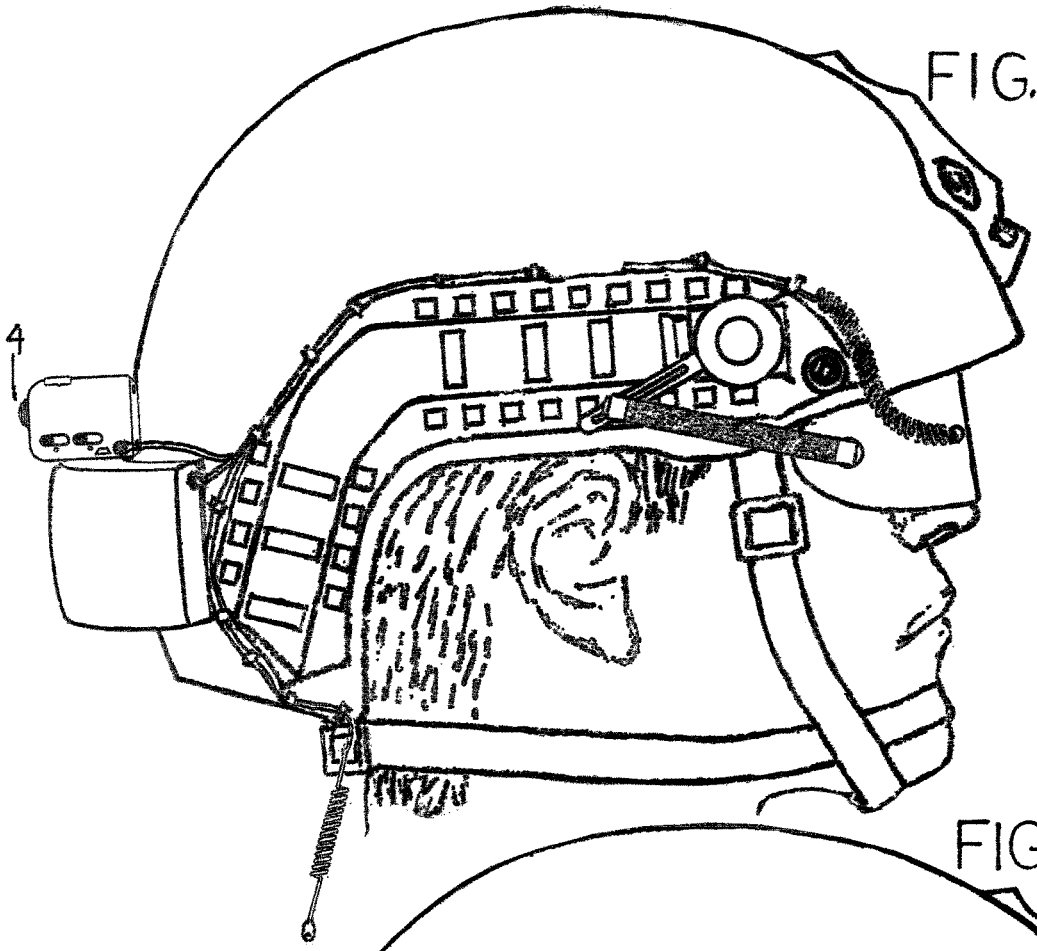
FIG. 22-A
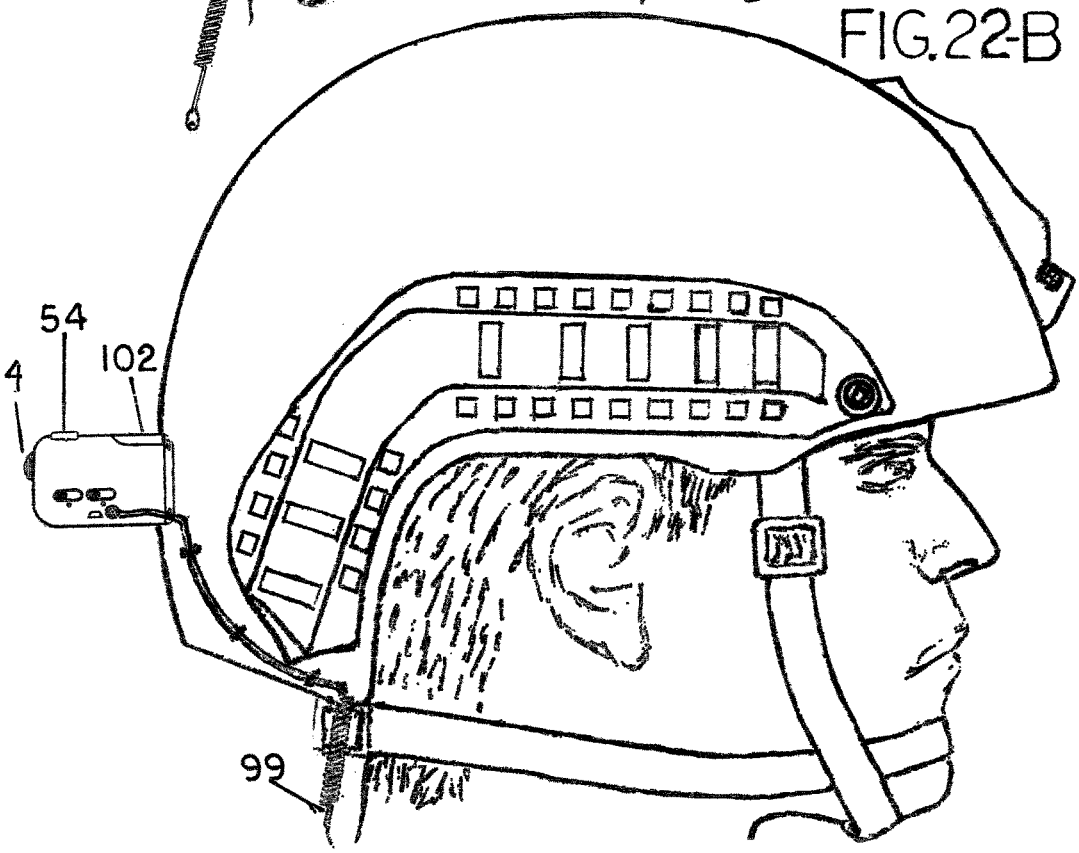
FIG. 22-B

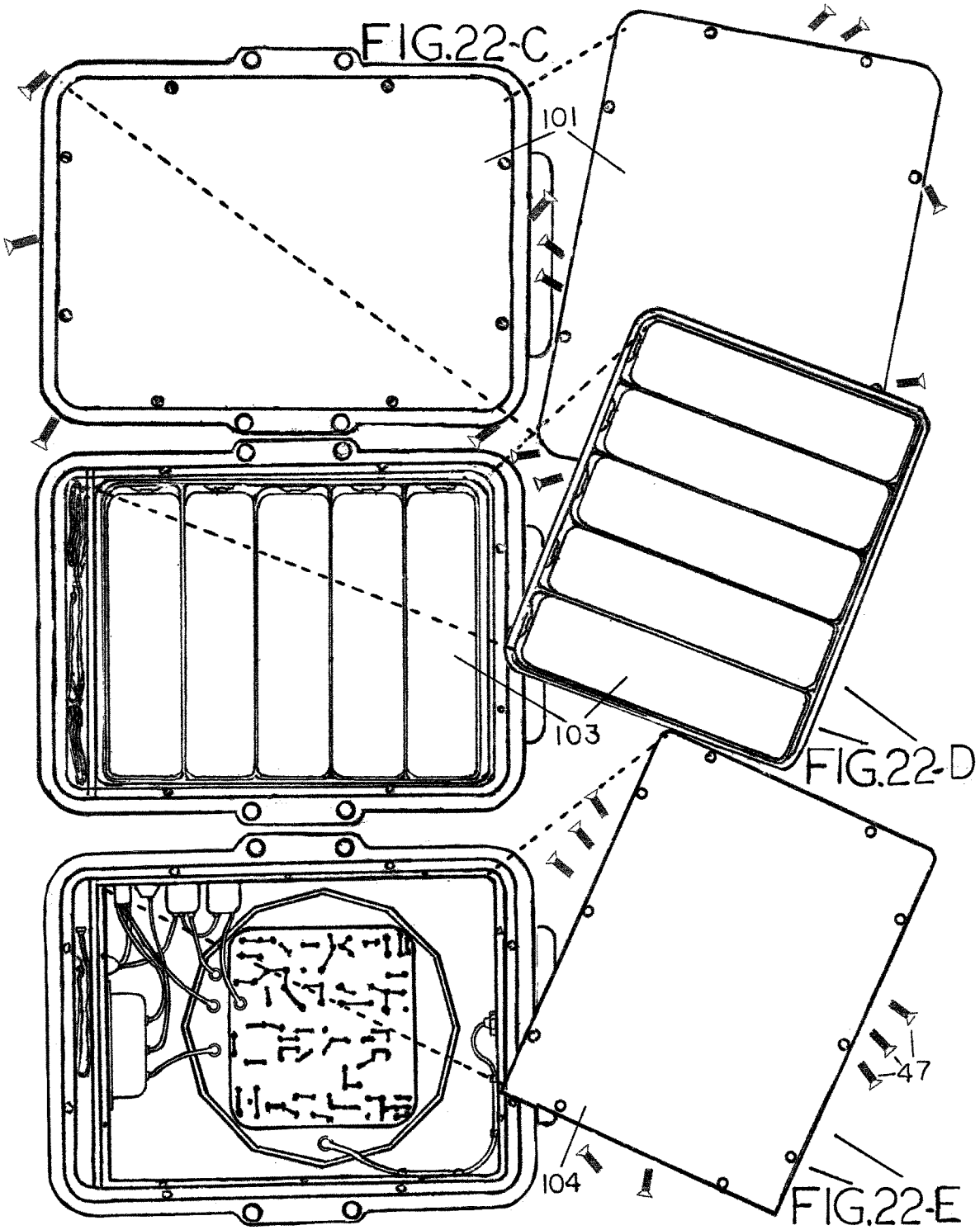
FIG.22-C
101
103
FIG.22-D
47
104
FIG.22-E

FIG.26-A
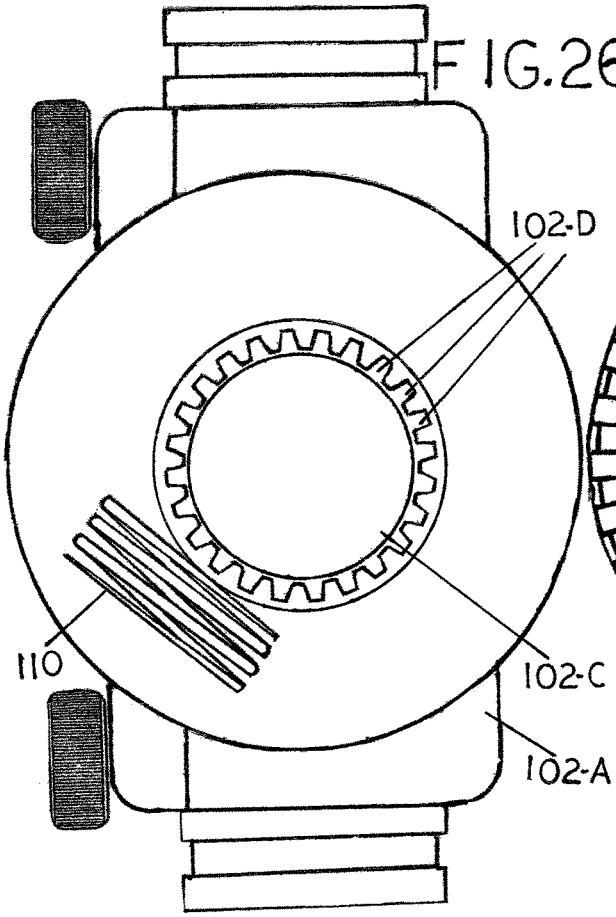
FIG.26-B
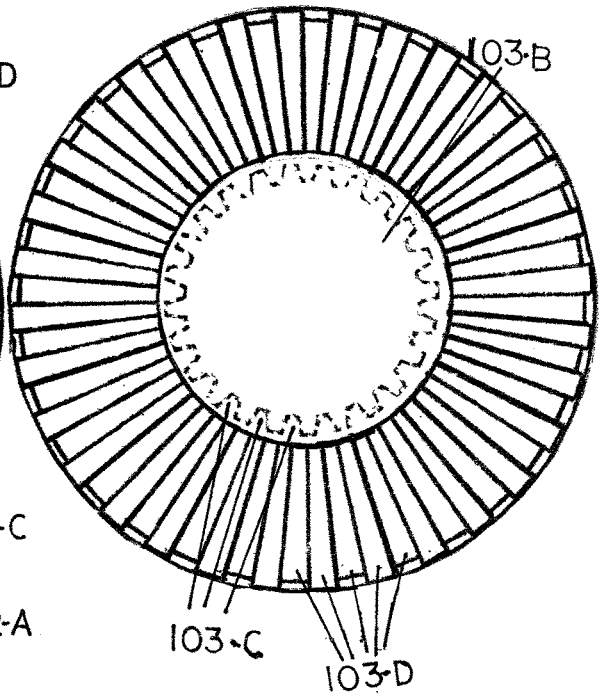
FIG.26-C
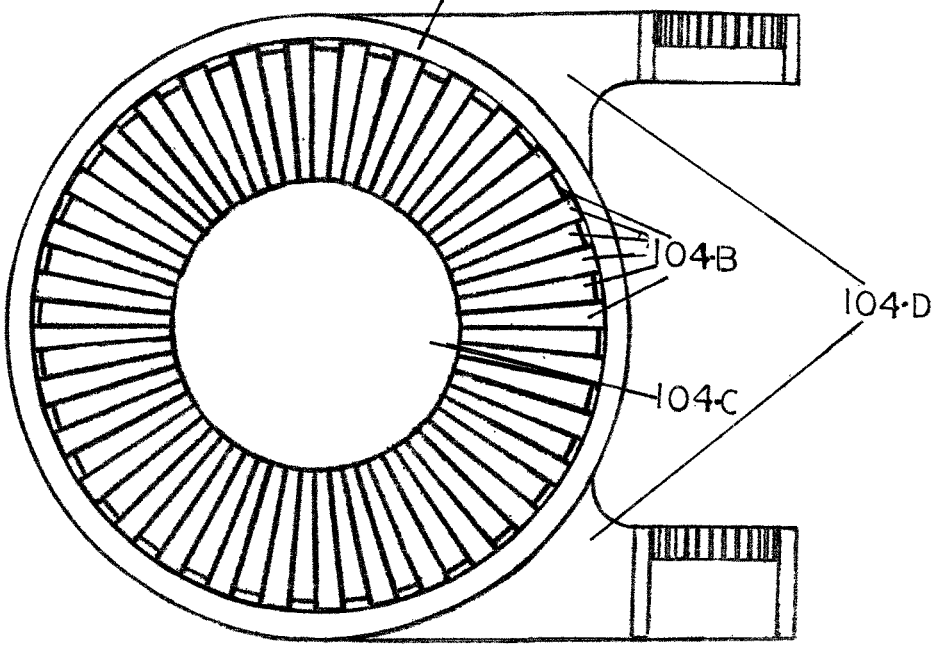

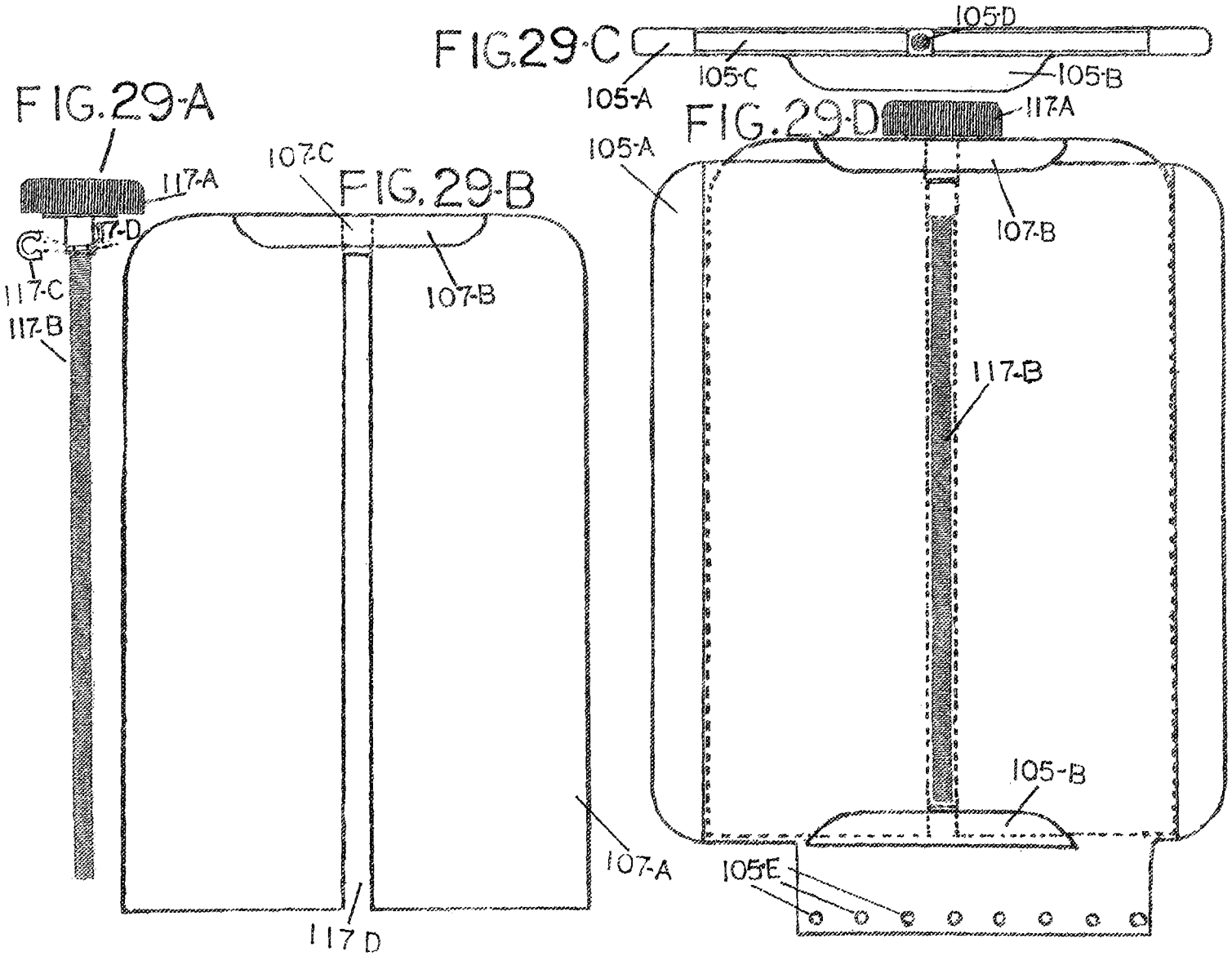
FIG.29-C
105-D
105-B
117-A
105-C
105-A
FIG.29-D
107-B
117-B
105-A
105-B
105-E
FIG.29-B
107-A
107-B
107-C
117-D
FIG.29-A
117-A
117-D
117-C
117-B

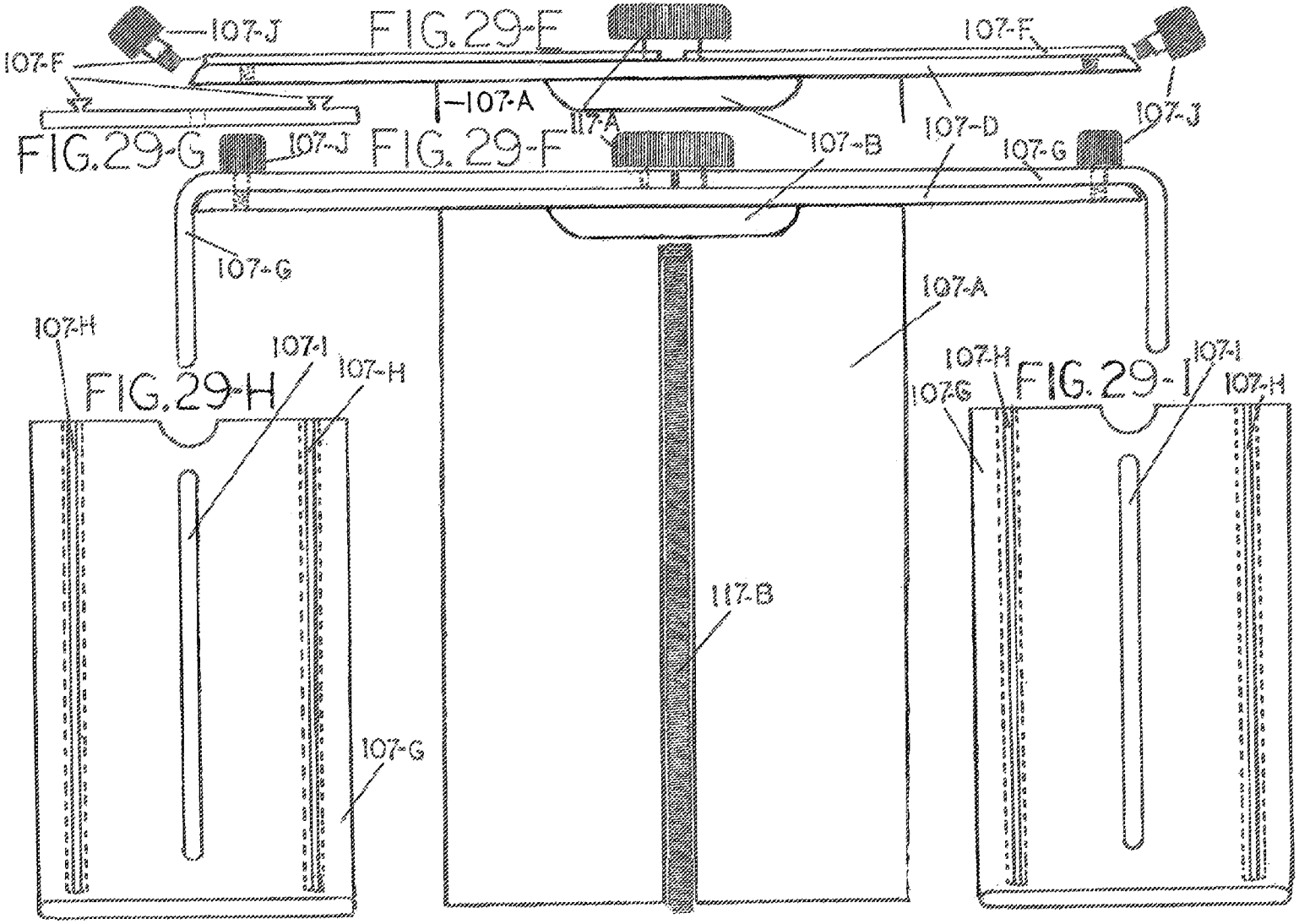
107-J
107-F
107-D
107-B
107-A
107-G
107-I
107-H
117-A
117-B
FIG. 29-E
FIG. 29-F
FIG. 29-G
FIG. 29-H
FIG. 29-I

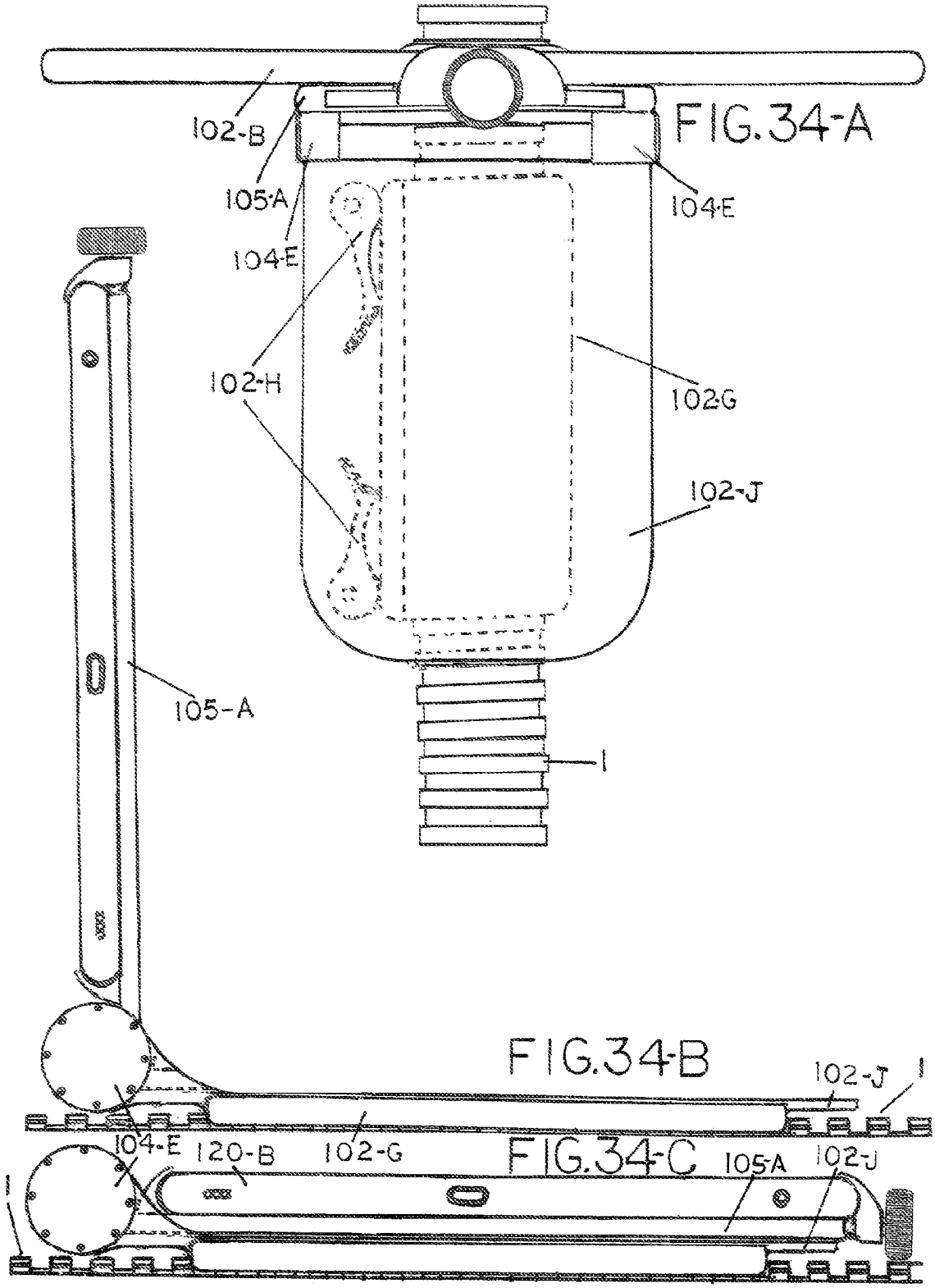
102-B
105-A
104-E
104-E
102-H
102-G
102-J
105-A
1
FIG.34-A
FIG.34-B
102-J
1
104-E
120-B
102-G
FIG.34-C
105-A
102-J
1

VIDEO CAMERA SIGHT SCOPES WITH EXTERNAL RETICLES

CROSS REFERENCES TO RELATED APPLICATIONS

This application claims the benefit of U.S. Patent Provisional Application 63/314,456, filed Feb. 27, 2022, the contents of which are incorporated herein by reference in their entirety.

FIELD BACKGROUND AND PRIOR ART OF THE INVENTION

The sighting devices, as well as the accessories employable in conjunction with them also included in this application, generally relate to the field of firearm accessories. Firearm accessories include a wide range of devices employable on, or in conjunction with, a firearm, that either enhance the performance of, or provide an additional needful service or ability of one sort or another, to enhance the abilities of a firearm or the effective employment of same, in one way or another. These firearm accessories include regular or infrared high-powered lights, tripods, various types of mounting rail systems, etc., as well as various types of firearm sight acquiring accessories which all fit into two basic categories.

The first category includes all types of actual firearm sights which all consist of portions of a firearm or optical accessories adaptable to a firearm and primarily employed by means of the users of them either viewing through them or across portions of them in one way or another, to provide the users of them with the ability to accurately align the aim point of the of the firearm with a target in one way or another.

Firearm sights actually come in many sub categories that provide the users of them with various advantages and disadvantages over each other, relative to efficiency and levels of accuracy possibly attainable by them, of which all provide the users with various levels of each, and primarily on much less distant targets. The first of these types of firearm sights being simple iron sights, such as those that come as standard equipment on all firearms when purchased. Another category of firearm sights being optic sights of one sort or another. This category of firearm sights includes various types of reflex and holographic sights. Another category of firearm sights includes laser sights, which are not actually sights at all but rather sight adjustable laser pointers mountable on a firearm and provide an illuminated mark on the target itself, referencing the aim point of the firearm. However all firearm sights are much more limited and their abilities to acquire accurate target acquisition on targets of any real distance are very restrictive in many ways and of course, some are far worse than others in their abilities to do so.

The other category of firearm sighting devices would be that of firearm scopes. This category basically consists of sight adjustable actual telescopes that are mountable on a firearm and are devised and exclusively employed to provide the user with the ability to achieve much higher levels of accuracy when taking aim on distant targets by means of providing the users with a highly magnified image of the target. This being why they are employed almost exclusively on high powered rifles. However it is their very same set and non-variable high levels of magnification that severely hinders the firearm they are employed on, or the user employing same from acquiring target acquisition on less distant targets in many ways. The first of which being the extremely restrictive field of view all scopes possess that not only renders closer targets extremely difficult to find in the first place, but also magnifying same far too much to effectively see and take aim on, or properly reference or assess anything else surrounding the target in any way, and thus severely restricting and limiting their possible effective level and range of effective service provided as well.

Scopes, for the most part, share almost all things common with each other. This holding true relative to their basic composition of components, as well as in the basic physical configurations of almost all of them. This due to a rifle scope basically being just a telescope with two crosshairs extending across and referencing the exact center of the outermost lens portion of the telescope and thus by means of the the user centering his view point to the best of his ability through the scope from the opposite end portion of same. The user is provided with not only a magnified view of the target but also with the ability to align both the intersecting center portions of the crosshairs in the outermost lens portion of the scope to the best of his ability with the magnified image of the target provided by same and thus achieve far greater levels of accuracy than could possibly be achieved on distant targets by other types of sighting optics such as reflex or holographic sights. This is not only due to the scope's ability to magnify the image of targets viewed through same, but also due to the distance between the crosshairs in the outermost lens portion of the scope and the lens in opposite end of the scope being viewed through by the user to align the crosshairs, with the level of refinement of the shot being relative to the distance between the crosshairs and the center of the rear lens portion of the scope brought into alignment with both, of which not only provides them with the ability to achieve even much higher levels of accuracy, but also provides them with much more refined sight aligning abilities on targets at great distances. This is also why rifle scopes are manufactured at the lengths that are many times longer than regular target acquiring optics as well. However the levels of accuracy possibly attainable by them, like all other types of sights previously devised. is also totally dependent on the user's ability to maintain the perfect alignment of the target and crosshairs along with the perfect centering of his own eye behind the rear lens of same during the entire shot to possibly acquire accurate target acquisition.

The firearm sighting devices included in this application on the other hand, in many ways are sights. However all are not only employable both as firearm sights and high powered scopes at the same time and do so in ways that radically out perform all other sights and scopes, literally in every way while doing so, but all also, additionally provide the users of them with a broad range of desperately needed and highly advantageous sighting and service providing abilities, impossibly providable by either while doing so. All are also devised and engineered in ways that provide the sighing devices included in this application with far greater levels of accuracy on both close as well as very distant targets than could possibly be providable by other types of firearm sights or scopes as well. This in part is actually attributable to a combination of many factors, features, and attributes exclusively possessed by them, but primarily due to the unique modes in which they acquire target acquisition in the first place, that not only overcome all of the factors that hinder and restrict levels of accuracy possibly attainable by all other types of firearm sights and scopes known of the applicant, but this along with the modes in which they provide same to the users of them, provides even the totally inexperienced and unskilled shooter not only with the ability to consistently achieve profound levels of accuracy, on close as well as very distant targets and do so at extreme levels of speed and ease, but additionally provides him with many unique extremely advantageous and needful additional sighting and service providing abilities also exclusive unto themselves while doing so.

The problems suffered by all other types of firearm sights and scopes known of the applicant on the other hand are not only numerous but also unavoidably inherent to the basic foundational composition of all sights and scopes of all kinds previously devised. They not only seriously restrict and limit, but literally render any extreme levels of accuracy from being effectively or consistently attained by them, or to possibly possess the ability to effectively acquire target acquisition on both close as well as very distant targets. They also render any truly advanced sighting and service providing abilities of any real significance from ever being attainable, or possibly providable by them. These restrictions and limiting factors, holding true relative not only to the composition, implementation, and arrangement of all components employed in them, or the modes in which they acquire target acquisition in the first place, but also relative even to serious restrictions and limitations unavoidably inherent to the basic configurations and features common to the modes in which all other types of sights and scopes were devised and engineered. As a result thereof, not only are other types of sights and scopes seriously lacking, relative to the actual levels and range of needful service providing abilities possibly providable by them, but none known of the applicant are capable of even providing the flawed and seriously restricted targeting abilities actually providable by them in any more than the one level of targeting magnification in which they were produced. Thus even further limiting the levels and range of needful sighting abilities possibly be providable by them. Such as scopes only being effectively employable for acquiring target acquisition on very distant targets and firearm optics such as reflex or holographic type sights and others only being effective on acquiring target acquisition on close to mid range targets. But neither really being effective at acquiring target acquisition on both. This as well as all other other types of sights and scopes known of the applicant also suffer from their very narrow and restrictive fields of view providable by the single level of magnification in which they were produced. Thus not only rendering the target very difficult to find in the first place but also rendering the user's ability to properly reference or assess additional targets, dangers, or maintain a visual on much of anything else being extremely limited in the employment of them.

The reasons other types of firearm sights and scopes could never consistently achieve the levels of accuracy attainable by the sighting devices included in this application is actually attributable, in part, to several factors, features, and attributes exclusively possessed by them. However the main factor providing the sighting devices included in this application with the advanced levels of accuracy providable by them being attributable to the unique modes in which they acquire target acquisition in the first place and provide same to the users of them, of which is very different from that of the basic conventional modes in which other types of sights and scopes acquire target acquisition, in that the actual level of accuracy possibly achievable by them has always been totally dependent on the level of the user's own ability to perform several tasks at once. The first of which being dependent on the level of the user's ability to perfectly center his own eye behind the center of the rear lens or window of the sight or scope while simultaneously aligning the crosshairs or targeting reticle centered in the outer lens or window of the sight or scope as well as the target in linear alignment with each other and maintaining all three in as close to perfect linear alignment with each other as possible in the user's attempt to acquire accurate target acquisition. The process of which not only being difficult and time consuming but the absolute maxim level of accuracy possibly or continuously attainable by them being subject to all levels of human error and inconsistencies on the user's part and of which accounts for almost all levels of inaccuracy and target deviation suffered by other types of sights and scopes previously devised.

The advanced levels of accuracy possessed by the new type of sighting and sight acquiring devices included in in this application in part is attributable to a combination and arrangement of components and features devised and employed by applicant, essential to achieve certain functions and abilities needful and beneficial to the effect. However the basic and foundational mode in which the sighting devices included in this application possess the ability to consistently achieve much higher levels of accuracy than other sights and scopes, is attributable in part to a combination of many unique things exclusive unto them, including but far from limited to the unique modes in which the digital video camera sighting devices included in this application acquire target acquisition, of which not only overcomes all of the problems and limitations that have always restricted extreme levels accuracy form being attainable by other types of firearm sights and scopes, previously devised and provides the users of them them with the ability to consecutively achieve superior levels of accuracy on every shot, but also with the ability to accomplish same at extreme levels of speed ease and efficiency while doing so.

The primary mode in which the sighting devices included in this application, achieve the advanced levels of accuracy achievable by them, among other things, is attributable to the modes in which they acquire target acquisition and provide same to the users of which is very different in that among many other things, initial target acquisition is acquired by them by means both of a targeting image acquiring digital video camera unit hard mounted on the weapon's rail of a firearm in a position wherein the lens portion of same is facing forward and at a distance from the targeting reticle or crosshairs portion of the targeting reticle unit in a manner wherein both the exact center of the lens portion of the digital video camera and the targeting reticle or crosshairs are sight adjusted relative to each other on the weapon's rail of a firearm in a manner that once sighted in together, the lens portion of the digital video camera unit portion of the sighting device always captures targeting images from its exact same hard mounted and sighted in position relative to the crosshairs or targeting reticle on the firearm at all times once sighted in and thus the targeting digital video images captured are also provided and displayed in the screen of the display device employed, in a manner that the targeting reticle always remains perfectly true to the target displayed and free of target deviation of any kind in the screen of the digital display device employed. Thus not only providing the user of same with the highest possible level of accuracy attainable by a sighting device but also providing the user with the targeting images captured by same in the screen of the digital display device employed by them, in a manner wherein the video targeting images provided by the sighting device are always displayed with the targeting reticle perfectly centered in the screen of the digital display device employed and thus additionally providing the users of them with profoundly fast and easy target acquiring abilities while doing so as well.

But embodiments of the sighting devices included in this application include drawings and descriptions of embodiments of them shown as being optionally equipped in a manner wherein the actual lens portions of the digital video cameras employed in same are not only equipped with optical zooming abilities but are also mounted externally on outer portions of the actual component housing portions of the digital video camera sighting devices, wherein the lens portions of same always capture the targeting images in a perfectly clear, totally unobstructed and extremely broad but magnifiable field of view, limited only by the unmagnified field of view of the digital video cameras employed in them and thus rendering the target not only extremely fast and easy to locate in the first place, but also in a manner in which the targeting images displayed are then, not only magnifiable, but variably magnifiable to a desired level of magnification and in a manner in which the targeting images provided and displayed in the screen of the digital display device employed, not only remain perfectly true to the target, but are also provided in a manner in which the digital images provided also remain perfectly sharp and clear, regardless of the number of times they have been magnified and thus providing the user of them with the ability to additionally acquire extremely accurate target acquisition on very distant targets with the same profound level of speed, ease and accuracy in the employment of them, but all have also always been very effectively equipped with and tested with various types of night viewing and thermal optic components as well, of which are also included in many of the drawings of various embodiments of them included in this application, which has always additionally enabled the effective the employability of them 24-7.

The digital video camera sighting and sight acquiring devices included in this application have also always been equipped in ways that have provided embodiments of them with different types of optionally employable digital video image transmitting components, that provide embodiments of them with point to point, or what also is referred to as device to device digital video communication between the sighting device and the digital displays or digital display devices employed by them, of which has always provided the full and unrestricted employability of all types and variations of them literally anywhere in the world. However embodiments of them have also always been equipped in ways that additionally provide them with the optionally employability of the screens of smart digital display devices, such as smart phones, tablets, smart glasses, smart goggles, or other, as their targeting screens, either in the same basic manner that maintains the full and unrestricted employability of them as their targeting screens any where in the world without a cellular service or internet connection of any kind. However all were devised to employ smart digital display devices as their targeting screens in ways that additionally provide the digital video camera sighting devices included in this application with the employability of them as extremely high tech computerized sights with countless additional needful and highly advantageous service providing abilities far too numerous to list.

However, as a result of additional efforts on the applicant's part to maximize the possible levels and range of needful services and abilities providable by the digital video camera sighting devices included in this application, during the his development process of them, he also devised and engineered several tactical and non-tactical accessories employable in conjunction with them. These accessories among other things, include both tactical as well as non tactical multi vertical and multi horizontal and angularly adjustable display or display device mounts that include both weapon's rail mountable as well as forearm mountable versions of them, as well as other accessories also included in this application that were all devised and engineered by the applicant to be employed by the users of them in conjunction with the digital video camera sighting and sight acquiring devices included in this application. In that all were devised and engineered in ways that even further expand the levels and range of services and abilities providable by the digital video camera sighting and sight acquiring devices, as well as the levels and range in which all services and abilities exclusively providable by them could be employed to the highest possible level and extent by the users of them. For instance, embodiments of the aforementioned digital display mounts, not only provide the users of them with the ability to always maintain a perfect view point of the screen of the digital display device employed in them, regardless of the user's position relative to the firearm, and do so as well as take same in and out of service at extreme levels of speed, ease, and operational effeciency, but all accessories for them included in this application were devised and engineered with all efforts on the applicant's part to do so, in every way, that not only provides the users of them with the absolute highest level of needful services and abilities providable by them but also in ways that provide all needful services and abilities as employable by the users of them at the highest levels of operational ease and effeciency possible while doing so, but also in ways that will easily hold up to any forces and conditions possibly encounterable during the employment of them, of which is also included and described in detail and will also be fully and easily understood in the in the following drawings and descriptions included for them, along with those included for the digital video camera sighting and sight acquiring devices included in this application.

Prior art comparable to the digital video camera sighting devices included in this application as well as all accessories for them also included in this application has actually proven to be unfindable by the applicant, in that not only has the applicant been incapable of finding anything previously devised that is employable both as a firearm sight and a high powered scope in the first place, or that could possibly consistently achieve the levels of accuracy possessed by them, primarily due to the unique modes in which they acquire target acquisition in the first place, or any sight that possesses, or that could possibly achieve unmagnified fields of view any where near as broad, let alone any sight that possess the ability to variable magnify same to any desired level of magnification and additionally employ them as high powered scopes, or that possesses and provides the users of them with any of the other numerous sighting and service providing exclusively possessed by them, at the same time, or that could possibly even provide the inferior and seriously restrictive sighting abilities actually providable by them, at any where near the level of ease and operational effeciency in which the digital video camera sighting devices included in this application provide the broad range of radically advanced and far superior sighting and service providing abilities to the users of them.

Nor has the applicant been capable of finding any type of sight, scope, or sighting device previously devised of any kind that is either configured in the same manner, or that consists of, or that even employs a plurality of separately mounted apparatuses to acquire target acquisition in the first place. Or that do so by means of a similar combination and arrangement of basic function enabling features, components or interactional modes, in which the combinations thereof, also provide them with the ability to achieve and provide the users of them with the far superior and radically advanced sighting and service providing abilities exclusively possessed by them, nor has the applicant been capable of finding anything really comparable to the accessories devised and engineered to be optionally employable in conjunction with them, also included in this application, that were not only devised and engineered in all ways to even further refine and expand the levels of services and abilities providable by the digital video camera sighting and sight acquiring devices, but also in ways that expands the levels of operational ease effeciency in which all services and abilities exclusively providable by them could be employed to the highest possible level and extent by the users of them.

All digital video camera sighting and sight acquiring devices included in this application not only overcome all of the problems that have always hindered and and limited consistent levels of accuracy, and not only out perform all other prior art known of the applicant, literally in every way, but also possess and provide the users of them with many radically advanced and desperately needed sighting and service providing abilities also impossibly providable by the prior art, to the applicant's knowledge. Nor could the unique and radically advanced sighting and service providing abilities exclusively possessed by them ever be attained or surpassed, by any other type of sighting devices produced in the future, without first implementing the basic foundational modes in which the digital video sighting devices include in this application acquire same.

BRIEF SUMMARY OF THE DISCLOSURE

The following presents a simplified summary of the disclosure in order to provide a basic understanding of some aspects of the various embodiments disclosed herein. This summary is not an extensive overview of every detail of every embodiment. It is intended to neither identify key or critical elements of every embodiment nor delineate the scope of every disclosed embodiment. Its sole purpose is to present some concepts of disclosure in a simplified form as a prelude to the more detailed description that is presented later.

In an embodiment, a digital video camera sighting device for a firearm may include a targeting reticle unit mountable to a firearm in a first position, and a digital video camera unit separately mountable behind the targeting reticle unit on the firearm in a second position that's different from the first position.

In an embodiment, a camera sighting device for a firearm may include a targeting reticle mounted in a first position on a weapons rail of the firearm, and at least one video camera comprising a field of view separately mounted in a second position on the weapons rail of the firearm at a distance behind the targeting reticle.

In an embodiment, a rear viewing surveillance device mountable to a helmet may include a component housing comprising a base portion securable to a helmet, a digital video camera disposed within the component housing, such that a lens of digital video camera is disposed such that it has a field of view; and a transmitter disposed in the component housing, and in digital communication with the digital video camera such that it is capable of transmitting digital video images provided by the digital video camera to a digital display for the remote viewing of same by the user.

The following description and annexed drawings set forth certain illustrative aspects of the disclosure. These aspects are indicative, however, of but a few of the various ways in which the principles disclosed may be employed. Other advantages and novel features disclosed herein will become apparent from the following description when considered in conjunction with the drawings.

BRIEF DESCRIPTION OF THE FIGURES

FIG. 3-B illustrates a profile view of the embodiment of the combination vertically adjustable threaded rod and targeting reticle #29, of FIG. 3-A removed from the main body portion of the same embodiment of the sight adjustable and illuminate-able targeting reticle unit #2 shown in FIG. 3-A. In accordance with the principles of the present embodiment.

FIG. 3-C illustrates an enlarged profile view of the very upper portion of the same embodiment of the combination vertically adjustable threaded rod and targeting reticle #29, removed from the main body portion of the sight adjustable and illuminate-able targeting reticle unit #2 as is included in FIG. 3-B. in accordance with the principles of the present embodiment.

FIG. 3-D illustrates an enlarged view of the very end portion of the same embodiment of a tiny fiber optic cable #30 comprising tiny fiber-optic tubes. in accordance with the principles of the present embodiment.

FIG. 3-E illustrates a frontal and partially blown up view of an embodiment, of a sight adjustable and illuminate-able targeting reticle unit #2. Wherein both the vertical sight adjustment control wheel #27, as well as the combination vertically adjustable threaded rod and reticle #29, have been removed from the main body portion of the sight adjustable and illuminate-able targeting reticle unit #2. in accordance with the principles of the present embodiment.

FIG. 3-F illustrates a profile view of the same embodiment of the combination vertically adjustable threaded rod and targeting reticle #29 as is included in FIG. 3-E. in accordance with the principles of the present embodiment.

FIG. 3-G illustrates an enlarged profile view of an embodiment of the upper portion of the combination vertically adjustable threaded rod and targeting reticle #29 as is included as the description for the embodiment thereof included in FIG. 3-F. in accordance with the principles of the present embodiments.

FIG. 3-H illustrates a frontal view of the embodiment of a combination vertically adjustable threaded rod and targeting reticle #29. in accordance with the principles of the present embodiment.

FIG. 3-I illustrates an enlarged profile viewof the upper portion of another embodiment of combination vertically adjustable threaded rod and targeting reticle #29 that's even more simplistic in design and easier to produce than the embodiment thereof included in FIG. 4-A illustrates a drawing an overhead view of the bottom surface portion of an embodiment of the base portion of the upper sight adjustable and illuminate-able targeting reticle unit Of which are portions of or employed in conjunction with the embodiments of the digital camera sighting devices included in FIG. 1 through FIG. 11-D. in accordance with the principles of the present embodiment.

FIG. 4-C illustrates a profile view of an embodiment of the sight adjustable and illuminate-able targeting reticle unit #2. with same fully assembled and mounted on a Picatinny mounting rail of a firearm, in accordance with the principles of the present embodiment.

FIG. 4-D illustrates an overhead view of the same embodiment of the sight adjustable and illuminate-able targeting reticle unit #2. in accordance with the principles of the present embodiment.

FIG. 7 illustrates an overhead view of the underneath portion of the same embodiment of the combination digital video camera and battery housing portion #25, of the sighting device, included in FIGS. 2, through FIG. 6. In accordance with the principles of the present embodiment.

FIG. 8 illustrates an overhead view, of one of the embodiments of a digital video camera and battery housing portion of one of the digital video camera sighting devices included in this application. in accordance with the principles of the present embodiment.

FIG. 11-A illustrates an overhead view of the same embodiment a digital video camera sighting device as is included in FIG. 1. in accordance with the principles of the present embodiment.

FIG. 11-B illustrates an overhead view of the same embodiment the combination digital video camera and battery housing portion #25 of the sighting device as is included in FIG. 11-A removed from the long rail mountable portion of the sighting device and turned upside down. In accordance with the principles of the present embodiment.

FIG. 11-C illustrates an overhead view of the upper surface portion of the long rail mounting portion #24. of the same embodiment of the sighting device, included in FIG. 11-A, with the video camera and battery housing portion removed, and the targeting reticle unit 2 removed and show in side view. In accordance with the principles of the present embodiment.

FIG. 11-D illustrates a side view of the bottom portion of the rail mountable portion of the long rail mounting portion #24. of the same embodiment of the portion of the sighting device, as is included in FIG. 11-C. In accordance with the principles of the present embodiment.

FIG. 12-A illustrates a profile view of an embodiment taught here in, of a digital video camera sighting device. with a sight adjustable digital video camera and digital image transmitting component housing #59. In accordance with the principles of the present embodiment.

FIG. 12-B illustrates a profile view of an embodiment taught here in, of a digital video camera sighting device, that's includes all of the same basic components and shares all but a couple things common and is employed in the same manner as the embodiment thereof included in the embodiment thereof included in FIG. 12-A. and FIG. 12-D. In accordance with the principles of the present embodiment.

FIG. 12-C illustrates a profile view of an embodiment taught here in of a combination knob and thumbscrew vertical adjustment mechanism #64. and a cover plate #70. In accordance with the principles of the present embodiment.

FIG. 12-D illustrates a profile view of the same embodiment taught here in, of the same sighting device as is included in FIG. 12-A. This drawing thereof includes the thumbscrew vertical adjustment mechanism #64. and a cover plate #70. as seen in FIG. 12-C removed from the upper forward portion of the battery compartment. In accordance with the principles of the present embodiment.

FIG. 17-A illustrates a profile view of the same embodiment taught here in. of the thumbscrew adjustment mechanism #64. and a cover plate #70. in which extends through and is freely rotatable therein. This cover plate along with thumbscrew adjustment mechanism #64. In accordance with the principles of the present embodiment.

FIG. 17-B illustrates an overhead view of the bottom surface of the knob portion of same embodiment of the thumbscrew adjustment mechanism #64. In accordance with the principles of the present embodiment.

FIG. 19-B illustrates a side view of an embodiment of a sighting device having a rail mountable portion with an upper surface. In accordance with the principles of the present embodiment.

FIG. 19-C illustrates an overhead view of an embodiment the bottom surface of the weapons rail mountable portion of the sighting device. In accordance with the principles of the present embodiment.

FIG. 19-D illustrates an overhead view of an embodiment the digital video camera and digital image transmitting component housing #59, as well as the battery housing #63 portion of the sighting device. In accordance with the principles of the present embodiment.

FIG. 19-E illustrates an embodiment of one of the sighting devices taught herein that's manufactured as a single mountable unit. Such as the embodiment of the sighting device included in FIG. 12-B. turned upside down and thus exposing the bottom surface portion of the long extended portion of the weapons rail mountable portion of the sighting device. In accordance with the principles of the present embodiment.

FIG. 20-A illustrates a profile view of a more simplistic embodiment of an actual different type of sighting device that actually possess many things common with embodiments of the digital video camera sighting devices included in FIGS. 12-A. through FIGS. 19-D. However, this embodiment taught herein, was actually devised for the purpose of acquiring targeting acquisition from other sights and scopes on a firearm. In accordance with the principles of the present embodiment.

FIG. 20-B illustrates a frontal view of the same embodiment of the digital video camera sighting image acquiring device as is included in FIG. 20-A. In accordance with the principles of the present embodiment.

FIG. 20-C illustrates a back side view of the same embodiment of the digital video camera sighting image acquiring device as is included in FIG. 20-A. In accordance with the principles of the present embodiment.

FIG. 20-D illustrates an overhead view of the same embodiment of the digital video camera sighting image acquiring device as is included in FIGS. 20-A. through FIG. 20-C. In accordance with the principles of the present embodiment.

FIG. 21-A illustrates an overhead view of the bottom portion of a tactical embodiment of the digital video camera surveillance sight. In accordance with the principles of the present embodiment.

FIG. 21-B illustrates a profile view of an embodiment of a tactical version of the non tactical embodiment of the digital video sighting image acquiring device included in FIGS. 20-A. through FIG. 20-D, In accordance with the principles of the present embodiment.

FIG. 21-C illustrates a frontal view of a tactical embodiment of the digital video camera sighting image acquiring device that acquires target acquisition from other actual sighting devices mounted on a firearm and does so in the same manner a the non-tactical embodiment thereof included in FIG. 20-A. In accordance with the principles of the present embodiment.

FIG. 21-D illustrates an overhead view of the same embodiment of the digital video camera sighting image acquiring device as is included in FIGS. 21-B. and FIG. 20-C. In accordance with the principles of the present embodiment.

FIG. 22-A illustrates an embodiment of the aforementioned tactical helmet mountable rear viewing surveilling device. primarily devised and engineered for the employment of same, in conjunction with other tactical video camera sighting and accessory's. In accordance with the principles of the present embodiment.

FIG. 22-B illustrates another embodiment of a tactical helmet mountable rear viewing surveilling device. Notice this embodiment thereof actually includes a lid #102 to a battery compartment portion of same, in that this embodiment thereof actually possess its own power supply. In accordance with the principles of the present embodiment.

FIG. 22-C illustrates a rear view of the embodiment of the helmet mountable surveillance device with its own power supply. Included in FIG. 22-B. As if same had been removed from the helmet, In accordance with the principles of the present embodiment.

FIG. 22-D illustrates a rear view of the same embodiment of the helmet mountable surveillance device with its own power supply. Included in FIG. 22-B. In accordance with the principles of the present embodiment.

FIG. 22-E illustrates a rear view of the same embodiment of the helmet mountable surveillance device with its own power supply. Included in FIG. 22-B. With cover plate #101. completely removed from the inner back portion of the housing portion of the digital video camera surveillance device. In accordance with the principles of the present embodiment.

FIG. 23 through FIG. 33-D include the drawings and descriptions, of an entirely new type of both a tactical as well as non-tactical embodiments, of a low profile and multi positionable and multi angularly adjustable display, or display device mounts. In accordance with the principles of the present embodiment.

FIG. 23 illustrates an overhead view of a tactical embodiments of a low profile and multi angularly and positionally adjustable display device mount, with the actual display mounting platform portion of same. #105-A adjusted to a lateral angle relative to a weapons rail #1 and laid back and locked into a position of non-employment on top of the rest of the device. In accordance with the principles of the present embodiment.

FIG. 24-A illustrates a profile view, of the same tactical embodiment of a low profile and multi angularly and positionally adjustable display, device mount, as is included in FIG. 23. This drawing of the display mount includes a smart digital display device, #120-A. such as a smartphone or small tablet mounted the upper surface portion of the display device mounting platform #105-A. With same raised and locked into a slight vertical angle relative to the rail mount portion of same. In accordance with the principles of the present embodiment.

FIG. 24-B illustrates a profile view, of the same tactical embodiments of a low profile and multi angularly and positionally adjustable display, device mount, of FIG. 24-A, in a closed, non-raised position. In accordance with the principles of the present embodiment.

FIG. 25 illustrates a profile view, of the same tactical embodiment of a low profile and multi angularly and positionally adjustable display, device mount, as is included in FIG. 23. Through FIG. 32. This drawing Includes a blown up view, to view the inner components comprising same. In accordance with the principles of the present embodiment.

FIG. 26-A illustrates an overhead view of the same embodiment of the portions of the of the tactical low profile and multi angularly and positionally adjustable display, device mount included in all embodiments thereof included in FIG. 23 through FIG. 32. and described in detail in FIG. 25. In accordance with the principles of the present embodiment.

FIG. 26-B illustrates an overhead view of the upper portion of same embodiment the disk portion of the tactical low profile and multi angularly and positionally adjustable display, device mount. included in FIG. 23 through FIG. 32. and described in detail in FIG. 25. In accordance with the principles of the present embodiment.

FIG. 26-C illustrates an overhead view of the upper inside portion of same embodiment the cowling portion of the tactical low profile and multi angularly and positionally adjustable display, device mount. included in FIG. 23 through FIG. 32. and described in detail in FIG. 25. In accordance with the principles of the present embodiment.

FIG. 27 illustrates an overhead view of the same embodiment the cowling #104-A. and rail mount portions of the tactical low profile and multi angularly and positionally adjustable display, device mount. included in FIG. 23 through FIG. 33-D. and described in detail in FIG. 25. fully assembled and disposed upon the weapons rail #1. In accordance with the principles of the present embodiment.

FIG. 28 illustrates an overhead view of the same embodiment of the tactical low profile and multi angularly and positionally adjustable display, device mount. included in FIG. 23 through FIG. 32. In accordance with the principles of the present embodiment.

FIG. 29-A through FIG. 29-D illustrate embodiments of the basic composition of components comprising an embodiment of a display device mount devised for the purpose of securely mounting a display device to the tactical low profile and multi angularly and positionally adjustable display, device mount. included in many of the following drawings. In accordance with the principles of the present embodiments.

FIG. 29-A illustrates an embodiment of a tensioning knob #117-A. as well as a threaded rod #117-B. In accordance with the principles of the present embodiment.

FIG. 29-B illustrates an embodiment of a display device securement member and internal slide portion of this embodiment of a display device mount. In accordance with the principles of the present embodiment.

FIG. 29-C illustrates an overhead view of an embodiment of the display device mounting platform. #105-A. #105-B is an overhead view of the display device cradle. of which is an integral portion of the upper mounting platform portion of #105-A. of which the lower edge portion of the display device would be compressibly secured up against after mounted to same. In accordance with the principles of the present embodiment.

FIG. 29-D illustrates an embodiment of the tensioning knob #117-A and threaded rod #117-B of FIG. 29-A, the display device securement member and internal slide portion of FIGS. 29-B and the display device mounting platform #105-A. In accordance with the principles of the present embodiment.

FIG. 29-E. through FIG. 29-I illustrates another embodiment of a combination internal slide #107-A, and upper compressive display device securement member #107-B. That would be housed inside the inner housing portion of the display device mounting platform #105-A that includes an adjustable display device sun-shield portions #107-G. of same. In accordance with the principles of the present embodiment.

FIG. 29-E illustrates a front view of the uppermost portion of an embodiment of the combination internal slide #107-A, and upper compressive display device securement member #107-B. As well as the lower track plate #107-D. portion of this embodiment of same. that laterally adjustable sun-shield portions #107-G. attach to and are laterally adjustable thereon. In accordance with the principles of the present embodiment.

FIG. 29-F illustrates an embodiment of an assembly of internal slide #107-A, upper compressive display device securement member #107-B, and a sun-shield portion lower track plate #107-D. In accordance with the principles of the present embodiment.

FIG. 29-G illustrates a side view of an outer end portion the embodiment of lower track plate #107-D having two raised tracks 107-F. In accordance with the principles of the present embodiment.

FIG. 29-H illustrates a bottom view of an embodiment of the left-side, laterally adjustable sun-shield portion #107-G showing inset female track portions #107-H in same. In accordance with the principles of the present embodiment.

FIG. 29-I illustrates a bottom view of an embodiment of the right-side, laterally adjustable sun-shield portion #107-G showing inset female track portions #107-H in same. In accordance with the principles of the present embodiment.

FIG. 30 illustrates an overhead view of the embodiment of the tactical low profile and multi angularly and positionally adjustable display, device mount included in FIG. 23 through FIG. 32. fully assembled. In accordance with the principles of the present embodiment.

FIG. 31 illustrates an overhead view of the embodiment of the tactical low profile and multi angularly and positionally adjustable display and device mount, fully assembled. with the display device mounting platform. #105-A. pushed over slightly to the left side of the cowling portion of the device. This action both unlocks the display device mounting platform from its previous vertical angle of adjustment and allows the display devise and the screen portion of same to be re-positioned to its next desired vertical angle of adjustment. In accordance with the principles of the present embodiment.

FIG. 32 illustrates an overhead view of the embodiment of the tactical low profile and multi angularly and positionally adjustable display and device mount. After the user of same vertically adjusted the display device mount along with a digital display device, mounted in same. In accordance with the principles of the present embodiment.

FIG. 33-A illustrates a profile view of an embodiment of a tactical low profile and multi angularly and positionally adjustable display, device mount. this embodiment thereof is equipped for the mounting of this embodiment thereof on the inner wrist or on the inner forearm of the user. in this application. In accordance with the principles of the present embodiment.

FIG. 33-B illustrates a profile view of the tactical low profile and multi angularly and positionally adjustable display, device mount shown in FIG. 33-A. However, this drawing includes only the lower mountable portion of the device. In accordance with the principles of the present embodiment.

FIG. 33-C illustrates a profile view of an embodiment of a tactical low profile and multi angularly and positionally adjustable display, in an open, raised position. This embodiment thereof does not a display mount, because it includes its own integrated display #109. In accordance with the principles of the present embodiment.

FIG. 33-D illustrates the =tactical low profile and multi angularly and positionally adjustable display of FIG. 33-A with the display device #120-B mounted in same. locked down into its closed, non-raised position of non-use. In accordance with the principles of the present embodiment.

FIG. 34-A through FIG. 34-C illustrate and embodiment of a non-tactical embodiment of a low profile display device or display device mount, mountable to a weapons rail on a firearm, In accordance with the principles of the present embodiment.

FIG. 34-A illustrates an overhead of an embodiment of a low profile non-tactical embodiment of a multi vertical angularly adjustable display device mount, mountable to a weapons rail on a firearm, with a display device. #120-B. Mounted on the display device mounting platform #105-A. portion of the display device mounting platform portion of same. With same adjusted and locked into a desired vertical angle of adjustment relative to the weapons rail #1. In accordance with the principles of the present embodiment.

FIG. 34-B illustrates a profile view of the same embodiment of a low profile non-tactical embodiment of a multi vertical angularly adjustable display device mount, mounted to a weapons rail #1 of FIG. 34-A, in an open, raised position for use. In accordance with the principles of the present embodiment.

FIG. 34-C illustrates a profile view of the same embodiment of a low profile non-tactical embodiment of a multi vertical angularly adjustable display device or display device mount of FIGS. 34-A and 34-B, locked into its closed, non-raised position of non-use. In accordance with the principles of the present embodiment.

DETAILED DESCRIPTION OF THE DISCLOSURE

Figure 1:
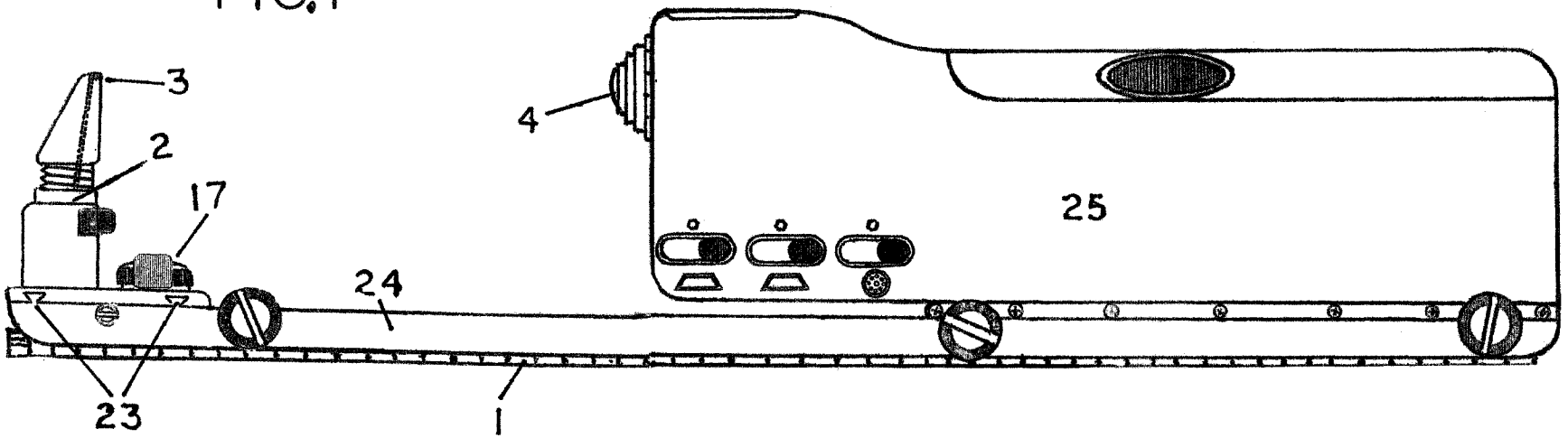
FIG. 1 illustrates a profile view of an embodiment taught here in, of a digital video camera sighting device comprising a combination digital video camera and battery housing portion #25 with an elongated lower portion thereof attachable to a Picatinny accessory mounting rail #1 and a sight adjustable and illuminate able targeting reticle #3. In accordance with the principles of the present embodiment.

The following detailed description and the appended drawings describe and illustrate some embodiments for the purpose of enabling one of ordinary skill in the relevant art to make use the invention. As such, the detailed description and illustration of these embodiments are purely illustrative in nature and are in no way intended to limit the scope of the invention, or its protection, in any manner. It should also be understood that the drawings are not necessarily to scale and in certain instances details may have been omitted, which are not necessary for an understanding of the disclosure, such as details of fabrication and assembly. In the accompanying drawings, like numerals represent like components.

The following detailed description includes variations of a new type of digital video camera firearm sighting and sight acquiring devices. Devised by the applicant primarily for the purpose of providing the users of them with the ability to achieve far greater levels of accuracy, especially at great distances, than any other type of firearm sighting device, previously devised. This as well as to additionally provide the users of them with numerous needful and highly advantageous service providing abilities. Impossibly providable by other types of firearm sighting devices previously devised. The video camera firearm sighting and sight acquiring devices, included in this application, acquire the targeting and surveilled images provided by them by means of a digital video cameras with optical zooming abilities and provide all digital video targeting and surveilled images captured by them, to various types of digital displays and digital display devices, employable by them. Including a broad range of smart digital display devices, also employable by them. Such as smartphones, small tablets. computerized glasses, or even in the tiny screen of a smart watch for that matter.

In an embodiment, a digital video camera sighting device for a firearm may include a targeting reticle unit mountable to a firearm in a first position, and a digital video camera unit separately mountable behind the targeting reticle unit on the firearm in a second position that's different from the first position.

In certain embodiments, an upper portion of the targeting reticle unit may be both vertically and laterally adjustable relative to the digital video camera unit of the sighting device. In certain embodiments, the digital video camera unit may include a plurality of digital video cameras with each possessing fields of view that are different relative to each other. In certain embodiments, a lower portion of the reticle unit may include lateral tracks that are capable of engaging an upper portion of the rail mount. In certain embodiments, the targeting reticle unit may include a targeting reticle that is illuminable. In certain embodiments, the reticle unit further may include an illumination intensity control knob capable of adjusting the illumination of the targeting reticle.

In certain embodiments, the targeting reticle unit may further include a barrel mount attachable to a barrel portion of a firearm. In certain embodiments, the barrel mount comprises a clamping member. In certain embodiments, both the targeting reticle unit and the digital video camera unit, may be mounted to a rail mount, such that the rail mount is capable of securing both the targeting reticle unit and the digital video camera unit to the firearm.

In an embodiment, a camera sighting device for a firearm may include a targeting reticle mounted in a first position on a weapons rail of the firearm, and at least one video camera comprising a field of view separately mounted in a second position on the weapons rail of the firearm at a distance behind the targeting reticle.

In certain embodiments, the at least one video camera may include a plurality of video cameras wherein the field of view of each camera in the plurality of video cameras is different from the field of view of the other cameras in the plurality of cameras. Certain embodiments may further include at least one adjustment member for adjusting a first position of a first video camera of the at least one video camera to align a lens portion of the first digital video camera relative to the targeting reticle. In certain embodiments, a portion of at least one video camera may be housed in a component housing. In certain embodiments, a lens portion of the at least one video camera may not be housed in the component housing. In certain embodiments, the targeting reticle may include a firearm sight or scope separately mounted in front of the at least one digital video camera. In certain embodiments, the targeting reticle may be illuminable. In certain embodiments, the targeting reticle of the may include a power supply. Certain embodiments may further include a rail mount attachable to a weapons rail of the firearm. In certain embodiments, the rail mount connects to targeting reticle or to the at least one video camera using lateral tracks.

In an embodiment, a rear viewing surveillance device mountable to a helmet may include a component housing comprising a base portion securable to a helmet, a digital video camera disposed within the component housing, such that a lens of digital video camera is disposed such that it has a field of view; and a transmitter disposed in the component housing, and in digital communication with the digital video camera such that it is capable of transmitting digital video images provided by the digital video camera to a digital display for the remote viewing of same by the user.

Embodiments of the digital video camera sighting and sight acquiring devices included in this application devised in ways that provide embodiments of them with several modes of employing the screens of smart devices as their targeting screens. But also modes of gaining full access and employability not only to all computing abilities possessed by them, as well as all service enabling software both comprising as well as all downloadable to same, intern is additionally made as fully employable by them due to the mode in which mobile operating systems of smart devices provide full access and employability of all capabilities and services providable by them. due to the modes in which the digital video camera sighting and sight acquiring devices included in this application were devised to employ the screens of same, as their targeting screens, which provides all additional service providing abilities providable by them by means of simple finger gesture controls and even voice commands and although employable in conjunction with. None of which require a cellular service or internet connection of any kind. In that all are equipped with at least one, but are also equippable with different types of digital video image transmitting components that provide all embodiments of them with real time, point to point or device to device digital video communication between the digital video sighting device and the digital display employed by them. Thus rendering same as fully employable in conjunction with a broad range of digital display devices, literally anywhere in the world.

The advanced levels of accuracy possessed by the digital video camera sighting devices included in this application, is primarily attributable to the unique mode in which all acquire targeting acquisition in the first place. Of which among other things, includes a digital video cameras, primarily with optical zooming abilities and illuminable targeting reticles, and with both hard mounted separately on either the top or bottom weapons rail of a firearm and at a distance from each other and in a manner wherein the center of the lens portion of digital video camera portion of the sighting device and the separately mounted illuminable targeting reticle portion of the sighting device, are sight adjustable relative to each other and thus not only do they always remain perfectly true to the target at all times, once sighted in. But the advanced levels of accuracy attained by them, by means of the mode in which they acquire target acquisition, with the tiny illuminated portion of the targeting reticle, being in perfect linear alignment with the exact center of the optical zooming lens portion of the target acquiring digital video camera, always remaining constant due to their hard mounted positions relative to each other on the same weapons rail of the firearm, always remaining constant and perfectly true to the target at all times, with the tiny illuminated portion of the targeting reticle, in perfect linear alignment with the exact center of the lens portions of the target acquiring digital video camera and thus. Not only displayed in the screen of the digital display device employed, in a manner that remains totally free of the effects of target deviation of any kind.

But the targeting images are also captured by the target acquiring digital video camera, with the illuminated portion of the targeting reticle, always positioned in the exact center of the field of view of the optical zooming lens portion of the targeting image acquiring digital video camera portion of the sighting device and thus same are also always provided and displayed in the screen of the digital display device employed by them for the remote viewing of same the users of them in the same manner. This being with the image of the illuminated portion of the targeting reticle, always displayed in the perfect center of its own dedicated digital display or the digital display device employed by them. providing the users of same with not only extremely fast, easy and accurate target acquiring abilities.

But also also providing the digital video targeting images captured by the lens portion of the digital video camera portion of the sighting device with optical zooming abilities, is also provided to the user of same, in a manner in which the targeting images provided are not only instantly magnifiable, but variably magnifiable to any desired level of magnification. additionally providing the user of same with the ability to variably zoom in and acquire target acquisition on extremely distant targets with the same far superior levels of accuracy providable by them while doing so.

Embodiments of the tiny illuminable targeting reticle portions of of same are also provided and employed by the users of same in a manner in which same not only maintain perfect resolution of the targeting reticle when illuminated but same are also provided with controls for same providing the user of them with the ability to alter and adjust same in ways that will also provide all with a full level of operational efficiency and use in all lighting conditions, both at night as well as during the day. Embodiments of them are also structured and configured in a manner that doesn't obstruct the view of the target when the image of the target is magnified many numerous times by the zooming lens of the video camera portion of the sighting device, is zoomed in on a target and the image of same is magnified many numerous times. Thus additionally providing the users of them with the ability to acquire target acquisition on targets of great distances, at the same superior levels of accuracy exclusively providable by them All embodiments of the sighting devices included in this application also include, or are employable with components that provide same with very effective thermal optics or other types of night viewing abilities as well. Thus also providing the very effective employability of them, 24-7 as well.

Embodiments the sighting devices included in this application also acquire target acquisition, by means of a digital video camera, primarily with optical zooming abilities, and primarily with the outer lens portions of same, extending through and mounted to to an outer portion of the digital video camera housing portion of the sighting device as to provide the lens portion of same with not only a perfectly clear, but also with a full broad and unobstructed view provided by same, and the rest of the digital video camera housed in the inner portions of the component housing portion of the sighting device. All digital video surveilled and targeting images captured by these sighting devices are then transmitted to a dedicated display, or to a smart digital display device, employed for the remote viewing of the surveilled and targeting images captured, by the user of same.

Also included in this application. Are both tactical embodiments, of a low profile, multi vertical and horizontal angularly adjustable display, or display device mounts, as well as non-tactical embodiments of them that provide only vertical angler adjustability to the display, or display device mounting portions of them. The tactical embodiments of them. were devised by the applicant primarily to be employed in conjunction with tactical embodiments of the digital video camera sighting devices with optical zooming abilities. Also included in this application. and for the purpose of providing the users of them with the perfect vantage point of the screen portion of display device portion thereof, or mounted on same regardless of the position in which the user would have to position himself, relative to the firearm, employing the sighting device, providing the targeting and surveilled video images displayed in the screen of same, to maintain his entire body behind the protective cover of a wall armored vehicle, corner of a building or other and totally out of the line of fire while doing so.

All tactical and non tactical embodiments of the low profile, multi angularly adjustable display, or display device mounts. Included in this application, possess a lower mounting portion. Comprising of either a rail mount adapted for the mounting of them to a weapons rail portion of a firearm as well as another embodiment of them that includes a strap, adapted for the securement of same. Either to a forward portion of the firearm or to an actual portion of the users body such as an inner portion of the users wrist or forearm. All embodiments of them also include either a display device mounting platform or a dedicated display device adapted for the mechanical securement of same directly to a portion of the devise that provides angularly adjustability to same.

Also included in this application is a helmet mountable rear viewing video camera surveillance device equipped mountable on a rear portion of a soldiers helmet, for the optional employment of same in conjunction with the tactical embodiments of the sighting devices, and other tactical accessories also included in this application, and as employable by our ground troops, or others in our armed forces for surveillance purposes and of which would also be equipped to provide the video images captured by them to and employ, the same digital video display device as is employed by the tactical surveillance sighting devices included in this application, for the viewing of video images captured in the same digital display device screens employed by same.

The primary source of the many problems and restrictions limiting not only the level of accuracy possibly attainable but also the levels range and quality of sighting abilities and service possibly providable, by all other types of firearm sights and scopes. Is firstly caused by and unavoidably inherent to, the modes in which other types of sighting devices, acquire target acquisition in the first place. In that all require the users of them to align the targeting reticle or crosshairs provided in the sight or scope with the target, by means of the users alignment of his own eye with the target and the reticle or crosshairs in the sighting device employed and among other things, its the limitations in everybody's ability to do so, that not only limits levels of accuracy possibly achievable, by all other types and scopes, but the users inability ever precisely do so, is also solely responsible for all levels of inaccuracy caused by the effects of parallax and target deviation, suffered at varying levels by all other sights and scopes and of which becomes far worse relative to distance. due to the modes in which other types of sighting devices acquire target acquisition. Another problem unavoidably suffered by all other types of sights and scopes, being the very limited fields of view possibly providable by the them. resulting not only in difficulty but also costing additional time just to locate the target in the first place, along with all of the time required by the user them in their attempt to accurately take aim on same. This alone has always presented a serious and unavoidable problem, proving evident in all applications and rolls of employment of all other types of firearm sights and scopes previously devised Another problem suffered by all other sighting devices being in their severe lack of operational efficiency, versatility and overall range and levels of services and abilities possibly providable by them. due to the modes in which all other sighting devices both acquire and provide target acquisition to the users of them.

The sighting devices, included in this application, on the other hand. Not only resolve all of the aforementioned problems suffered by other types of sights and scopes previously devised. But the digital video sighting devices with optical zooming abilities included in this application, are also sights that also not only possess far greater levels of accuracy than could possibly be achievable by any other type of sight or scope previously devised, but they additionally possess a broad range of desperately needed, operationally efficient and highly advantages sighting and service providing abilities impossibly providable by either.

The modes in which embodiments of the digital video camera sighting devices included in this application acquire the far superior levels of accuracy along with the broad range of desperately needed and highly advantages abilities exclusively providable by them, is attributable not only to the composition and arraignment of all components both devised and employed and the combined interactions of the combinations of same that provide them with the numerous abilities and attributes exclusively possessed by them. But also by means of the unique modes in which they all work gatherer and employ same in ways that accomplish all tasks needfully performed to provides same with not only all of their abilities needful to acquire target acquisition and employ same in the modes in which they do. that overcomes all of the problems that have always hindered and restricted the levels of accuracy possibly attainable, as well as the range and levels of needful services and sighting abilities possibly providable by any other types of firearm sights and scopes. But the digital video camera sighting devices included in this application do so in ways that additionally provides them with a broad range of needful, extremely effective and highly advantageous service providing abilities impossibly providable by any other type of firearm sights or scopes previously devised. Nor could they ever possibly do so, without employing the same basic foundational modes and combinations of components devised and employed by the applicant to perform the combination of all tasks needful to accomplish and provide the numerous needful service providing abilities exclusively providable by them The present inventions are described in enabling detail in the following examples which may represent more than one embodiment of the present inventions. Accordingly, the components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

FIG. 1 includes a profile view of an embodiment taught here in, of a digital video camera sighting device comprising a combination digital video camera and battery housing portion #25 with an elongated lower portion thereof attachable to a Picatinny accessory mounting rail #1 on a firearm by means of a clamping member portion of same #24. The lower elongated housing portion of the combination digital video camera and battery housing portion of this embodiment of a digital video camera sighting device additionally including tracks #23 integral to and extending laterally across an end portion thereof and enabling both the attachment of, as well as the lateral adjustment of, a sight adjustable targeting reticle unit #2 portion of the digital video camera sighting device. In accordance with the principles of the present embodiment.

Figure 2:
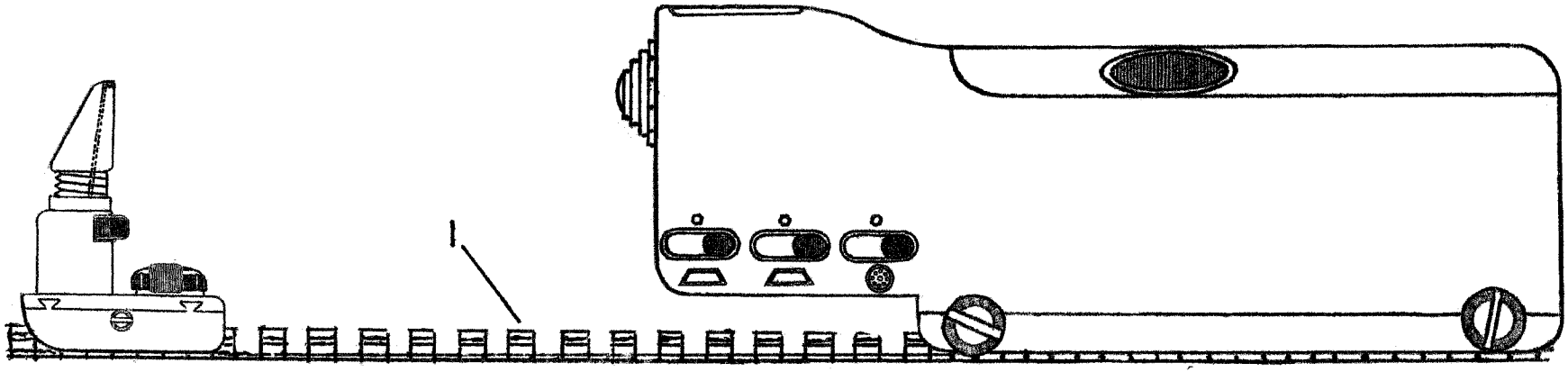
FIG. 2 illustrates a profile view of an embodiment taught here in, of a digital video camera sighting device that shares all but a couple of things common with the embodiment thereof included in FIG. 1 This being both in in the basic configuration and composition of the lower housing portion thereof is neither elongated, nor is same actually integrally connected to the sight adjustable and illuminate-able targeting reticle portion of same. In accordance with the principles of the present embodiment.

Many embodiments of the actual targeting reticle unit portions of the digital video camera sighting devices included in FIG. 1 through FIG. 11. are mounted totally separate from the portion of the sighting device that actually contains the digital video camera portions of the sighting device, like the embodiment thereof included in FIG. 2 along with others that are included as a complete unit, like this embodiment thereof included in FIG. 1 with the sight adjustable and illuminate able targeting reticle #2 connected directly to an end portion the extended rail mount portion of the sighting device. However all of the actual targeting reticle #3 portions thereof are sight adjustable relative to the lens portion #4 of the targeting digital video camera #50 (not shown in this drawing) portion of the sighting device, and are mountable to a Picatinny accessory mounting rail on a firearm #1 in a stationary position relative to the sight adjustable and illuminate able targeting reticle #3 portion of #2.

The separately mounted sight adjustable targeting reticle portion of both digital video camera sighting device's included in FIGS. 1 and 2 possess an actual targeting reticle #3 that is optionally illuminated by means of a combination switch and button battery housing, #17 similar in appearance to those employed on common conventional red dot type sights. Embodiments of this switch and battery housed in same provide both a power source, to illuminate the actual targeting reticle portion thereof, as well as the user of same with variable control of the illuminated intensity of same, by means of an additional variable control switch #14 Other embodiments thereof included in this application additionally provide the users of same with the selective employment of various reticle shapes, patterns and colors as well. in accordance with the principles of the present embodiment. several embodiments of these separately mountable and sight adjustable and illuminate-able targeting reticles are included in the drawings, described detail and will be easily understood in FIGS. 3-A through FIG. 3-I. as well as another barrel mountable embodiment thereof included in FIG. 5.

Figure 9:
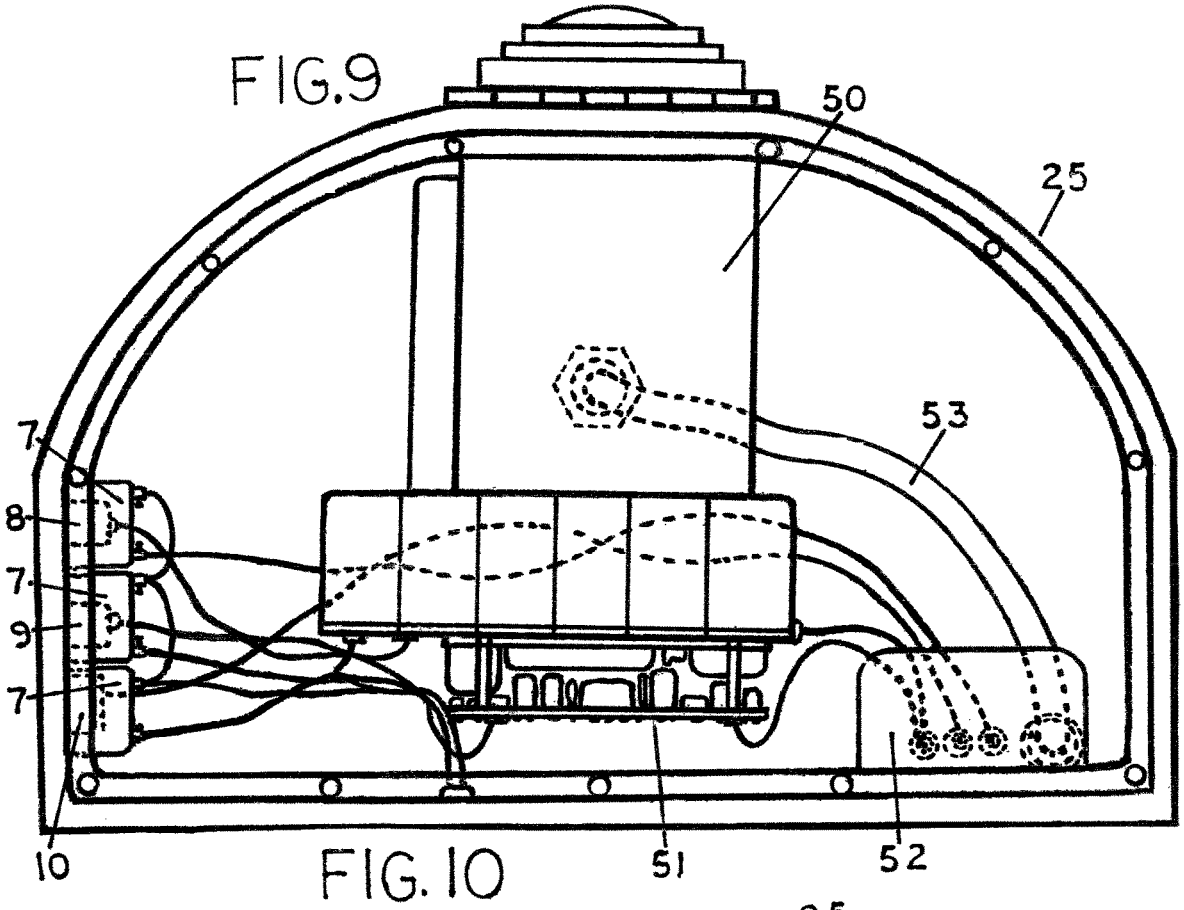
FIG. 9 illustrates an overhead view of an embodiment of the forward portion of the combination digital video camera and battery housing portion #25, of an embodiment of the digital video camera sighting devices Included in this application. As if they'd been turned upside down and the inspection plates as seen in FIG. 7, had been removed. In accordance with the principles of the present embodiment.
Figure 10:
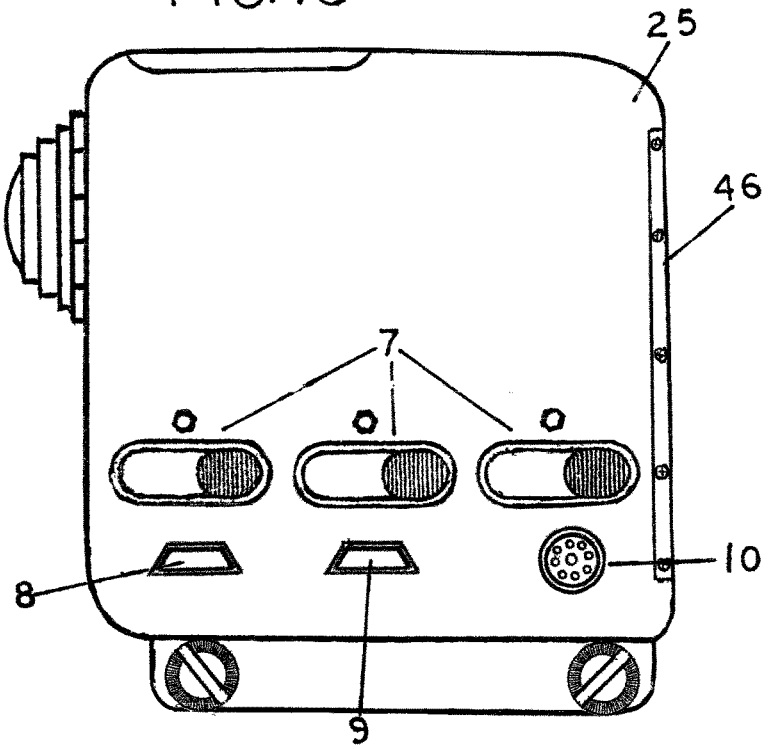
FIG. 10 illustrates a profile view of an embodiment of a digital video camera with optical zooming abilities and digital image transmitting component housing in an optional configuration, containing all of the same basic components as the embodiment thereof included in FIG. 9. however the housing portion #25 in this embodiment thereof does not actually include a battery compartment or its own power supply of any kind. in accordance with the principles of the present embodiment.

The combination digital video camera and battery housing portion of embodiments of the digital video camera sighting device's included in FIGS. 1 and 2 as well as components employable in same and their operational relationship to each other are included, described in detail and will be easily understood in FIG. 9 and FIG. 10. In accordance with the principles of the present embodiment.

Figure 5:
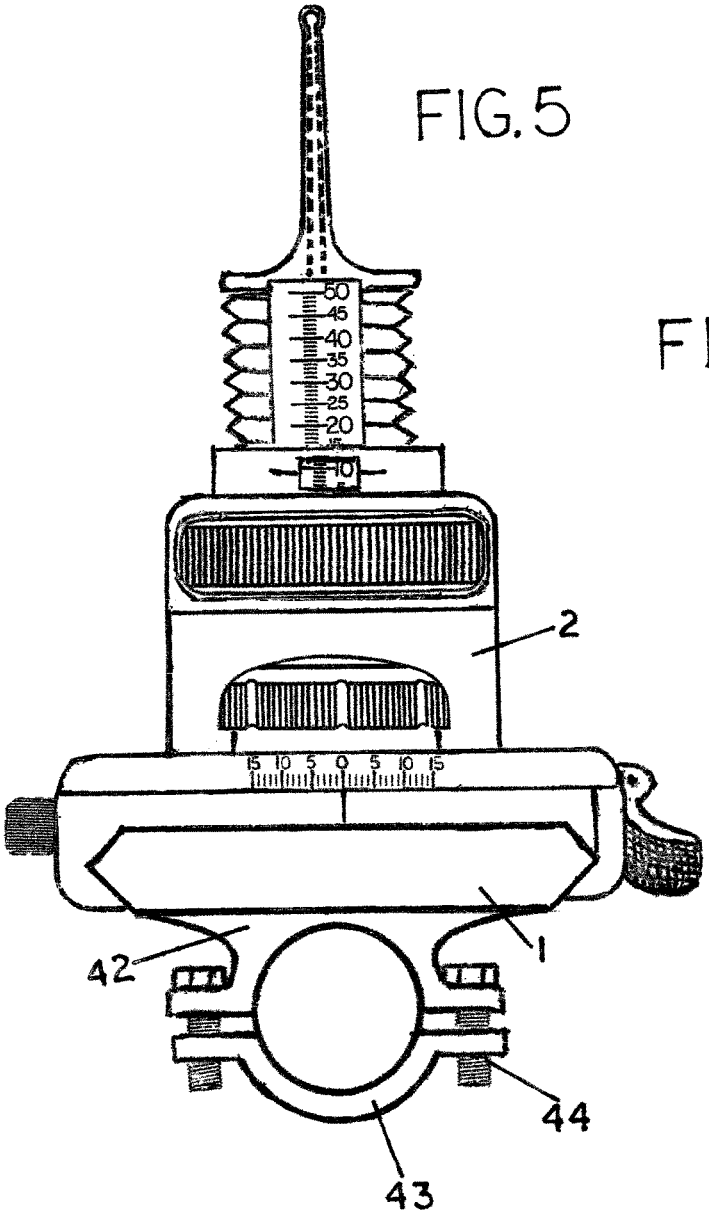
FIG. 5 illustrates a frontal view of an embodiment of a sight adjustable and illuminate-able targeting reticle unit #2. attached to and mounted on a small section of a Picatinny firearm accessory mounting rail #1, in accordance with the principles of the present embodiment. In accordance with the principles of the present embodiment.

FIG. 2 also includes a profile view of an embodiment taught here in, of a digital video camera sighting device that shares all but a couple of things common with the embodiment thereof included in FIG. 1 This being both in in the basic configuration and composition of the lower housing portion thereof is neither elongated, nor is same actually integrally connected to the sight adjustable and illuminate-able targeting reticle unit in this embodiment thereof, but instead this embodiment of a sight adjustable and illuminate-able targeting reticle unit. Although employed in the same manner as the embodiment thereof included in FIG. 1 is actually a separate unite that includes its own clamping member and therefore is attachable to the Picatinny accessory mounting rail of the firearm at any desired distance relative to the forward portion of the digital video camera and battery portion of the sighting device mounted on same. in accordance with the principles of the present embodiment. FIG. 5. Also includes another embodiment of a sight adjustable and illuminate-able targeting reticle unit that's also employed in the exact same basic manner as the embodiment's thereof included in FIG. 1 and FIG. 2 and of which is also a separate unite much like the embodiment thereof included in FIG. 2 with the only actual difference thereof actually being in same including an additional clamping member attachable directly to a portion of the actual barrel of the firearm and employable thereon. In accordance with the principles of the present embodiment.

Figure 3:
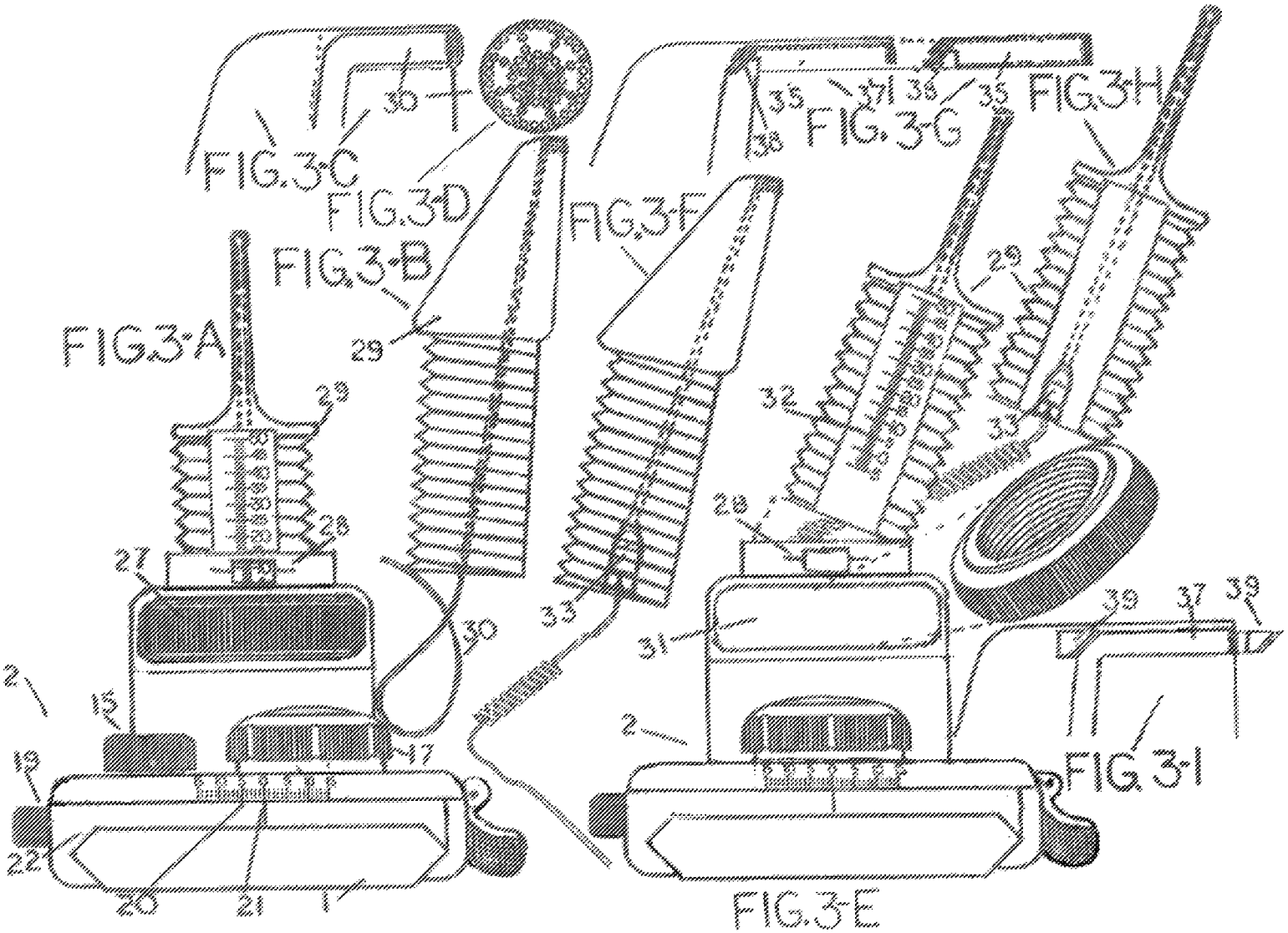
FIG. 3-A illustrates a frontal view of an embodiment of a rail mountable version of a sight adjustable and illuminate-able targeting reticle unit #2. In accordance with the principles of the present embodiment.

FIG. 3-A Includes a frontal view of an embodiment of a rail mountable version of a sight adjustable and illuminate-able targeting reticle unit #2. This drawing thereof provides a good view of the adjustment knob portion #19. Although of which is far better viewed and easily understood in the drawings and descriptions included in FIGS. 4-A and FIG. 4-B. Knob #19 is actually a portion of a thumbscrew employed for enabling the lateral sight adjustment of the targeting reticle unite #2 employed and lateral sight adjustments made by the user of same by means of clockwise and counterclockwise rotation of lateral sight adjustment knob #19 with the adjusted lateral position thereof indicated by means of the position indicating line #21 located on the lower portion of the rail mount #22 portion of #2 solidly mounted to the Picatinny rail #1 portion of the firearm, relative to the marks and numbers on the numbed scale #20 located on the lower frontal base portion of this embodiment of the sight adjustable and illuminate-able targeting reticle unit #2 that is slidably attached to the lateral rail portions #23 of the rail mount #22 of which the upper sight adjustable portion of #2 attaches to and is laterally adjustable thereon. (not viewable in this drawing but viewable in FIG. 1 and FIG. 2. As well as in FIGS. 4-A through FIG. 4-C. Vertical sight adjustments in these embodiments thereof are enabled by means of the clockwise and counterclockwise Rotation of the vertical sight adjustment control wheel #27 and with the adjusted elevation thereof indicated by means of the position elevation indicating line #28. Relative to the position of the numbers and lines on the numbered scale portion of the combination vertically adjustable threaded rod and reticle #29 portion of the sight adjustable and illuminate-able targeting reticle unit. Embodiments of the actual targeting reticle portions of the sighting devices included in this application are all shown and described, as employing different modes to provide and illuminate the tiny targeting reticle portions of them. The applicant has also included several optionally employable modes in which the users of them could be provided with additional employable reticle options, such as that of the actual color of the targeting reticle as well as employable modes to provide the users of them with things like reticle configuration options as well. However the most important aspects needfully possessed by embodiments of the actual targeting reticle portions of the digital video camera sighting sighting devices included in this application, relative to the level and range of effective service providable by them. Being both that of the users ability to instantly locate and most effectively employ the targeting reticle, In all lighting conditions both night and day. Of which is primarily provided to the users of same by means of the reticle light source being equipped with a rheostat as well as a control knob #15, for same. Provided for the purpose of providing the user of same with the ability to variably adjust the illuminated intensity of the tiny light source in which the targeting reticle is illuminated to literally any desired level of illuminated intensity. Of which not only being the only one service providing ability in which all embodiments thereof. Included in this application are provided with and of which would be controlled. In this embodiment thereof by means of the illumination intensity rheostat control knob #15. This drawing of an embodiment thereof is shown as being equipped with an actual reticle selector #17, providing same with many employable reticle configuration as well as reticle color options of either red or green. and of which like other embodiments thereof included in this application would possess its own button battery power source as well.

Another advantageous attribute possessed by embodiments the actual targeting reticle portions of the digital video camera sighting devices with optical zooming abilities. Included in this application, being more in that of the basic configuration of embodiments of the upper portions of #29 as well as actual size of the illuminate-able targeting reticle of which would be extremely tiny. The wide lineal width of #29 is also shown as being configured in the manner in which they are, to provide additional structural strength to the very narrow lateral upper portions of #29 and the targeting reticle portion of same, without adding visual width to the view point of the lens portion of the targeting image acquiring digital video camera portion of the video camera sighting devices with optical zooming abilities and thus providing same with the ability to magnify the the image of the target by same many times without obstructing the image of the target while doing so. In accordance with the principles of the present embodiment.

FIG. 3-B. includes a drawing of profile view of another embodiment of the vertically adjustable portion, of a sight adjustable targeting reticle. embodiment of the combination vertically adjustable threaded rod and targeting reticle #29, removed from the main body portion of an embodiment of the rest of the sight adjustable and illuminate-able targeting reticle unit. This drawing includes a single tiny fiber optic cable #30. Extending up through a passageway comprising both a vertical opening extending from the bottom of the vertically adjustable threaded rod to the very upper inner portion of same and out to the end of an additional very tiny horizontal hole drilled through the very upper aft end portion of this embodiment of the vertically adjustable threaded rod to a point where same inters the upper outer end portion of same and sealed therein, with only the exposed very end portion of the single very tiny fiber optic tube that actually makes up the illuminated portion of the targeting reticle. viewable on the upper outer end portion of same.

This embodiment thereof was included to provide a very simplistic and more economical version of same to produce. This embodiment thereof, would also include only one employable targeting reticle option. This as well as same being provided in only one color. The only function options provided to the actual illuminable targeting reticle provided to this embodiment thereof being that of the users ability to turn same on and off, This as well as this much more simplistic embodiment thereof also being provided only with the ability to variably adjust the illuminated intensity of the tiny light source in which the targeting reticle is illuminated to literally any desired level of illuminated intensity. in accordance with the principles of the present embodiment.

FIG. 3-C. includes an enlarged profile view of the very upper portion of an embodiment of the combination vertically adjustable threaded rod and targeting reticle removed from the main body portion of the sight adjustable and illuminate-able targeting reticle unit This embodiment thereof also includes a tiny fiber optic cable #30. That would extending from the light sources for same and up through the passageway and back out to the upper aft outer end portion of this embodiment of the vertically adjustable threaded rod and illuminated targeting reticle portion of this embodiment thereof in the same basic manner as the embodiment of the much more simplistic embodiment thereof included in FIG. 3-B. However unlike the embodiment included in FIG. 3-B. The fiber optic cable portion of this embodiment thereof includes a plurality of very tiny fiber optic tubes that carry the light sources making up the actual illuminate-able portion of the targeting reticle, all combined in a single very tiny fiber optic cable. This embodiment like several others included in this application would also be initially be provided with a reticle a combination on off switch and rheostat illumination intensity control switch as well as a selective control switch including a plurality of switch positions that direct selective power to individual and combinations of individual light sources with each providing a light source to both individual and pluralities of extremely tiny fiber-optic tubes, then with all combined in a single extremely tiny fiber-optic cable with combinations therein a manner in which various combinations of same make up patterns, such as of extremely tiny tiny crosshairs and, or targeting reticles as various reticle shapes and configurations. Thus providing the user of same with a plurality of reticle choices, as well as possibly color choices of either red or green. in accordance with the principles of the present embodiment.

FIG. 3-D. includes a drawing of an enlarged view of the same embodiment of the very end portion of an embodiment of a tiny fiber optic cable #30 as is included and described in FIG. 3-C. With same comprising a plurality of extremely tiny fiber-optic tubes, in which by means of selective power creating selective illumination both to the individual and, or to the combinations of the individual light sources providing same to the individual, and plurality of extremely tiny fiber-optic tubes, arraigned in a manner in the tiny fiber optic cable #30. in which, by means of selective power to the individual and combinations of light sources, various optionally employable illuminated targeting reticles are provided as optionally employable by the user of same in patterns of tiny crosshairs various reticle sizes, shapes and reticle configurations. of course same could be provided in a far less complex manner and with the plurality of extremely tiny fiber-optic tubes consisting of far fewer of them and with same providing only on or two very simple reticle options or even the provision of only the choice of reticle color and provided by means of a dual element light source and the actual illuminated portion of the targeting reticle comprising only single very tiny fiber-optic tube like the embodiment thereof included in FIG. 3-B. in accordance with the principles of the present embodiment.

FIG. 3-E. Includes a frontal and partially blown up view of an embodiment, of a sight adjustable and illuminate-able targeting reticle unit #2. Wherein both the vertical sight adjustment control wheel #27, as well as the combination vertically adjustable threaded rod and reticle #29, have been removed from the main body portion of the sight adjustable and illuminate-able targeting reticle unit #2. The basic mechanical composition of the portion of these two components, that actually enable the vertical sighting adjustments to be made to the illuminated targeting reticle portion of the vertically adjustable threaded rod. Although very effective. consists of a wheel with machine threads in the inner opening portion thereof, that mesh with the outer threaded portion of the vertically adjustable threaded rod and reticle #29. The outer threaded portion of which also includes one side thereof, that's been milled flat to restrict the rotation thereof, when housed in the main body portion of the sight adjustable and illuminate-able targeting reticle unit, that includes a female receptacle portion thereof with the opening portion of same configured in the same manner as the outer threaded portion of the vertically adjustable threaded rod and reticle #29. and thus restricting the rotation of the threaded member portion thereof in same, while also enabling the threaded member to vertically slide up and down freely therein and thus also be vertically adjusted up and down therein along with the narrow extended upper portion thereof with a very tiny illuminated reticle lite portion of same stationed on the uppermost portion of #29, by means of the clockwise and counterclockwise rotation of vertical sight adjustment control wheel #27, housed in an additional milled portion #31, in an upper side portion of the main body of the sight adjustable and illuminate-able targeting reticle unit #2.

This milled out portion of the main body of #2, is provided in same and configured to accommodate vertical sight adjustment control wheel #27, in a manner as to both restrict any up and down movement of same, while also allowing the outermost portions thereof to freely rotate therein when threaded onto the threaded portion of the vertically adjustable threaded rod and reticle #29. The adjusted elevation of the reticle indicated by means of the position elevation indicating line #28. Relative to the position of the numbers and lines on the numbered scale #32 portion of the combination vertically adjustable threaded rod and reticle #29 portion of the sight adjustable and illuminate-able targeting reticle unit #2. With embodiments thereof constructed of a durable aluminium alloy or other durable non ferrous metal.

This embodiment thereof actually shares all things common with the embodiment thereof included in FIG. 3-A. With the exception thereof being in the the mode in which the illumination of the targeting reticle is provided. This embodiment thereof was added to provide another include one of many additional modes in which a bit more simplistic illuminate-able targeting reticle could be produced and thus keep the production costs of same low, while still producing same in a manner that provides the user of them with very high levels of effective service and efficiency. this embodiment thereof employing one very tiny L.E.D. bulb, of which could also very easily provide reticle color choices of either red or green by means of the employment of a dual filament, L.E.D. bulb, along with a control switch for same including the additional contact points enabling the optional channeling of the variable current provided by same, to the wires leading to and providing current to a choice of either the red or green element in the dual element, L.E.D. bulb, employed in same. This embodiment thereof operates in a very simplistic but very effective manner of which will be much better viewed by means of the drawings and descriptions for same included in FIGS. 3-F through FIG. 3-I. In accordance with the principles of the present embodiment.

FIG. 3-F. Includes a drawing of a profile view of the same embodiment of the combination vertically adjustable threaded rod and targeting reticle #29 as is included in FIG. 3-E as if same had been removed from the main body portion of the sight adjustable and illuminate-able targeting reticle unit #2 to better view and understand the basic composition of components comprising same. Notice that the light source included to produce and the actual targeting reticle portion of same consists of a single tiny L.E.D. bulb, #33 of which may or may not include a dual elements, enabling the optional employment choice of either the red or green illuminated targeting reticle.

Above this tiny L.E.D. bulb, #33. In this embodiment of a combination vertically adjustable threaded rod and targeting reticle #29, additionally includes a smoothly bored and gradually tapered hole #34, that extends upward from an opening in same above the tiny L.E.D. bulb in a manner as to allow light provided by the L.E.D. bulb, #33 to directly pass through same to the ending to a point of 34 just bellow the uppermost inner portion of the combination vertically adjustable threaded rod and targeting reticle #29, where same extends into but not through an inner end portion of a second smoothly bored tiny hole #37, extending laterally from an uppermost aft side portion of #29, wherein a very tiny tube #35 is inserted into #37 and laminated or mechanically affixed in place.

This tiny tube #35 includes a tiny mirror. #38, with the upper back side portion of this tiny mirror laminated to an upper inside and angled downward end portion of this tiny tube #35, with the reflective surface of mirror #38 angled downward on the inner end portion thereof positioned directly over the upper end portion of the smoothly bored and gradually tapered hole #34, with the reflective surface of this tiny mirror #38. set at the proper angle to reflect and redirect the light provided by the tiny L.E.D. bulb, #33. travelling up through bored hole #34 out through said tiny tube #35, Wherein the tiny light omitted from same, in its different forms, provided and employed as the illuminated targeting reticle. In this embodiment of #29. A better view of same as well as a another embodiment thereof included in FIG. 3-G and FIG. 3-I. in accordance with the principles of the present embodiment.

FIG. 3-G. includes a drawing of larger drawing of an embodiment of the upper portion of the combination vertically adjustable threaded rod and targeting reticle #29 as is included as the description for the embodiment thereof included in FIG. 3-F However the drawings included both in FIG. 3-F and FIG. 3-H are both drawings are employable as both profile and frontal views of either embodiment thereof included in FIGS. 3-G or FIG. 3-I. of the upper portions of both in accordance with the principles of the present embodiments.

FIG. 3-H. Includes a drawing of a frontal view of the embodiment of a combination vertically adjustable threaded rod and targeting reticle #29 employable as a drawing of a frontal view of the embodiments thereof included both in FIG. 3-F and FIG. 3-H as well. in accordance with the principles of the present embodiment.

FIG. 3-I. Includes a drawing of the upper portion of a another embodiment of combination vertically adjustable threaded rod and targeting reticle #29 that's even more simplistic in design and easier to produce than than the embodiment thereof included in FIG. 3-G. included only a few small differences from the embodiment thereof described in the description provided for FIG. 3-F. and the drawing included in FIG. 3-G. These differences including the absence of The tiny tube #35 and a tiny mirror. #39, portion of same in that the only reason that the tiny tube #35 is included in the description provided for FIG. 3-F and included in the drawing of the embodiment thereof in FIG. 3-G was to include one of several optional modes in which the mirror portion of same could be easily installed without having to cut a small slot in the upper side portion of #29 to do so. This additional example of an embodiment thereof includes a like tiny mirror as is included in FIG. 3-G. either made as a portion of, or laminated to a small plug and with both of which being the same diameter and circumference as the inside diameter of the lateral hole #37 bored into an uppermost portion of #29 and with both also configured in a manner as to maintain the tiny mirror portion of same at proper angle to perfectly reflect the light between bored out holes #34 and #37 and with the installation of same accomplished by means of the insertion of same into the open aperture end portion thereof, pushing same back and laminating same into the an inner portion thereof in which the reflective surface of mirror #39 angled downward and positionally oriented on the inner end portion thereof directly over the upper end portion of hole #34, with the reflective surface of this tiny mirror #39. set and laminated in place at the proper angle to reflect and redirect the light provided by the tiny L.E.D. bulb, #33. travelling up through bored hole #34 and out through the lateral hole #37, in an uppermost portion of #29, Wherein the tiny light omitted from same, in its different forms, in this embodiment thereof also provided and employed as the actual illuminated targeting reticle, In accordance with the principles of the present embodiment.

Figure 4:
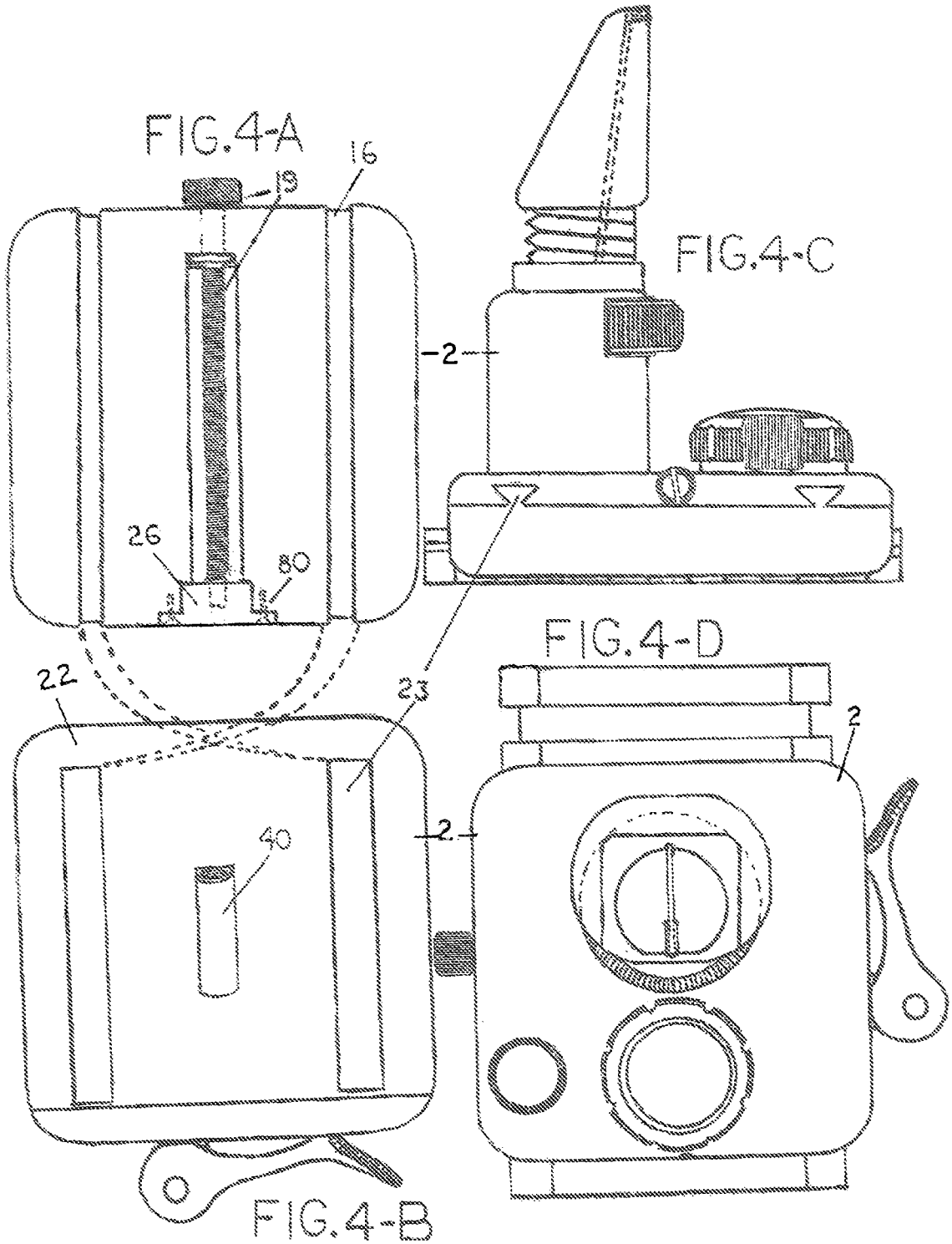
FIG. 4-B illustrates an overhead view of upper surface portion of the lower base portion #22 of an embodiment of the sight adjustable and illuminate-able targeting reticle unit #2. in accordance with the principles of the present embodiment.

FIGS. 4-A. includes a drawing an overhead view of of the bottom surface portion of an embodiment of the base portion of the upper sight adjustable and illuminate-able targeting reticle unit portion of #2. Of which are portions of or employed in conjunction with the embodiments of the digital camera sighting devices included in FIG. 1 through FIG. 11-D. This portion of #2, includes inset female tracks #16 extending laterally all of the way across the bottom portion of the upper sight adjustable portion of #2 and of which are slidably coupled to the male lateral rail portions #23 of the rail mount able portion #22 of targeting reticle assembly #2, and is laterally adjustable thereon by means of lateral sight adjustment knob #19. Of which this embodiment thereof would share basically all things common, as far as the basic mechanical composition of same with the vertical adjustment mechanism #64 as seen in FIG. 17-A. and FIG. 17-B. The threaded member, portion of the of the lateral sight adjustment knob #19. Extends through an outer side portion of #22 and extends through an open inner portion thereof and bottoms out in an opening in the center the removable cheek plate #26 and maintained therein by means of a small C-clip allowing same to freely rotate in the bottom of the base portion of the upper sight adjustable and illuminate-able targeting reticle unit portion of #2. So that when assembled with lower female track portions of the upper sight adjustable and illuminate-able targeting reticle unit portion of #2, is slidably coupled to the male lateral rail portions of 22 and the threaded member portion of the lateral sight adjustment knob #19 threaded through the upper female threaded portion #40 of 22 as seen in FIG. 4-B. Of which the upper sight adjustable portion of #2 attaches to and is laterally adjustable thereon. thus enabling lateral sighting adjustments made to the illuminate-able targeting reticle portion of #2, by means of the clockwise and counterclockwise rotation of the lateral sight adjustment knob #19 in this example of an embodiment thereof.

The assemblage and disassembly of same enabled by means of the removal and reinstallment of removable cheek plate #26 that is inset into and extends across the outer surface portion of the opposite side of the center lateral inset portion of the upper sight adjustable portion of the sight adjustable targeting reticle #2 portion of the sighting device and is mechanically fastenable thereto by means of mechanical fasteners #47. In this example of an embodiment thereof. Drawings of embodiments of same fully assembled in included in drawings and viewable in FIG. 1 and FIG. 2. As well as FIG. 3-A. FIGS. 4-C. and 11-A, in accordance with the principles of the present embodiment. as well as another embodiment thereof in FIG. 5. In accordance with the principles of the present embodiment.

FIG. 4-B. Includes a drawing of an upper surface portion of the lower base portion #22 of an embodiment of the sight adjustable and illuminate-able targeting reticle unit #2. of which the bottom of the upper sight adjustable portion of #2. Viewable in the drawing provided in FIGS. 4-A. attaches to and is laterally sight adjustable on the male track portions #23 which are are an integral portions of 22 and extending laterally across same, enabling both the attachment of, as well as the lateral adjustment of, a embodiment of sight adjustable targeting reticle unit #2 thereon. in accordance with the principles of the present embodiment.

FIG. 4-C. Includes a drawing of a profile view of an embodiment of the sight adjustable and illuminate-able targeting reticle unit #2. with same fully assembled and mounted on a Picatinny mounting rail of a firearm, as a separately mountable unite that includes its own clamping member and therefore is attachable to the Picatinny accessory mounting rail of the firearm and sight adjustable relative to the lens portion of digital video camera portion of same, at any desired distance relative to the forward portion of the digital video camera and battery portion of the sighting device. in accordance with the principles of the present embodiment.

FIG. 4-D. Includes a drawing of an overhead view of the same embodiment of the sight adjustable and illuminate-able targeting reticle unit #2. as is included in FIG. 4-C with same fully assembled and mounted on a Picatinny mounting rail of a firearm. in accordance with the principles of the present embodiment.

FIG. 5. Includes a frontal view of an embodiment of a sight adjustable and illuminate-able targeting reticle unit #2. attached to and mounted on a small section of a Picatinny firearm accessory mounting rail #1, integral to an upper portion of a clamping member #42. with an inner portion thereof configured to extend partially around an outer portion of the barrel of a firearm, and with the side portions of same extending outward, laterally on each side of same and including an opening, or a threaded hole in each for the passing through thereof, or for the threaded mechanical securement of a machine screws #44 in each side of same.

This clamping member portion of the small section of a Picatinny firearm accessory mounting rail #1, also including an additional portion of the clamping member. #43, with #43, also including an inner portion of same, configured to extend around a portion of the apposing outer portion of the barrel of a firearm and with same also including side portions extending outward and laterally on each side thereof and with same also including an opening, or a threaded hole in each side portion thereof align-able with the openings or threaded holes in each side portion of the upper portion of clamping member #42. enabling both the mechanical securement of #42 with #43 and thus the compressive mechanical securement of the small section of the Picatinny firearm accessory mounting rail #1, integral to same, to a portion of the barrel of a firearm, with this drawing including an embodiment of the sight adjustable and illuminate-able targeting reticle unit #2. Solidly mounted on the upper portion of same and thus enabling both the positionable mechanical securement of #2 as well as the employment of same on the barrel of the firearm by means of the clockwise rotation of the two machine screws #44, and thus enabling the linear alignment of the reticle portion of the sight adjustable and illuminate-able targeting reticle unit #2, with the lens of digital video camera sighting device equipped for the employment of same. anywhere on the barrel of the firearm. In accordance with the principles of the present embodiment.

Figure 6:
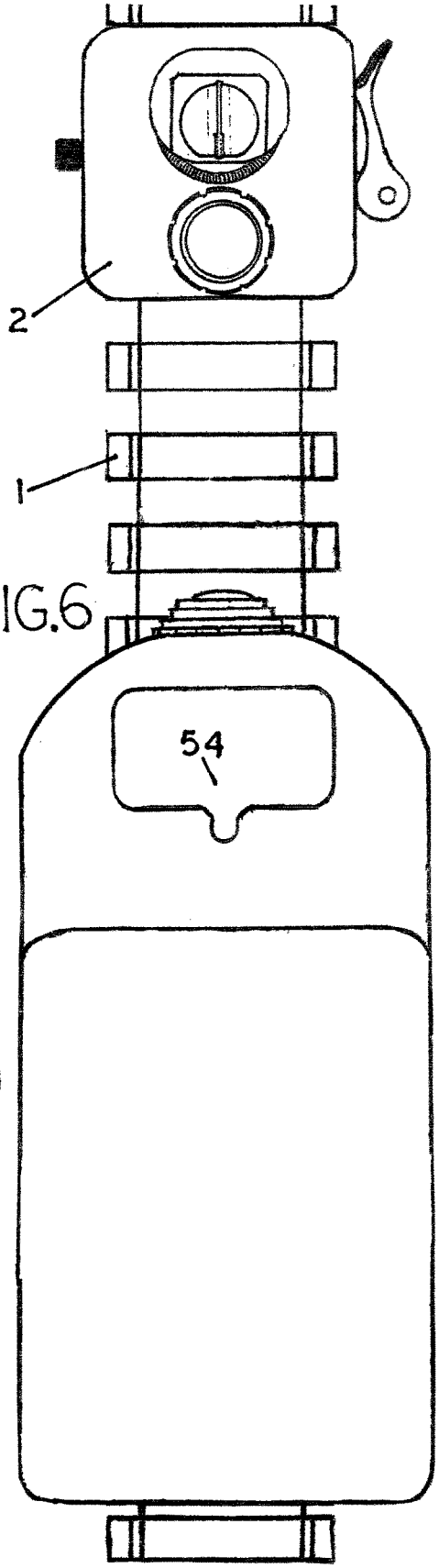
FIG. 6 illustrates a drawing of an overhead view of the same embodiment of a combination sight adjustable and illuminate-able targeting reticle unit #2. and the same embodiment of a digital video camera and battery housing portion of the sighting device as is included in FIG. 2. in accordance with the principles of the present embodiment.

FIG. 6. Includes a drawing of an overhead view of the same embodiment of a combination sight adjustable and illuminate-able targeting reticle unit #2. and the same embodiment of a digital video camera and battery housing portion of the sighting device as is included in FIG. 2. With same mounted on a section of a Picatinny firearm accessory mounting rail of a firearm #1, and like the embodiment thereof included in FIG. 5. the sight adjustable and illuminate-able targeting reticle unit #2. Is a separate unite that includes its own clamping member and therefore is attachable to the Picatinny accessory mounting rail of the firearm and sight adjustable relative to the lens portion of digital video camera at any desired distance relative to the forward portion of the digital video camera and battery portion of the sighting device. of which also includes an omnidirectional flush mounted 5-G digital image transmitting antenna enabling 5-G device to device digital wireless video communication between same and a 5-G smart display device (not shown) employed as a targeting screen for same by same in accordance with the principles of the present embodiment.

FIG. 7 Includes a drawing of an overhead view of the underneath portion of the same embodiment of the the combination digital video camera and battery housing portion #25, of the sighting device, included in FIG. 2, FIG. 6. and FIG. 8. This drawing thereof provides a good view of the basic components comprising the rail mountable stationary clamping member portion #13, of the combination digital video camera and battery housing portion #25. Notice that the rail mountable clamping member portion #48, also includes upper portions that secure #48 to #25 at the same time that it compressibley secures the sighting device to the weapons rail (not shown). in this embodiment thereof. Neither #13 or #48 extends all of the way to the forward end portions of the digital video camera housing portion of the sighting device sighting device. In this embodiment thereof, but instead extends only up to an aft end portion of an inspection plate #45. Of which this drawing thereof includes #45, as if the mechanical fasteners #47, securing same to the forward bottom housing portion of this embodiment of the digital video camera sighting device had been removed, along with inspection plate #45. Of which was included in various examples of embodiments of the digital video camera and battery housing portions, of the digital video camera sighting devices included in this application, to enable of full access to the forward portions thereof that actually houses the digital video camera, as well as the night viewing and additional components and modules, enabling things such as different forms of digital image communication between the digital video camera and the dedicated digital display or smart digital display device employed by same, as well as to all of the connections between same as well as all swishes and controls providing selective control of electrical communication between the battery power source and same. in accordance with the principles of the present embodiment.

A couple of embodiments thereof, as well as couple examples of optional variations of components employable in same, are included and described in much further detail and will be easily understood, in the drawings an descriptions of examples thereof included in FIG. 9 and FIG. 10.

FIG. 8. Includes a drawing of an overhead view, of one of the embodiments of a digital video camera and battery housing portion of one of the digital video camera sighting devices included in this application. As if the lid portion of the battery compartment (Not shown.) Was removed to view battery pack #75 housed therein. Other embodiments of the digital video camera sighting devices included in this application produced for the employment of same by our armed forces, may also be produced as embodiments thereof that don't actually include their own power supply, but instead, are provided power by means of direct electrical communication between same a separate battery pack provided to and employed by our ground troops to power other equipment employed by them. in accordance with the principles of the present embodiment, as well as other embodiments thereof included in this application. in accordance with the principles of the present embodiment.

FIG. 9, includes a drawing of an overhead view of an embodiment of the forward portion of the combination digital video camera and battery housing portion #25, an embodiment of the digital video camera sighting devices Included in this application. As if they'd been turned upside down and the inspection plates as seen in FIG. 7, had been removed from the forward bottom portion of same, to view some of the optionally employable embodiments of components housed inside and enabling functionality to this portion of an embodiment of the digital video camera sighting devices included in this application. Of which there are actually many variations thereof employable in them and have been employed and both bench and field tested in many rough embodiments thereof as a result of efforts on the applicants part, to determine those and combinations thereof that provide the highest level of needed service and abilities providable by same.

The applicant has also not only always kept up on the latest digital optic technologies applicable but also spent a good amount of time contacting companies and searching the internet for components needful to to effect a higher level, quality, or range of service providable by these sighting devices that also meet all size, energy consumption and component compatibility requirements, needful and of which all attainable by the applicant have been purchased employed and tested in numerous ways with all types of digital video cameras, findable and applicable, as well as with all modes of digital image transmission between the various types of digital video cameras employed in same and the various types of digital displays and of course the numerous types and variations smart digital display devices employable by them. Of which also provides these sighting devices with the countless additional abilities by means of not only online. But also all stand alone offline mobile applications as well, In that even though employable. No components have ever been employed in any digital video camera sighting device devised by the applicant, that ever actually required an internet connection of any kind to transmit or transfer digital video images between sighting device and the digital display device employed by same. and thus rendering all embodiments of these sighting devices, as employable any where in the world. All employable modes and types of components and combinations thereof findable and attainable by the applicant that enable optional employable modes of device to device or what is also referred to as point to point digital video communion, between the digital video cameras employed in same and the digital display, or smart digital display device employable by same. have also been purchased and thoroughly tested in them as well and of which, although fairly restrictive actual real time direct digital video communication has proven to be providable by means of both direct wire and fiber optic digital video communication. Modes of 5-g device to device digital video communication enabling components also employable in them are also capable of enabling extremely close to true real time digital communication between the digital video camera sighting device and the 5-G enabled display device employed by same as well. Other types of point to point digital video radio communication such as WIFI and F.P.V. Frequencies have also been employed and tested in various ways as well but both suffer with unacceptable and unresolvable lag time issues. Although all are actually employable and all of which possess certain advantages and disadvantages of one sort or another, to each other, that the applicant is fully aware of as a result of research and much testing of same.

As a result thereof. The applicant has experienced several advancements in the levels of efficiency, as well as the quality and levels of service attainable by them by means of component employment options. As a result thereof. Drawings of the composition of some of the more advanced components enabling basic functions and abilities possessed by embodiments of these digital video camera sighting devised by the applicant are included in FIG. 9. Some of which only reticently found and tested by the applicant that meet all size, energy consumption and component compatibility requirements, requisite to their effective employment in these sighting devices and of which will provide same with very high quality and levels of the abilities they possess.

Included in this drawing of a very high quality digital video camera with electrically and remotely controllable optical zooming abilities #50. As is included in FIG. 9. However the applicant. Has also found many other types and variations high quality, but more cost effective digital video cameras with optical zooming abilities that would still lend themselves well to their employment in them. but do so in a manner in a manner that provided a slightly lower level of same operational ease while doing so. Another fairly cost inhibitive component included in FIG. 9. Are the two tiny circuit boards #51. That in part, provide this portion of this embodiment of the digital video sighting device with very effective thermal optic night viewing abilities. And of which lend themselves quite well to their employment in these digital video camera sighting devices with optical zooming abilities.

However less expensive embodiments of these digital video camera sighting devices could and may be produced in models of same employing far more common and less expensive components that were actually employed during some of the initial stages of the development and testing of them. Of which were equipped with only inferred viewing abilities and were equipped with inferred illuminators and therefor same possessed only inferred night viewing abilities of which not only possessed higher energy requirements, but also suffered from serous range limitations as well.

However, even though the employment of these much more cost effective and lower tech components. reduced the level and quality of services and abilities providable by these digital video camera sighting devices to a certain percent. All still possessed the same key attributes, devised by the applicant that provide them, with the far greater attainable levels of accuracy, than any other type of sighting device previously devised. And of which proved evident during the testing process of all embodiments tested regardless of the components employed in them. Notice that the outer lens #4 portions of the digital video camera employed in the embodiment of the digital video camera sighting devices included in FIG. 9 as well as others included in this application are actually mounted on the outside of the actual housing #25 portions of the sighting devices themselves.

The mounting of the digital video optical zooming cameras with outer lens #4 portions of same actually mounted on an outside portion of the actual housing #25 portion of the sighting device. This not only resolves all field of view restrictions and insures field of view of view provided to same remains totally unrestricted at all times and thus limited only by the field of view possessed by the digital video cameras employed in them. This as well as with same remaining unhindered in any way from acquiring a perfectly clear view at all times. This as well as even the ability to keep the lens portion of same perfectly clean during times of non use and ready to employ by means of a simple lens cap.

However far more important. The external mounting of the outer lens portions of the video camera with optical zooming abilities also enables the employment of any type of digital video camera with an optical zooming lens assembly, including the type that extends outward. Of which a large portion of them do, especially those capable of magnifying the targeting images many, many times. The external mounting position of the outer lens portions of the video camera with optical zooming abilities, also enables the employment of a high quality but much less expensive type of digital video camera with an optical zooming lens assembly that's zoomed in and out manually Some of the additional optionally employable composition of some of the main components included in this embodiment of a forward digital video camera with optical zooming abilities and digital video image transferring or transmitting component housing #25 portion of an embodiment of one of the sighting devices included in this application and included here in FIG. 9. includes the aforementioned high quality digital video camera with electrically and remotely controllable optical zooming abilities #50. as well as the aforementioned two tiny circuit boards that comprise the greatest portion of the components providing this portion of this embodiment of the sighting device with thermal optic viewing abilities, of which was actually removed from other thermal optic viewing equipment and hardwired into same which actually worked quite well. #52 in this drawing is shown as being one of the many types of digital image transmitting or transferring modules, that enable or additionally enable one of the many forms of digital image communication between the digital video camera portion of the sighting device and the digital display device employed as a targeting screen for same The digital image transmitting module #52, in this drawing is actually shown as being a 5-G The digital image transmitting module in that the antenna wire #53 coming out of same is running up to a very low wattage omnidirectional antenna #54 mounted to a upper housing portion of the digital video sighting device as seen in FIG. 6. although these digital video sighting devices are also equippable with many other types digital image transmitting components as well enabling things such as different forms of digital image communication between the digital video camera and the dedicated digital display or smart digital display device employed by same, such as components or modules enabling fiber optic, digital video communication employed by our armed forces as well as. 5-G, direct wire, and even WIFI and F.P.V. point to point digital video communication between the digital video camera sighting device and the dedicated digital display or smart digital display device employed by same. Although the applicant has pretty much fazed away from employing almost all forms of WIFI and F.P.V. point to point digital video communication due to lag times and data restrictions relative to the larger frequency wave lengths associated with both. #7 are switches providing selective control of electrical communication between the power source and the components in this portion of the sighting device needful of same. #8 is shown as being micro USB receptacle either in direct electrical communication with the batteries enabling a secondary mode for the recharging of same while housed in a battery compartment portion of same (not shown) #9. is shown as being an additional micro USB receptacle in providing the optional provision of direct wire digital video communication between the digital video camera sighting device with optical zooming abilities and the dedicated digital display or smart digital display device employed by same. #10 is shown as being a tiny fiber optic cable receptacle enabling direct fiber-optic communication between a fiber optic digital image transferring module and a dedicated display equipped to employ fiber optic digital video communication. Primarily employed by our armed forces. (but not shown as being equipped with same in this embodiment thereof). In accordance with the principles of the present embodiment.

FIG. 10. Includes a drawing of a profile view of an embodiment of a digital video camera with optical zooming abilities and digital image transmitting component housing in an optional configuration, containing all of the same basic components as the embodiment thereof included in FIG. 9. however the housing portion #25 in this embodiment thereof does not actually include a battery compartment or its own power supply of any kind, like all other embodiments thereof included in this application. but instead would be provided power by means of direct wire electrical communication with a remote power source and with this embodiment thereof receiving same through the micro USB receptacle #8 and directly to the switches #7, providing selective control of electrical communication between the power source and the components in this portion of the sighting device needful of same. in accordance with the principles of the present embodiment.

This drawing also provides a better view of #9. shown as being an additional micro USB receptacle for embodiments thereof equipped image transmitting components enabling direct wire digital video communication between the digital video camera sighting device with optical zooming abilities and the dedicated digital display or smart digital display device employed by same. #10 is shown as being a tiny fiber optics cable receptacle enabling direct fiber-optic communication between same by means of a tiny fiber-optics cable and a fiber optic digital image transferring module if employed in same and a dedicated display equipped to employ fiber optic digital video communication. Notice the positional orientation of the access panel #46 provided both for the enabling both easy assemblage as well as to provide easy access to all components housed in #25 in the possible event wherein future maintenance or repairs ever become needfully performed on same, is located on a backside portion of #25 instead of a bottom portion of same, wherein this embodiment includes a weapons rail mounting portion. Integrally connected directly to the bottom portion of #25. in accordance with the principles of the present embodiment.

FIG. 11-A. through FIG. 11-D all include drawings of overhead views of the basic breakdown of the extra long rail mounting portion #24. of the embodiment of the sighting device included in the drawing of FIG. 1 as well as views of both the a combination digital video camera and battery housing portion #25 of the digital video camera sighting device as well as the illuminate able and both laterally and vertically sight adjustable targeting reticle #2 portion of the digital video camera sighting device removed from same. in accordance with the principles of the present embodiment.

FIG. 11-A. includes a drawing of an overhead view of the same embodiment a digital video camera sighting device comprising a as well as an illuminate able and both laterally and vertically sight adjustable adjustable targeting reticle attached to a long rail mounting portion #24. of the embodiment of the sighting device. As is included in the drawing of FIG. 1. With the sighting device completely assembled and mounted on a Picatinny mounting rail. in accordance with the principles of the present embodiment.

FIG. 11-B. includes a drawing of an overhead view of the same embodiment the combination digital video camera and battery housing portion #25 of the sighting device as is included in FIG. 11-A removed from the long rail mountable portion of the sighting device and turned upside down, to provide a view of a male flange #57 portion of the bottom side of the battery housing portion #25 of the sighting device. This male flange #57 extends around the outer periphery of an additional male flange #58, which is a portion of the upper surface of the long rail mounting portion #24. as seen in FIG. 11-C. And is mechanically fastened thereto when assembled. In accordance with the principles of the present embodiment.

FIG. 11-C. Includes a drawing of an overhead view of the upper surface portion of the long rail mounting portion #24. of the same embodiment of the sighting device, included in FIG. 11-A, with both the combination digital video camera and battery housing portion #25 of the sighting device as well as the sight adjustable and illuminate able targeting reticle portion of the sighting device as is included in FIGS. 4-A through FIG. 4-D. removed from same and laid on its side, beside the long rail mounting portion #24 of the sighting device. In accordance with the principles of the present embodiment.

FIG. 11-D. Includes a drawing of an overhead view of the bottom portion of the rail mountable portion of the long rail mounting portion #24. of the same embodiment of the portion of the sighting device, as is included in FIG. 11-C. This drawing also includes the clamping member portion of same #61 along with the thumb screws #62 provided to extend through same and across an inner bottom portion of 24 and thread into an outer portion of #24 configured for the securing of same to a weapons rail on a firearm. so that by means of the clockwise and counterclockwise rotation of the thumbscrews #62 the sighting device is either secured to, or removed from a weapons rail on a firearm. In accordance with the principles of the present embodiment.

FIGS. 12-A. through FIG. 20. Include embodiments of the video camera sighting devices that are sighted in, by means of both horizontal and vertical sighting adjustments made to the actual digital video camera and digital image transmitting component housing portion of the sighting device itself and thus the very center of the outer lens portions of the digital video camera portion of same, relative to the illuminated targeting reticle portion of the sighting device separately mounted at a distance in front of same on the firearm.

FIG. 12-A includes a drawing of a profile view of an embodiment taught here in, of a digital video camera sighting device. of which would actually be employable with the same basic types and variations of digital video cameras and digital image transmitting components as are employable in the embodiments thereof included in FIG. 1 through FIG. 11-D. However notice the actual digital video camera and digital image transmitting component housing #59 portion of this, as well as all of the following embodiments of the sighting device included in this application, are quite different, in that housing #59. Is not actually an integral part of the battery compartment #63 portion of the sighting device, but instead is actually a separate portion of the sighting device, that's vertically adjustable thereon, by means of the clockwise and counterclockwise rotational of the knob portion of thumbscrew adjustment mechanism #64. Best seen and fully described in FIG. 17-A. #68 is an indicating mark on a side portion of the digital video camera and digital image transmitting component housing #59 employed as a pointer to referencing vertical sight adjustments made to the elevation of the center of the lens portions of the digital video camera portion of the sighting device relative to the targeting reticle #3. portion of the stationary mounted illuminated targeting reticle unit #5. Portion of the sighting device mechanically fastened to the weapons rail #1 of the firearm in front of and at a desired distance from the center of the outer optical zooming lens portion of the digital video camera employed in same.

Figure 19E:
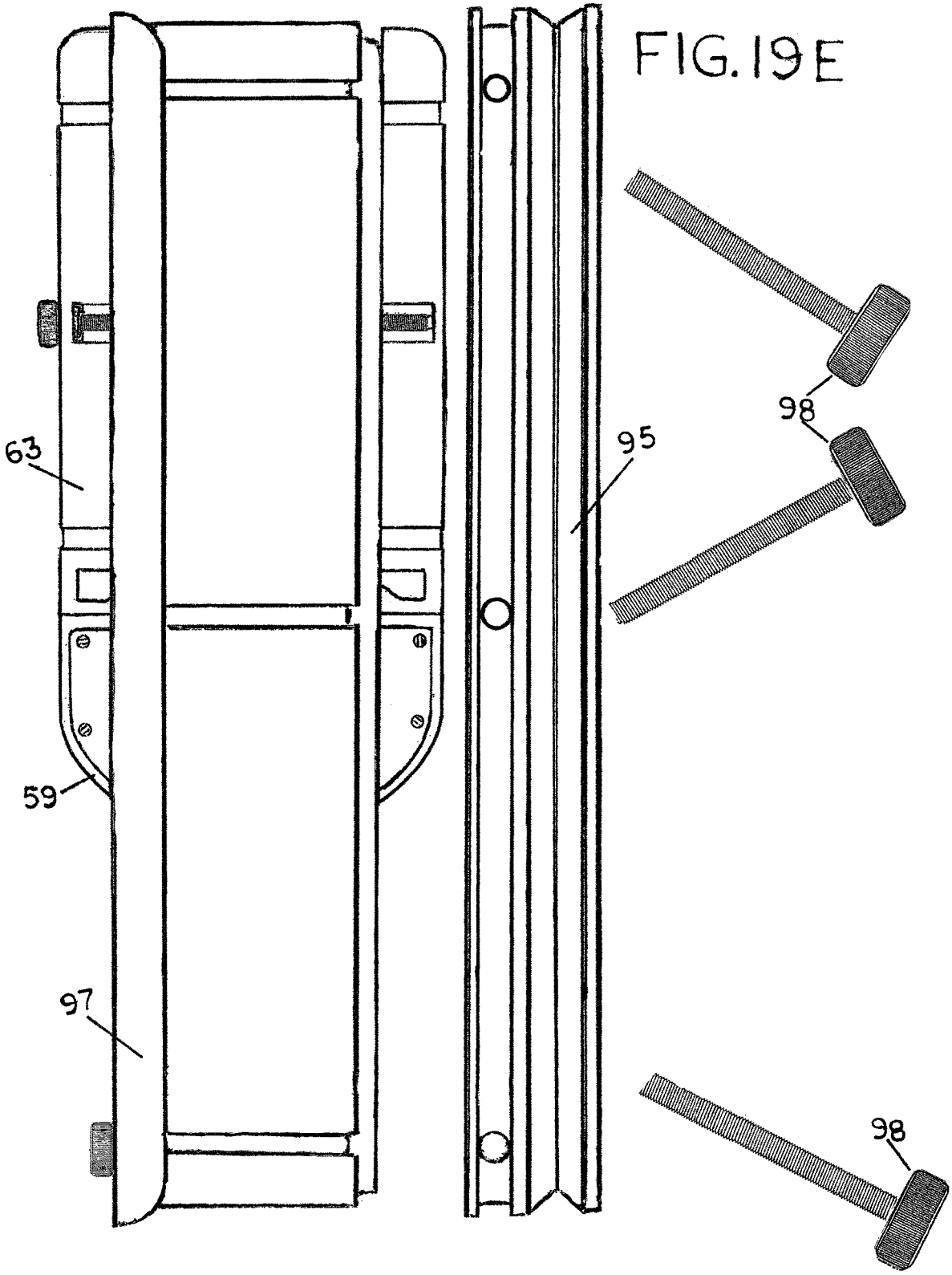
FIG. 19-A illustrates a bottom view of an embodiment of a the bottom of a digital video camera and digital image transmitting component housing #59 having removable cover plate that enables access to inner components. In accordance with the principles of the present embodiment.

Vertical sighting adjustments made relative to same referenced by means of the numbered vertical sight adjustment reference marks #67 on a side portion of the battery compartment #63. lateral or horizontal sighting adjustments made to the alignment of the center of the lens portions of the digital video camera portion of the sighting device relative to the targeting reticle #3. portion of the stationary mounted illuminated targeting reticle unit #5. are made by means of the clockwise and counterclockwise rotational thumbscrew adjustment mechanism #69. best seen and described in detail in FIGS. 19-A and 19-B. In accordance with the principles of the present embodiment.

FIG. 12-B includes a drawing of a profile view of an embodiment taught here in, of a digital video camera sighting device, that's includes all of the same basic components and shares all but a couple things common and is employed in the same manner as the embodiment thereof included in the embodiment thereof included in FIG. 12-A. and FIG. 12-D. These differences being that in this embodiment thereof is made and employed as a single unit. Notice that the illuminated targeting reticle unit #5. portion of the sighting device in this embodiment thereof is actually an integral part of the forward end portion of an extended lower weapons rail mounting portion of the sighting device and of which the battery housing portion of the sighting devices attaches to tracks #65 on the upper aft surface portion thereof and is laterally adjustable thereon, relative to the targeting reticle unit #5 and the illuminated targeting reticle #3 Portion of the sighting device on the forward end portion thereof. In accordance with the principles of the present embodiment.

FIG. 12-C. Includes a drawing of a profile view of an embodiment taught here in of a combination knob and thumbscrew vertical adjustment mechanism #64. and a cover plate #70. in which #64 extends through and is freely rotatable therein. This cover plate along with thumbscrew adjustment mechanism #64. is mechanically fastenable to an upper forward portion of the battery compartment portion of the sighting devices included in FIGS. 12-A through FIG. 20. included as a mechanism to enable vertical adjust-ability of #59 relative to #63 and thus sighting adjustments the center of the lens portions of the digital video camera portion of the sighting device relative to the stationary illuminated targeting reticle #3. by means of the clockwise and counterclockwise rotational of the knob portion of thumbscrew adjustment mechanism #64. In accordance with the principles of the present embodiment.

FIG. 12-D. Includes a drawing of a profile view of the same embodiment taught here in, of the same sighting device as is included in FIG. 12-A. This drawing thereof includes the thumbscrew vertical adjustment mechanism #64. and a cover plate #70. as seen in FIG. 12-C removed from the upper forward portion of the battery compartment, along with the entire digital video camera and digital image transmitting component housing #59 removed from the battery housing #63 portion of the sighting device. Of which is slidably attached thereto, by means of male and female interlocking tracks also seen and described in drawings of FIG. 15. Through FIG. 17. In accordance with the principles of the present embodiment.

Figure 13:
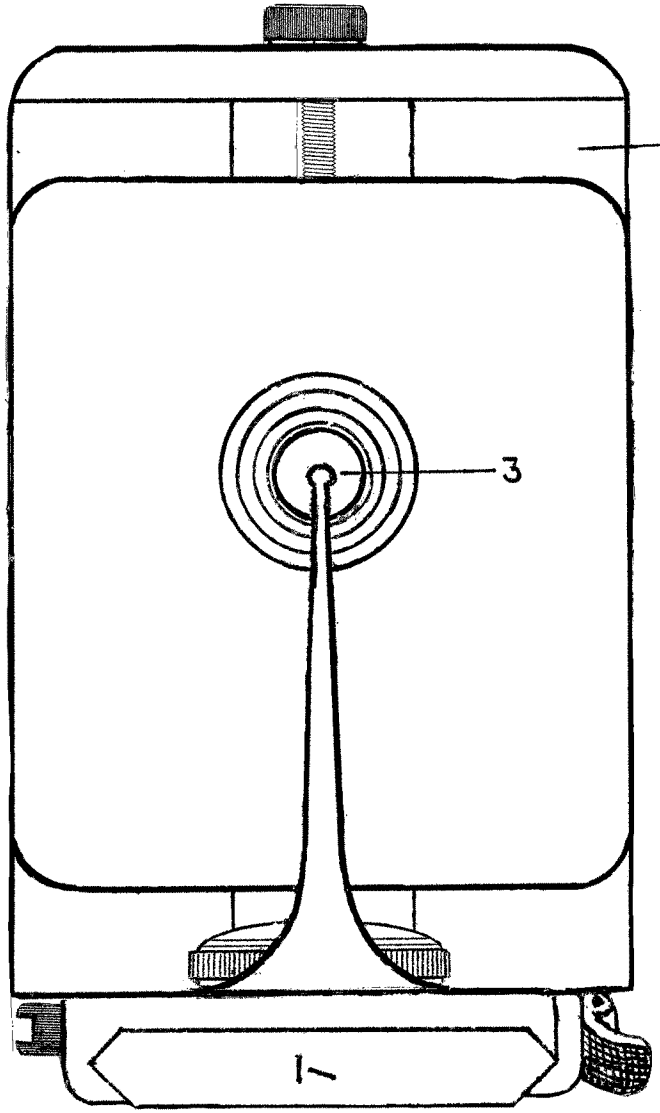
FIG. 13 illustrates a frontal view of an embodiment of one of the sighting devices included in FIGS. 12-A through FIG. 20. This drawing shows the back side, of the stationary mounted illuminated targeting reticle unit #5. Portion of the sighting device, along with a forward view of the digital video camera and digital image transmitting component housing #59 and battery housing #63. In accordance with the principles of the present embodiment.

FIG. 13. Includes a drawing of a frontal view of an embodiment of one of the sighting devices included in FIGS. 12-A through FIG. 20. This drawing shows the back side, of the stationary mounted illuminated targeting reticle unit #5. Portion of the sighting device, along with a forward view of the digital video camera and digital image transmitting component housing #59 and battery housing #63 portion of the sighting device. mechanically fastened to the weapons rail #1. In linear alignment with each other. In accordance with the principles of the present embodiment.

Figure 14:
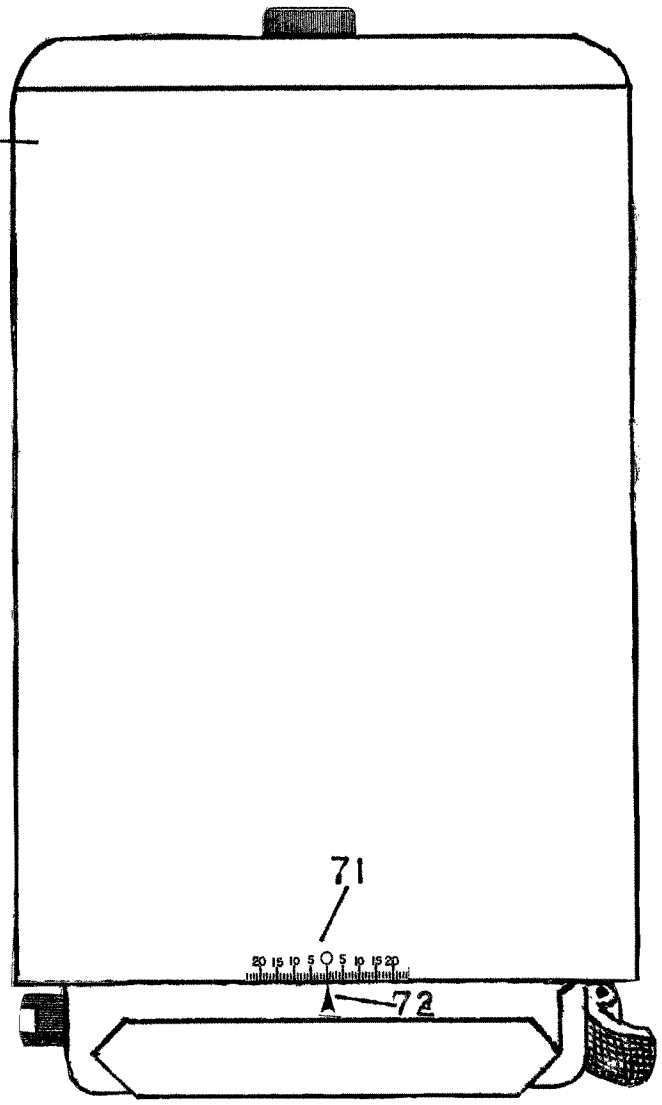
FIG. 14 illustrates a view of the back side of an embodiment taught herein, of one of the sighting devices included in FIGS. 12-A through FIG. 20. This drawing was included to show a small numbered scale #71 located on a lower back side portion of the battery housing #63, In accordance with the principles of the present embodiment.

FIG. 14. Includes a drawing of a view of the back side of an embodiment taught herein, of one of the sighting devices included in FIGS. 12-A through FIG. 20. This drawing was included to show a small numbered scale #71 located on a lower back side portion of the battery housing #63, portion of the sighting device, just above an indicating mark #72 located on an upper back side portion of the rail mount #12, portion of the sighting device provided to indicate amounts of lateral or horizontal sighting adjustments made to the sighting device. In accordance with the principles of the present embodiment.

Figures 15, 16, 18:
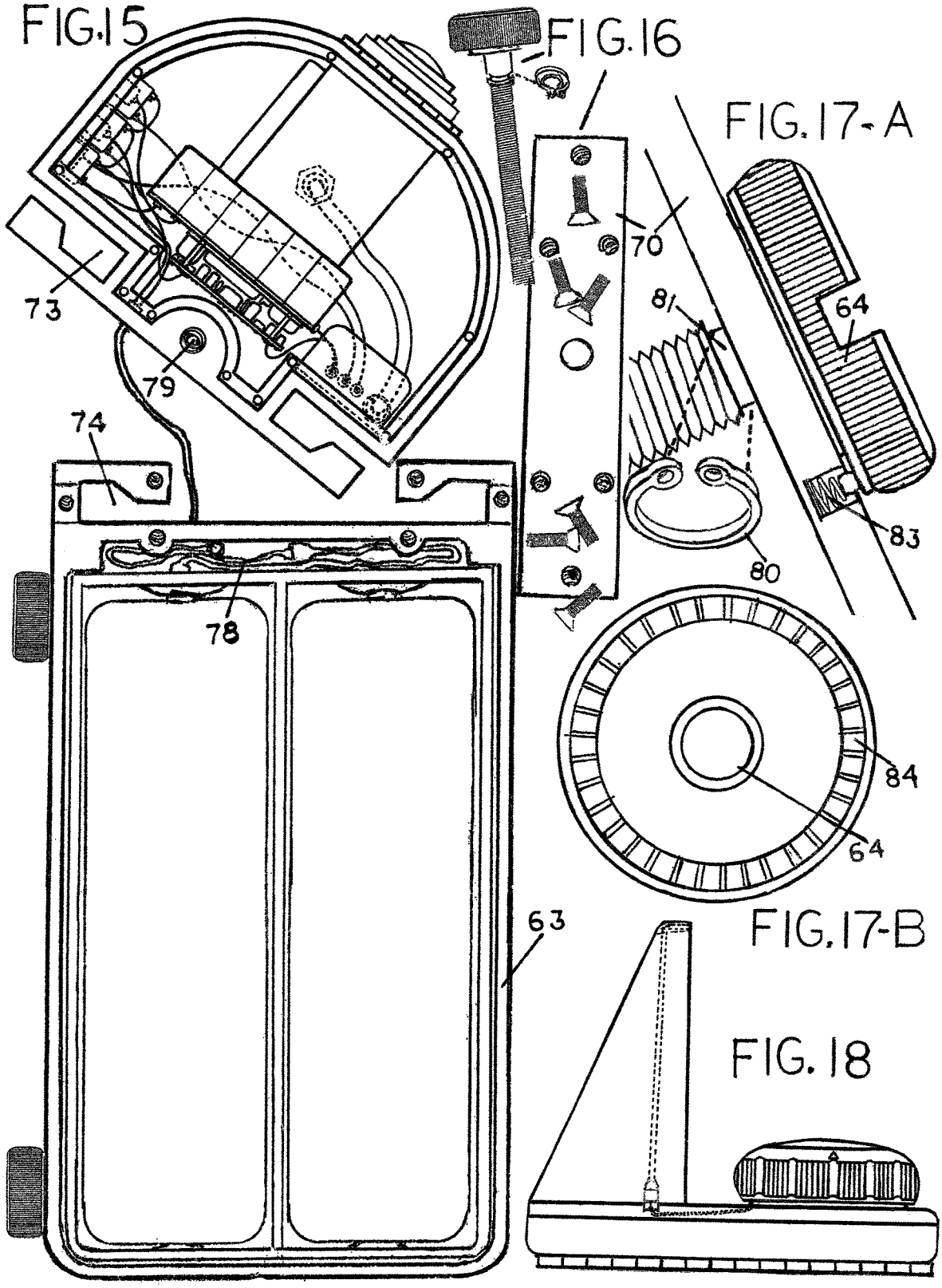
FIG. 15 illustrates an overhead view of an embodiment taught herein, of an embodiment of one of the sighting devices included in FIGS. 12-A through FIG. 20. This drawing shows both the cover plate #70. and the vertical adjustment mechanism #64. removed from the device and included in FIG. 16. In accordance with the principles of the present embodiment.
FIG. 16 illustrates an overhead view of an embodiment taught herein, This drawing shows both the cover plate #70. and the vertical adjustment mechanism #64. removed from one of the sighting devices included in FIGS. 12-A through FIG. 20. In accordance with the principles of the present embodiment.
FIG. 18 illustrates a profile view of an embodiment taught here in. of one of the variations of the non-sight adjustable illimitable targeting reticle unit #5. In accordance with the principles of the present embodiment.

FIG. 15. Includes a drawing of an overhead view of an embodiment taught herein, of an embodiment of one of the sighting devices included in FIGS. 12-A through FIG. 20. This drawing shows both the cover plate #70. and the vertical adjustment mechanism #64. removed from the device and included in FIG. 16. The lower threaded portions of #64 thread into the female threaded portion #79 on an back side center portion of the digital video camera and digital image transmitting component housing #59. So that when fully assembled, along with the cover plate and thumbscrew adjustment mechanism #64. mechanically fastened to an upper forward portion of the battery compartment portion of the sighting device.

Directly over and threaded into #79. Vertical sighting adjustments of the the digital video camera and digital image transmitting component housing #59 along with the center of the outer lens portions of the digital video camera portions of same are vertically adjusted and sighted in by means of the clockwise and counterclockwise rotational of the knob portion of thumbscrew adjustment mechanism #64.

This drawing also drawing also provides a good view of the male track portions #73 of the digital video camera and digital image transmitting component housing #59 slid off of and removed from the female track portions #74 of the battery housing portion of the sighting device and turned upside down and with the cover plate removed from same to view basically the same optionally employable types and combinations components that are also included in the drawing and descriptions thereof in FIG. 9. This drawing of an embodiment of the sighting device also shows as if the lid for the battery compartment #63, portion of the sighting device had been removed from same. This drawing thereof also shows same as including an actual battery pack #75 removable along with batteries #77 inside same as a complete unit by means of unplugging wire #78 from the plug for same and thus allowing the entire battery pack to optionally be charged separately then reinstalled in the same manner if desired. In accordance with the principles of the present embodiment.

FIG. 16. Includes a drawing of an overhead view of an embodiment taught herein, This drawing shows both the cover plate #70. and the vertical adjustment mechanism #64. removed from one of the sighting devices included in FIGS. 12-A through FIG. 20. along with the mechanical fasteners provided for the mechanical fastening of same into the threaded portions of the upper forward portion of the battery compartment portion of the sighting device. In accordance with the principles of the present embodiment.

FIG. 17-A. Includes a drawing of a profile view of the same embodiment taught here in. of the thumbscrew adjustment mechanism #64. and a cover plate #70. in which extends through and is freely rotatable therein. This cover plate along with thumbscrew adjustment mechanism #64. as being partly assembled and with only a C-clip #80 removed from same. This C-clip is provide to clip into the recessed upper portion #81. So as to retain thumbscrew adjustment mechanism #64. Into cover plate #70. While allowing thumbscrew adjustment mechanism #64. to also freely rotate therein when threaded into an aft female threaded portion of a digital video camera and digital image transmitting component housing. Notice there's an inset portion in of cover plate #70, directly under and just inside of the outer periphery portion of the the knob portion of #64. that contains both a low profile cone shaped tiny spring #82 that compress into the inner portions of itself when compressed. as well as a tiny stainless steel ball #83 which will be further explained in FIG. 17-B. In accordance with the principles of the present embodiment.

FIG. 17-B. Includes an overhead view of the bottom surface of the knob portion of same embodiment of the thumbscrew adjustment mechanism #64. As is included in FIGS. 16. and 17-A. the low profile cone shaped tiny spring #82 and tiny stainless steel ball #82 included in FIG. 17-A. actually maintain the thumbscrew adjustment mechanism #64 into its adjusted position at all times, by means of this tiny spring maintaining compressive pressure against the tiny stainless steel ball of which maintains compressive pressure of the tiny stainless steel ball up against and into the plurality of inset portions #84, stationed around the outer inside periphery portions of the bottom surface of the knob portion of thumbscrew adjustment mechanism #64. and intern keeps same into it adjusted position once released. In accordance with the principles of the present embodiment.

FIG. 18. Includes a drawing of a profile view of an embodiment taught here in. of one of the variations of the non-sight adjustable illimitable targeting reticle unit #5. portions of the sighting device that's actually a fully self contained unit mountable to the weapons rail of a firearm at a desired position in front of the outer lens portion of the camera portion of the sighting device. This embodiment thereof includes a illuminated targeting reticle, illuminated in the same manner as those included in FIGS. 3-E. Through FIG. 3-I. In accordance with the principles of the present embodiment.

FIG. 19-A. Includes a drawing of an overhead view of an embodiment taught herein, of a removable cover plate that enables access to the inner components of the digital video camera and digital image transmitting component housing #59. This as well as turned upside down and with same removed from the upper surface portion of the rail mountable portion of the sighting device. Of which is included in FIG. 19-B. The bottom surface portion of this embodiment of a battery housing portion of the sighting device, includes two lateral inset female track portions #85 extending across the entire the entire lateral span of the bottom of the battery housing portion of the sighting device, as well as an additional lateral inner inset portion #88 extending across an inner portion of same, between the two lateral inner track portions thereof. This center lateral inset portion of same #88. Starts just a short distance from an enclosed first side portion of this embodiment of the bottom of the battery housing portion of of the sighting device and extends all of the way through the second side portion thereof. wherein a removable cheek plate #90 is provided that's inset into and extends across the outer surface portion of the second side of the center lateral inset portion of the lower battery housing portion of the sighting device and is mechanically fastened thereto by means of mechanical fasteners.

This center lateral inset portion of the lower battery housing portion of the sighting device is provided in same, to house both the threaded rod portion of a thumbscrew adjustment mechanism #69. and of which this embodiment thereof would share basically all things common, as far as the basic mechanical composition of same with the vertical adjustment mechanism #64 as seen in FIG. 17-A. and FIG. 17-B. As well as the raised threaded portion #89 of the rail mountable portion of the sighting device. as seen in FIG. 19-B. In accordance with the principles of the present embodiment.

FIG. 19-B. Includes a drawing of an overhead view of an embodiment taught herein, of the upper surface portion of the rail mountable portion of the sighting device. that includes the two male track portions #85 extending across the entire the entire lateral span of the upper surface portion of the weapons rail mountable portion of the sighting device configured in a manner as to slidably interlock into the two lateral inset female tracks #85 extending across the entire the entire lateral span of the bottom of the battery housing portion of the sighting device, included in FIG. 19-A. This embodiment of the upper surface portion of the rail mountable portion of the sighting device additionally includes a raised threaded portion #89 that is also inserted into the open portion of the second side of the center lateral inset bottom portion #88. Of the battery housing portion of the sighting device, As seen in FIG. 19-A. wherein the threaded rod portion of the thumbscrew adjustment mechanism #69, is threaded through same, and bottoms out in a center inset portion of the center of cheek plate #90. Also viewable in FIG. 19-A. And thus lateral or horizontal sighting adjustments are made to the alignment of the center of the lens portions of the digital video camera portion of the sighting device relative to the targeting reticle, portion of the stationary mounted illuminated targeting reticle unit. are made by means of the clockwise and counterclockwise rotational thumbscrew adjustment mechanism #69. In accordance with the principles of the present embodiment.

FIG. 19-C. Includes a drawing of an overhead view of an embodiment taught herein, of the bottom surface of the weapons rail mountable portion of the sighting device. This drawing thereof includes a side clamping mechanism portion thereof, that compressibly secures the sighting device to the weapons rail of the firearm, disassembled and removed from the side portion of the rest of the rail mountable portion of the sighting device. This clamping mechanism comprising of a clamping plate portion of same #91. with the female inner span portion of same, configured to mate with the male outer configuration of a Picatinny weapons rail on a firearm. and of which is attachable to two pad eye #92 portions of the rail mountable portion of the sighting device that extend through two openings in an upper portion of #91 and into a cut out inner portion of two common quick release pivoting levers #94 and pivotably secured to same by means of clevis pins #93, in a manner in which when fully assembled #91 is compressibly secures the sighting device to a desired position on the weapons rail of the firearm, or removed from same, by means of the rotation of two common quick release pivoting levers to each direction side to side to where same rest up against the outer side portions of #91. In accordance with the principles of the present embodiment.

FIG. 19-D. Includes a drawing of an overhead view of an embodiment taught herein, of both the digital video camera and digital image transmitting component housing #59, as well as the battery housing #63 portion of the sighting device. turned back over and completely reassembled. In accordance with the principles of the present embodiment.

FIG. 19-E includes an embodiment of one of the sighting devices taught herein that's manufactured as a single mountable unit. Such as the embodiment of the sighting device included in FIG. 12-B. turned upside down and thus exposing the bottom surface portion of the long extended portion of the weapons rail mountable portion of the sighting device. in which the upper, forward portion thereof, is an integral portion of the non-sight adjustable illuminated targeting reticle portion of the sighting device and the aft upper portion thereof being the portion of this embodiment of the sighing device that both the the digital video camera and digital image transmitting component housing #59, as well as the battery housing #63 portion of the sighting device. is mounted to and sight adjustable relative to the non-sight adjustable illuminated targeting reticle portion of the sighting device.

This drawing thereof includes a side clamping mechanism portion of the weapons rail mounting portion thereof, that compressibly secures the sighting device to the weapons rail of the firearm, disassembled and removed from the side portion of the rest of the rail mountable portion thereof. This clamping mechanism comprising of a long clamping plate portion of same #95. with the female inner span portion of same, configured to mate with the male outer configuration of a Picatinny weapons rail on a firearm. and of is compressibley securable to same by means of three thumbscrews #98 in this embodiment thereof, that extend through openings in an upper portion of #95 and thread into threaded openings in the inner side portions of the raised female span of the integral cheek plate portion of same #97, on the opposite side of the rail mount, portion of the sighting device configured to mate with the male outer configuration of opposite side of a Picatinny weapons rail on a firearm. Thus enabling the securement of the sighting device to a desired position on the weapons rail of the firearm, or removing the sighting device from same by means of the clockwise and counterclockwise rotation of thumbscrews #98. In accordance with the principles of the present embodiment.

It will be apparent to one with average skill in the art of electronic optics and firearm sighting systems that the all aforementioned embodiments of the digital video camera sighting device surveillance sights and the digital camera sighting device surveillance sight acquiring devices included in this application may be provided using some or all of the mentioned composition of features and components without departing from the spirit and scope of the present invention. It will also be apparent to the skilled artisan that the embodiments described above are specific examples of a single broader invention which may have greater scope than any of the singular descriptions taught. There may also be many alterations made in the descriptions without departing from the spirit and scope of the present invention.

FIG. 20-A. Includes a drawing of a profile view of a more simplistic embodiment of an actual different type of sighting device that actually possess many things common with embodiments of the digital video camera sighting devices included in FIGS. 12-A. through FIGS. 19-D. However this embodiment taught herein, was actually devised for the purpose of acquiring targeting acquisition from other sights and scopes on a firearm. As a result thereof this device neither includes a targeting reticle or crosshairs of any sort and as a result thereof, in ways this device is isn't an actual sight at all but rather a vertically adjustable sighting image acquiring devise, in which the actual sighting image acquiring cameras and the lens portions of same are perfectly centered over the weapons rail of the firearm, once on same and acquire their sighting images from actual sights and scopes mounted on the weapons rail of a firearm and do so from a mounted position behind same, on the same weapons rail of the firearm.

This embodiment of height adjustable targeting image acquiring devise actually shares many things common with the actual digital video sighting devices included in this application such as all of the actual function enabling components housed in the digital video camera and digital image transmitting component housing #59, as well as the basic components enabling vertical adjustability of same relative the mounting rail in which both are mounted, are also shown as being the same as those included in FIGS. 16, 17-A and FIG. 17-B in that the same basic components as well as the services provided by same, would be employable in either and thus are shown as if the same or very similar embodiments thereof were employed in this embodiment of a height adjustable targeting image acquiring devise as is employed in embodiments of the actual digital video camera sighting devices with optical zooming abilities included in FIGS. 12-A. through FIGS. 19-D.

Some of the actual differences between the two, of course being the absence of a targeting reticle of its own of any kind. This as well as the absence of all components enabling horizontal sighting adjustability. This due to the only sighting adjustment needfully made to the component housings and the digital video camera along with the sens portions of same employed in embodiments of these digital video camera targeting image acquiring devices. Included in FIGS. 20-A through FIG. 20-D. as well as the tactical embodiment thereof included in Included in FIGS. 21-B. Through FIG. 21-D.

Is that of vertical adjustability relative to the weapons rail, in which embodiments of the digital video camera sighting image acquiring devise and the actual sight or scope that embodiments of this new type of digital video camera sighting image acquiring devices are mounted behind and acquiring their targeting images from are mounted on.

This due to the fact that the actual targeting reticle or crosshairs in all sights and scopes, known of the applicant, are always stationed directly over the the exact center of the weapons rail of the firearm once mounted on same, even though all of the actual targeting reticles or crosshairs in them are stationed at a broad range of elevations relative to the weapon rails on the firearm once mounted on same.

Thus the only adjustments needfully made to the actual digital video camera and the lens portion of same that acquires its sighting images from other sights and scopes mounted on a firearm in this embodiment of a digital video camera sighting image acquiring device, is that of vertical adjustability reflective to the actual weapons rail on the firearm, in which this embodiment thereof as well as the sight or scope mounted in front of same, is mounted on, to actually provide this embodiment of a digital video camera sighting image acquiring device, as well as the tactical embodiment thereof included in FIGS. 21-B. Through FIG. 21-D. with the ability to acquire perfect target acquisition from other sights and scopes, that this embodiment thereof is mounted behind, is sames ability to adjust the digital video camera and more specifically. The lens portion of same to the exact same height over the center of the weapons rail of the firearm in which the targeting reticle or crosshairs of the sight or scope, in which this embodiment of a digital video camera sighting image acquiring device, is acquiring target acquisition from are stationed over the weapons rail of the firearm, in which both are employed. As is seen in FIG. 20-A of which includes a drawing of an embodiment of a digital video camera sighting image acquiring device, mounted behind and acquiring target acquisition, from a standard reflex type sight. The employment of this embodiment of a digital video camera sighting image acquiring device. Included in this application, in this manner. Not only radically improves the level of accuracy possibly attainable by the sight or scope in which this device is acquiring targeting acquisition from, by means of this embodiment of a digital video camera sighting image acquiring device's perfectly maintained liner aliment of the lens portion of its targeting image acquiring digital video camera with the targeting reticle or crosshairs of literally any sight or scope, that its acquiring target acquisition from, with both always remaining in their exact sighted in and hard mounted positions relative to each other and thus not only do they always remain exactly true to the target at all times, with the targeting reticle, or crosshairs in perfect linear alignment with the lens portion of the sighting image acquiring digital video camera and thus the digital video targeting images captured are always provided and displayed in the screen of the digital display device employed, totally free from the effects of parallax or target deviation of any kind and thus in the highest possible level of accuracy attainable by a sighting device its acquiring its targeting images from, as well as the manner in which the target acquiring digital video camera, always provides the targeting images it captures with the targeting reticle or crosshairs perfectly centered, in the sighting images captured and thus also provided in the screen of the digital display device employed in the same manner, also provides the user same with not only very accurate but also extremely fast and easy target acquiring abilities.

But by means of this a digital video camera sighting image acquiring device's employment of a digital video camera with variable optical zooming abilities not only optionally provides any reflex or holographic sight, same is acquiring its targeting acquisition from with the ability to additionally employ same as a high powered scope with actual variable magnifying abilities and thus the added ability to variably zoom in on and acquire target acquisition on very distant targets, with the same profound level of accuracy, but when employing this embodiment of a digital video camera targeting image acquiring device in conjunction with high powered scopes not only provides them with the ability to actually zoom in on a target with actual variable magnifying abilities but also with the ability to zoom in and clearly view or acquire accurate target acquisition at distances previously impossibly achievable. In accordance with the principles of the present embodiment.

FIG. 20-B. includes a drawing of a frontal view of the same embodiment of the digital video camera sighting image acquiring device as is included in FIG. 20-A. With the main difference between this embodiment thereof and the embodiment thereof included in FIG. 13. being the absence of a targeting reticle #3. In accordance with the principles of the present embodiment.

FIG. 20-C. includes a drawing of a back side view of the same embodiment of the digital video camera sighting image acquiring device as is included in FIG. 20-A with the main difference between this embodiment thereof and the embodiment thereof included in the drawing included in FIG. 14 of the back side view of one of the embodiments of the actual digital video camera sighting devices included in this application being the basic composition of components enabling lateral or horizontal sighting adjustments made to the alignment of the center of the lens portions of the digital video camera portion of the sighting device relative to the targeting reticle, portion of same. such as the thumbscrew portion of the lateral sighting adjustment mechanism #69, as well as the numbered scale #15 as well as the tiny mark indicating the amount of horizontal adjustments made to the sighting device as well as the tiny mark indicating the amount of horizontal adjustments made to the sighting device also included in FIG. 15. that is not included in this drawing included for FIG. 20-C. due to the lack of need for horizontal adjustability by embodiments of the actual digital video camera sighting image acquiring device as is included in this application. In accordance with the principles of the present embodiment.

FIG. 20-D includes an overhead view of the same embodiment of the digital video camera sighting image acquiring device as is included in FIGS. 20-A. through FIG. 20-C. with the only viable diffidence in same and some of the embodiments of the actual digital video camera sighting devices included in this application once again being the absence of a targeting reticle of any kind as well as the lack in any lateral sighting adjustment components included with or on same. In accordance with the principles of the present embodiment.

FIG. 21-A. Includes a drawing of an overhead view of the bottom portion of a tactical embodiment of the digital video camera surveillance sight. This drawing as well as the description for same, would also be applicable to the tactical embodiment of the sighting image acquiring device. Included in FIGS. 21-B through FIG. 21-D This drawing of a digital video camera and digital image transmitting component housing #59, as well as the battery housing #63 portion of a tactical combination digital video camera surveillance and sighting device. Of which is another version of the digital video camera sighting devices with optical zooming abilities, included in this application. Tactical embodiments, of this new type of surveillance sighting device, and new type of new type of surveillance sighting image acquiring device, share pretty much all things common with the non-tactical versions thereof included in this application, in that they both acquire target acquisition in the exact same modes and would be equipped with and equippable with, all of the same basic types of components and combinations thereof as the non-tactical versions of the same. such as those included in FIGS. 1-A through FIG. 20-D. as well as the tactical embodiment thereof included in FIGS. 21-B. Through FIG. 21-D.

As a result thereof the tactical embodiments, of this new type of sighting device, also possess all of the same superior levels of accuracy as well as all of same unique and profoundly effective additional service providing abilities as is providable by the non-tactical versions of same.

Figures 33B, 33C, 33D:
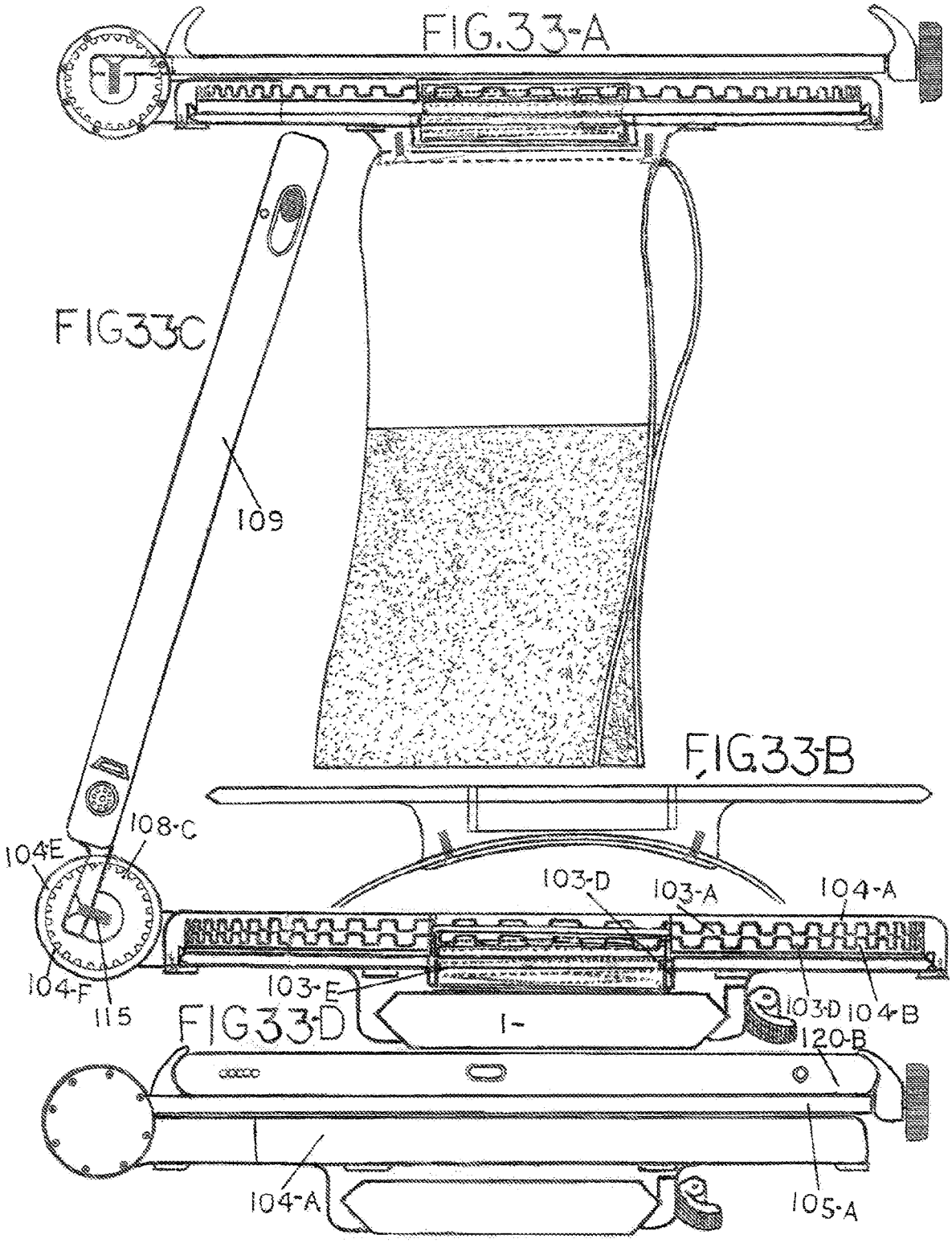

However tactical versions of these sighting devices, were primarily devised to be employed in conjunction with two other apparatuses, included in FIGS. 22-A through FIG. 33-D. In this application, and of which were devised for military applications and primarily to be employed by our armed forces. Such as by our ground troops in theaters of urban combat, as well as all branches of our special forces, secret service and possibly also by homeland security. This a well as the possible employment of same in law enforcement applications as well, such as swat. In that the employment of same. Will not only provide our ground troops with far greater sighting abilities and levels of accuracy in general. but they will additionally provide them with levels of safety, defence and tactical control providing abilities, not only many times greater than anything previously availed to them.

The tactical versions of these sighting devices would basically share all things common with the non tactical versions of them. With the only exception being the tactical versions of these sighting devices employment of additional, digital video cameras with optical zooming abilities, also mounted in the forward digital video camera and electronic component housing portions of them and of which are also mounted in them in the same manner as the forward facing, target acquiring digital video camera employed in same.

This being with the outer portions of the surveilling digital video cameras #50-B. Also extending through the actual housing portions of this tactical embodiment of a surveilling and sighting device for same with the outer lens portions thereof #4 also mounted on the outer portions of the housings for them in the same manner. The mounting of all of the digital video cameras with optical zooming abilities employed in them in this manner, provides all employed in same, with not only a clear but also totally unrestricted and unobstructed fields of view at all times.

The targeting and Surveilled images captured by embodiments of this tactical combination digital video camera surveillance and sighting device, included in this application are provided to the dedicated digital display or smart digital display device by them and are displayed in them, in a manner in which, both the targeting, as well as all surveilled digital video images provided are displayed as optionally viewable either simultaneously in separate windows, to provide a soldier with, not only the ability to maintain a unobstructed visual of his surroundings for any of the otherwise unenforceable dangers or develop developing enemy scenarios therein. but also with the ability to maintain same from positions of protective cover and totally out of the line of incoming fire while doing so. This along with the ability to individually bring up any angle of view, full screen and optionally magnify the digital images provided in the screen of the dedicated digital display or the screen of the smart digital display device employed, along with the ability and maintain a perfectly clear view of the video images provided, regardless of the number of times the digital video targeting or surveilled images had been magnified by the digital video cameras in the tactical combination digital video surveillance and sighting device.

This drawing includes this embodiment of the tactical combination digital video surveillance and sighting device as if the digital video camera and digital image transmitting component housing #59, as well as the battery housing #63 portion of a tactical combination digital video camera surveillance and sighting device, had been turned upside down and the mechanical fasteners #47, previously securing inspection plate #45. to the forward bottom housing portion of this tactical embodiment of the digital video camera sighting device had been removed along with inspection plate #45. As to provide an overhead view of the components housed therein Notice this embodiment of the tactical version of this sighting device is equipped with all of the same basic target acquiring components such as the target acquiring digital video camera with optical zooming abilities #50-A. along with all switching and digital video image transmitting components would also be employable in either the tactical or non tactical embodiments thereof, in the same manner as well. The tactical combination surveillance and sighting devices, would also include, and employ the same embodiments of the illuminable targeting reticles and of which would be sight adjustable relative to each other and in every way, would also acquire target acquisition in the exact same manner as all non-tactical embodiments thereof included in this application, and therefore the very detailed descriptions of the composition of all of the electronic and mechanical components comprising same would also applicable to the composition of all comprising this tactical version of same as well.

The primary difference between embodiments of the non tactical digital video camera sighting devices and the tactical surveillance and sighting device embodiments thereof included in this application being the addition of the surveilling cameras #50-B. positionally mounted in is same, in a manner in which the unmagnified fields of view, provided by the surveilling digital video cameras are displayed in the screen of the digital display device employed, in a manner, in which the outermost forward portions of the surveilled digital video images captured, begin at the outermost end portions of the unmagnified field of view provided by of the digital video targeting camera and displayed in the screen of the digital display device employed. and with the opposite outer end portions of the surveilled images provided by the digital video surveilling cameras and displayed in the screen of the digital display device employed, extending around to points behind and to each side of the user of same, with all digital images provided either either viewed simultaneously or optionally brought up separately full screen, by means of tapping on the image of same in the screen in the digital display device employed and from that point optionally zooming in on either the actual digital video image provided by the forward facing target acquiring digital video camera of which is always provided with the image of the targeting reticle perfectly centered in the screen of the display device employed, and thus providing the user of same with extremely accurate target acquisition by means of putting the tiny illuminated reticle in the center of the targeting screen on the target. Or optionally bring an angle of view provided by one of the surveilling cameras full screen and optionally zooming in on same to any desired level of magnification to very effectively surveil the users surroundings and reveal any potential dangers therein.

This drawing of a tactical embodiment of one of the digital video camera sighting devices included in this application are all optionally employable with all of the exact same types of components and of which are employable in the exact same manner as the non tactical embodiments thereof included in this application and as a result thereof, this drawing of a tactical version of same, is also drawn as if this embodiment thereof was employing the exact same types of components. This as well as same being employed as well as same being employed in the the exact same manner as those employed in the non-tactical versions thereof included in this application. As a result thereof. very thorough and complete descriptions of all comprising same can be found in the descriptions included for FIG. 7 and FIG. 9 included in this application. These tactical embodiments thereof are shown as being equipped with the same basic type of digital video cameras, as well as the same type of night viewing and additional components and modules, enabling things such as different forms of digital video image transmission and direct digital video image communication components as well as the connection ports providing digital video image communication between the digital video camera portions of the device and the dedicated digital display or smart digital display device employed by them. This also holding true to all of the connections between same and all swishes and controls providing selective control of electrical communication between the battery power source and the electronic components needful of same. In accordance with the principles of the present embodiment.

FIG. 21-B. includes a drawing of a profile view of an embodiment of a tactical version of the non tactical embodiment of the digital video sighting image acquiring device included in FIGS. 20-A. through FIG. 20-D, and of which actually possess almost all things common with same. This drawing. like the drawing included in FIG. 20-A includes a drawing of a tactical embodiment of a digital video camera surveillance and sighting image acquiring device, mounted behind and acquiring target acquisition, from a standard reflex type sight, with the lens portion of same adjusted to the exact same height over the center of the weapons rail of the firearm in which the targeting reticle of standard reflex type sight, mounted in front of same is stationed.

This tactical embodiment thereof also acquires target acquisition from a mounted position, behind other sighting devices also mounted on the same weapons rail of the firearm employing both, and does so in the same manner and with the same basic composition of components, as the non tactical version thereof.

This tactical embodiment of a height adjustable targeting image acquiring devise also shares all things common with everything actually included in the drawing of a tactical digital video camera sighting device with optical zooming abilities included in FIG. 21-A. Included in this application. Such as all of the actual function enabling components housed in the digital video camera and digital image transmitting component housing #59, as well as the basic components enabling vertical adjustability of same relative the mounting rail in which both are mounted, are also shown as being the same as those included in FIGS. 16, 17-A and FIG. 17-B in that the same basic function enabling services provided by these components are needful in both.

In fact the only real differences included in the drawings of this embodiment of a tactical version of a height adjustable digital video camera targeting image acquiring devise. and the non tactical version of thereof. Included in FIGS. 20-A. through FIG. 20-D. Is this tactical version of sames employment of additional surveilling cameras #50-B. as well as the additional components enabling the additional employment of same. These two additional surveilling cameras #50-B. included in this embodiment of a height adjustable digital video camera targeting image acquiring devise, are included in this drawing of an embodiment thereof as being positionally mounted in the same basic positions and of which would be employed in the same basic manner as the two extra surveilling cameras #50-B included in the drawing of the tactical digital video sighting device included in FIG. 21-A. and all of the same optionally employable components employed in same would be employable in both.

These extra two surveillance cameras #50-B would also work in conjunction with the digital video camera targeting image capturing camera, #50-A. in this embodiment thereof, in the same basic manner and provide the same basic services and be employable with the same component variations as those included in the tactical version of a digital video camera sighting device included in FIG. 21-A. as well. As a result thereof the description of the basic component employment as well as the basic functions and services provided as the description provided for FIG. 21-A, would also be applicable to this embodiment of a tactical version, of a height adjustable digital video camera targeting image acquiring devise. In accordance with the principles of the present embodiment.

Some of the actual differences between the two, like the non tactical version of same of course being the absence of a targeting reticle of its own of any kind. This as well as the absence of all components enabling horizontal sighting adjustability. This due to the only sighting adjustment needfully made to the component housing and the digital video camera housed in embodiments of the height adjustable digital video camera targeting image acquiring devises included in this application, is that of vertical adjustability relative to the weapons rail, in which embodiments of the digital video camera sighting image acquiring devise and the actual sight or scope in which same is mounted behind on the firearm employing both. In accordance with the principles of the present embodiment.

FIG. 21-C. includes a drawing of a frontal view of a tactical embodiment of the digital video camera sighting image acquiring device that acquires target acquisition from other actual sighting devices mounted on a firearm and does so in the same manner a the non-tactical embodiment thereof included in FIG. 20-A. The main differences between this drawing and the drawing of frontal view of an embodiment of an embodiment of the actual a digital video camera sight included in FIG. 13. being both the absence of a targeting reticle of any sort. This as well as this embodiment of a tactical digital video camera sighting image acquiring device's as well as the tactical embodiment of the sighting device also included in FIG. 20-A in this application, being the employment of additional surveilling cameras with optical zooming abilities, and of course as well as the additional components enabling the employment of same. This drawing of an embodiment thereof also including the outer lens #4. Portions of the surveilling digital video cameras with optical zooming abilities extending through the actual housing portions of this tactical embodiment of a surveilling and sighting image acquiring device for same, with the outer lens portions thereof #4 also mounted on the outer portions of the housings for them in the same manner. This due to the higher level of service providable by any type cameras employed in these sighting or sighting image acquiring devices in this manner actually provides all employed in same, with not only a perfectly clear, but also totally unrestricted and unobstructed fields of view at all times. In accordance with the principles of the present embodiment.

FIG. 21-D. includes an overhead view of the same embodiment of the digital video camera sighting image acquiring device as is included in FIGS. 21-B. and FIG. 20-C. with the only viable diffidence in same and some of the embodiments of the actual digital video camera sighting devices included in this application once again being the absence of a targeting reticle of any kind as well as the lack in any lateral sighting adjustment components included with or on same. In accordance with the principles of the present embodiment.

FIGS. 22-A through FIG. 33-D. of this application. Include the drawings and descriptions, of a couple embodiments of accessories devised primarily for the purpose of working in conjunction with the digital video camera sight and sighting image acquiring devices included in this application. to expand and broaden the level of operational efficiency and rang of needful services and abilities providable by the. In accordance with the principles of the present embodiment.

FIGS. 22-A through FIG. 22-E. include the drawings and descriptions, of a couple of embodiments of a tactical rear viewing digital video camera surveillance device. Embodiments of this rear viewing helmet mountable surveillance device, mountable on a rear portion of a soldiers helmet #87. were devised primarily for the purpose of being optionally employable by our ground troops, or others in our armed forces for surveillance purposes and of which the digital video images captured by same, would be provided as optionally viewable in the screen of the digital display device employed, and in conjunction with the digital video images provided by the forward target acquiring camera and the two surveilling cameras in four separate windows, providing the users of same with a view of their entire surroundings, either simultaneously in four separate windows in the screen of the display device employed, or individual windows and the angels of view displayed in them selectively brought up full screen in same. The window displaying the forward view and the actual targeting image, is also always provided in a manner in which the view of the aria including the actual target is also always displayed with the targeting reticle perfectly centered in the screen of the display device employed, thus providing the users of them with extremely fast easy and accurate target acquiring abilities as well like all other sighting and surveilling digital video cameras employed in all other sighting device embodiments, these are also shown as including the outer lens portions #4. of the surveilling digital video camera portions of these embodiments of a rear viewing helmet mountable surveillance device. also extending through the actual housing portions of same, with the outer lens portions thereof #4 also mounted on the outer portions of the housings for them in the same manner. Of which, unlike the actual target acquiring cameras. Of which is not actually necessary for the actual surveilling cameras to be mounted in the housings for them in this manner and as a result thereof there may be embodiments of them produced with the entire camera portions of them internally mounted, behind window portions of the housings for same.

However the installation and employment of all digital video cameras employed in the sighting with the outer lens portions of same mounted on the outer portions of the component housings for them, also provides all surveilling video cameras with many advantages as well, such as the ability to always maintain a very clear field of view, regardless of the actual type of video cameras employed and with same being restricted only by the field of view and image capturing abilities possessed by the video cameras employed. In accordance with the principles of the present embodiment.

FIG. 22-A. includes a drawing of an embodiment of the aforementioned tactical helmet mountable rear viewing surveilling device. primarily devised and engineered for the employment of same, in conjunction with other tactical video camera sighting and accessory's. This drawing includes same as being an embodiment thereof that provides its surveilled digital video images captured by means of either direct wire or fiber optic digital video communication. This drawing also includes an embodiment thereof that also possesses no actual power supply of its own but is rather provided with power. in this drawing of an embodiment thereof. By means of a standard helmet mountable battery pack of which could be employable to provide power to same, as well as well as the digital video goggles #100. As is included in this drawing, as the display device employed to view the both the targeting as well as all surveilled images provided both by the helmet mountable rear viewing surveilling device. included in this drawing as well as the actual tactical video camera sight or sighting image acquiring device employed in conjunction with same (not shown). In accordance with the principles of the present embodiment.

FIG. 22-B. includes a drawing of another embodiment of a tactical helmet mountable rear viewing surveilling device. Notice this embodiment thereof actually includes a lid #102 to a battery battery compartment portion of same, in that this embodiment thereof actually possess its own power supply. This drawing thereof also shows same as including a wire or tiny fiber-optic cable #99. enabling the transmission its surveilled digital video images captured, by means of either direct wire or fiber optic point to point, digital video image communication to the digital display device employed by same (not shown). However transmission of its surveilled digital video images captured could and may well be provided to the digital display device employed by same by means of device to device wireless transmission and at least one omnidirectional antenna #54. In accordance with the principles of the present embodiment.

FIG. 22-C. Includes a drawing of a rear view of the embodiment of of the helmet mountable surveillance device with its own power supply. Included in FIG. 22-B. As if same had been removed from the helmet, in which it was mounted and turned around to provide a view of the back side of same and the rear cover plate #101. enabling access to the composition of components comprising same. In accordance with the principles of the present embodiment.

FIG. 22-D. Includes a drawing of a rear view of the same embodiment of the helmet mountable surveillance device with its own power supply. Included in FIG. 22-B. As if same had been removed from the helmet, in which it was mounted and turned around and the aforementioned cover plate #101. had also been completely removed to provide a view of a self contained battery pack, #103. That would normally be removed by means of removing same as a complete and interchangeable unit by means of the removal of the lid to a battery compartment portion of the helmet mountable surveillance device. Included in FIG. 22-B. In accordance with the principles of the present embodiment.

FIG. 22-E. Includes a drawing of a rear view of the same embodiment of the helmet mountable surveillance device with its own power supply. Included in FIG. 22-B. As if same had been removed from the helmet, in which it was mounted and turned around and the aforementioned cover plate #101. had also been completely removed along with the battery pack #103 to provide a view of cover plate #104. also removed. Of which would be the only cover plate. included in the embodiment of the helmet mountable surveillance device included in FIG. 22-A. That actually possess no actual power supply of its own. but instead is provided with same from an external power source. Of which actually holds true for many electronic devices employed by our ground troops. This also being why an example of an embodiment of the portion of one of the digital video camera sighting devices that would be powered in the same manner was included in FIG. 10. Cover plate #104. included in both embodiments of these helmet mountable surveilling device, is shown as being removed by means of the removal of the mechanical fasteners #47. and an o-ring seal under same. This cover plate #104. Was included in drawings of these embodiments of a rear viewing helmet mountable surveilling device, to provide a design option of same that would both provide full access to the composition of components employed in them. Both for manufacturing and assemblage purposes, as well as to provide resealable access to all to all of the internal components enabling the operational functionality and provision of all services and needful functions performed by them, in the case of needful maintenance or future repair's performed on them. as well as a mode to provide same with an access port that remained under the mounted portion of the device once installed. In accordance with the principles of the present embodiment.

FIG. 23 through FIG. 33-D include the drawings and descriptions, of an entirely new type of both a tactical as well as non-tactical embodiments, of a low profile and multi positionable and multi angularly adjustable display, or display device mounts. This new type a low profile and multi angularly adjustable display, or display device mounts. included in this application are not only different than any thing previously devised by the applicant, in literally every way, but they will also provide far greater levels of service and needful abilities and possess far greater levels of operational efficiency and radically outperform anything previously devised. literally in every way. Even though embodiments, of this new type of a low profile multi positionable and multi angularly adjustable display, or display device mounts. Included in this application, are actually devised and engineered in a rather simplistic manner.

In fact these display mounts, like the sighting devices included in this application, came about as a result of efforts on the applicants part to devise a type of multi positionable and multi angularly adjustable display, or display device mounts. employable, in conjunction, with both the tactical and non-tactical video camera sighting devices with optical zooming abilities. Included in this application, that would not possess the ability to provide ground troops, with the perfect vantage point of the screen of the display portion or display device mounted in same regardless of the position he had to position himself relative to the firearm to maintain his entire body behind protective cover and totally out of the line of fire while doing so. But to also devise and engineer them in a manner in which they would operate at much higher levels of operational speed, ease and efficiency, by the users of them weather employing same either on upper or optionally on a side accessory mounting rail of a firearm as well as same being employable on either in a manner in which same neither obstructs or hinders the the employment of any other sighting devices or equipment on the firearm employed by the user in any way while doing so, but they will also provide the users of them with the ability to take same in and out of service as well as angularly and positionally adjust same, to acquire the perfect vantage point of the screen of the display device mounted therein, by means of one quick and easy motion of one of the users hands, employing same. This as well as the ability to perform same with absolutely profound levels of speed ease and efficiency while doing so. In accordance with the principles of the present embodiment.

FIG. 23 through FIG. 33-D include drawings of a tactical embodiment of the aforementioned, low profile multi angularly and positionally adjustable display, or display device mounts when employed in conjunction, with, an embodiment of the tactical video camera sighting or sighting image acquiring devices with optical zooming abilities. Included in FIG. 21-A. through FIG. 21-D. This as well as the optional employment of both in conjunction with an embodiment of the rear viewing helmet mountable surveillance device. Included in FIGS. 22-A through FIG. 22-E. In this application.

The employment, of three embodiments of these tactical firearm accessories. included in FIG. 21. through FIG. 33-D of this application. Will not only provide our ground troops, and all branches of our special forces, but possibly even divisions of our secret service, homeland security and possibly even law enforcement, such as swat, for that matter with a perfect visual of the screen of the digital display device employed along with the targeting and all surveilled images displayed therein. from literally any position the user would have to position himself relative to the firearm providing the users of same, with not only the ability to safely maintain a 360 degree visual of the users entire surroundings, from literally any position that the user would have to position themselves relative to the firearm to maintain his entire body behind the protective cover, of a wall, the corner of a building, behind an armored vehicle, or tree, or from behind a berm, out of a ditch or other and totally out of the line of incoming fire. without having to expose even the slightest portion of his body to incoming fire while doing so.

But also with the ability to safely take his time, even when under incoming fire and clearly zoom in, on any angle of view relative to the users position. Thus also not only with the ability to quickly and easily locate the actual point of fire and accurately return same, if the order is given. but also with the ability thoroughly surveil the users entire surroundings while doing so, for sniper positions, advancing enemy combatants and other developing enemy scenarios, from positions of protective cover and totally out of the possible line of incoming fire while doing so, but will also provide them with an all new level of safety and control providing abilities in the performance of a broad range of additional duties required of them, Our armed forces desperate need of the defensive control and safety providing services and abilities providable by the tactical embodiments of the digital video camera sighting devices with optical zooming abilities and the tactical accessories employable in conjunction with them. Also included in this application, has historically proven evident, in the large percentage of of U.S. casualties incurred as a result of the prior arts inability to ever provide a real and viable solution to this problem.

These problems along with the cost in casualties incurred historically proving evident, in a broad range combat scenarios facing our ground troops and special forces, in the performance of numerous duties needfully required of them, that entails their having to put themselves in harms way in the performance of same. such as when having to clear buildings of snipers and other enemy combatants, they were under fire from, and having to view down hallways and into various rooms and hiding places, or when surveilling enemy strongholds and all other forms and duties related to reconnaissance, or having to traverse between one position to another, and having to look around the corners of buildings or down alleys to ensure the path needfully taken is safe to do so. These to mention just a few of the dangers our troops must face on a daily basis, that have been historically responsible for a large percentage of U.S. casualties due to their inability to reveal these dangers without exposing themselves, as a target to do so.

Tactical embodiments of the digital video camera sighting devices and the tactical accessories for them included in this application, will not only, literally resolve all aforementioned problems and dangers related to same presently faced by our troops. As a result of the miserable failings of the prior art's ability to provide viable solution to same.

But embodiments of these tactical digital video camera sighting devices and tactical accessories for them. included in this application, will not only provide our troops with an all new range and levels of defensive safety and control providing abilities, many times greater than anything previously devised, along with far greater levels of accuracy and sighting abilities in general along with numerous needful and highly advantageous additional services and abilities, solely providable by them.

But will also provide our troops with ability to very effectively and safely maintain a 360 degree visual of their entire surroundings and not only be made aware of the dangers residing therein, without having to expose themselves to those very dangers to do so, along with the ability accurately assess the true battlefield demographics and properly identify and insure that only the true aggressors need ever to have to pay the consequences for their aggression's, but will also provide our troops with the ability to safely fight wars and conduct military operations, in a manner in which collateral damage is all but eliminated. Especially in theaters of urban combat where lines often become blurred between the enemy and innocent civilians also residing therein. But also in a manner that provide our troops with a far greater chance of returning home once the conflict is over. In accordance with the principles of the present embodiments.

Figure 23:
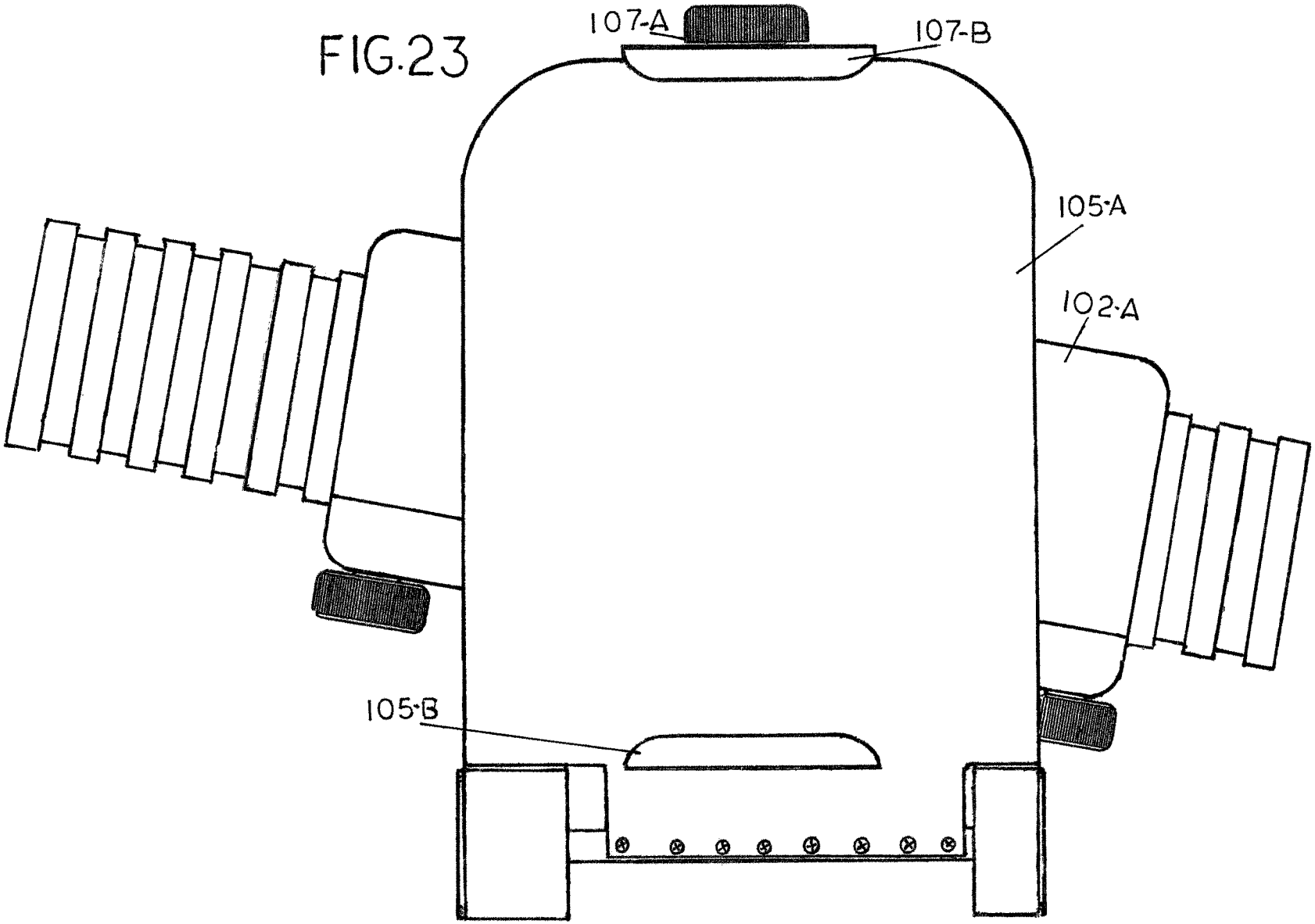

FIG. 23. Includes an drawing of an overhead view, of one of the aforementioned tactical embodiments of a low profile and multi angularly and positionally adjustable display device mount, with the actual display mounting platform portion of same. #105-A. Adjusted to a an lateral angle relative to a weapons rail #1, and laid back and locked into a position of non-employment on top of the rest of the device. This drawing provides a good view of the actual display device mounting platform portion of this tactical embodiment of a low profile and multi angularly and positionally adjustable display device mount that the digital display device employed would actually be mounted to. #105-B Is a display device cradle. of which is an integral portion of the upper mounting platform portion of #105-A. of which the lower edge portion of the display device would be compressibley secured up against during the mounting process of the display device to the upper mounting platform portion of the the display mount. #107-B is the upper compressive securement member portion of an internal slide portion of the display device mounting platform (not included in this drawing but viewable and further described in detail in FIG. 29-B.) #117-A. is a knob employed to apply downward compressive pressure to the upper compressive securement member, positioned up against an upper outer edge portion of the display device employed, by means of the application of a clockwise rotation of the knob #117-A. And thus both compressibly securing the display device employed between the upper compressive securement member and the display device cradle. as well as compressibly securing the back portion of the display device employed up against the upper surface portion of the display device mounting platform #105-A. as a result of the inner configuration of the upper compressive securement member, and display device cradle portions of this embodiment of a low profile and multi angularly and positionally adjustable display, or display device mount. Another embodiment of same would simply include the display device mounting platform turned over and remounted along with a spacer to make up for the thickness of the display device employed. Of which would provide both the upper compressive securement member, as well as the cradle portion of the display device portion of the display device mounting platform securing the display device employed to the other side of same wherein the display device employed would be stationed between the display device mounting platform and the rest of the low profile and multi angularly and positionally adjustable display device mount, and with the screen portion of the display device employed up against same when folded down and locked into a position of non employment. In accordance with the principles of the present embodiment.

Figure 24:
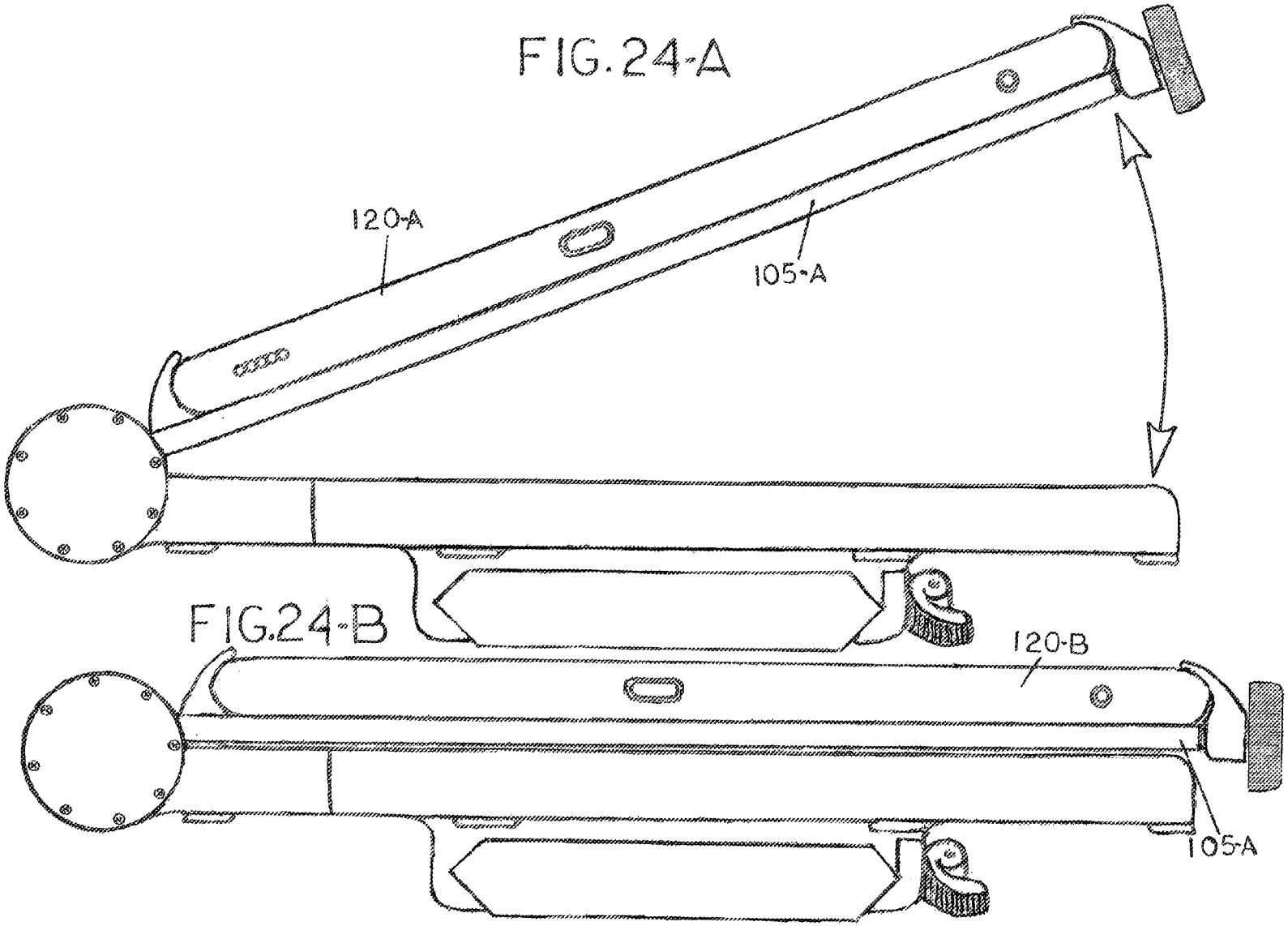

FIG. 24-A. Includes a drawing of a profile view, of the same tactical embodiment of a low profile and multi angularly and positionally adjustable display, device mount, as is included in FIG. 23. This drawing of the display mount includes a smart digital display device, #120-A. such as a smartphone or small tablet mounted the upper surface portion of the display device mounting platform #105-A. With same raised and locked into a into a slight vertical angle relative to the rail mount portion of same. in that all embodiments thereof possess the ability to adjust the display device portion thereof or display device mounting platform portion thereof into a plurality of vertical angles as well a plurality of lateral angles, simultaneously quickly and easily with one hand by the user of same, relative to the weapons rail in which same is mounted, and of which angles same securely locks into once released by the user employing same. This drawing also provides a good assembled view, of the blown up view of same, in the same position. Included in FIG. 25 which will be described in detail therein. In accordance with the principles of the present embodiment.

FIG. 24-B. Also includes a drawing of a profile view, of the same tactical embodiments of a low profile and multi angularly and positionally adjustable display, device mount, as well as from the viewing position of same, as is included in the drawing of thereof included in FIG. 24-A. However this drawing of same includes the display device mounting platform #105-A. along with the digital display device, #120-B. mounted thereon, lowered all of the way back down onto the upper surface portion of the rest of the display mount where it solidly locks into into position thereon same, once released by the user employing this tactical embodiment of a low profile and multi angularly and positionally adjustable display, device mount. In accordance with the principles of the present embodiment.

Figure 25:
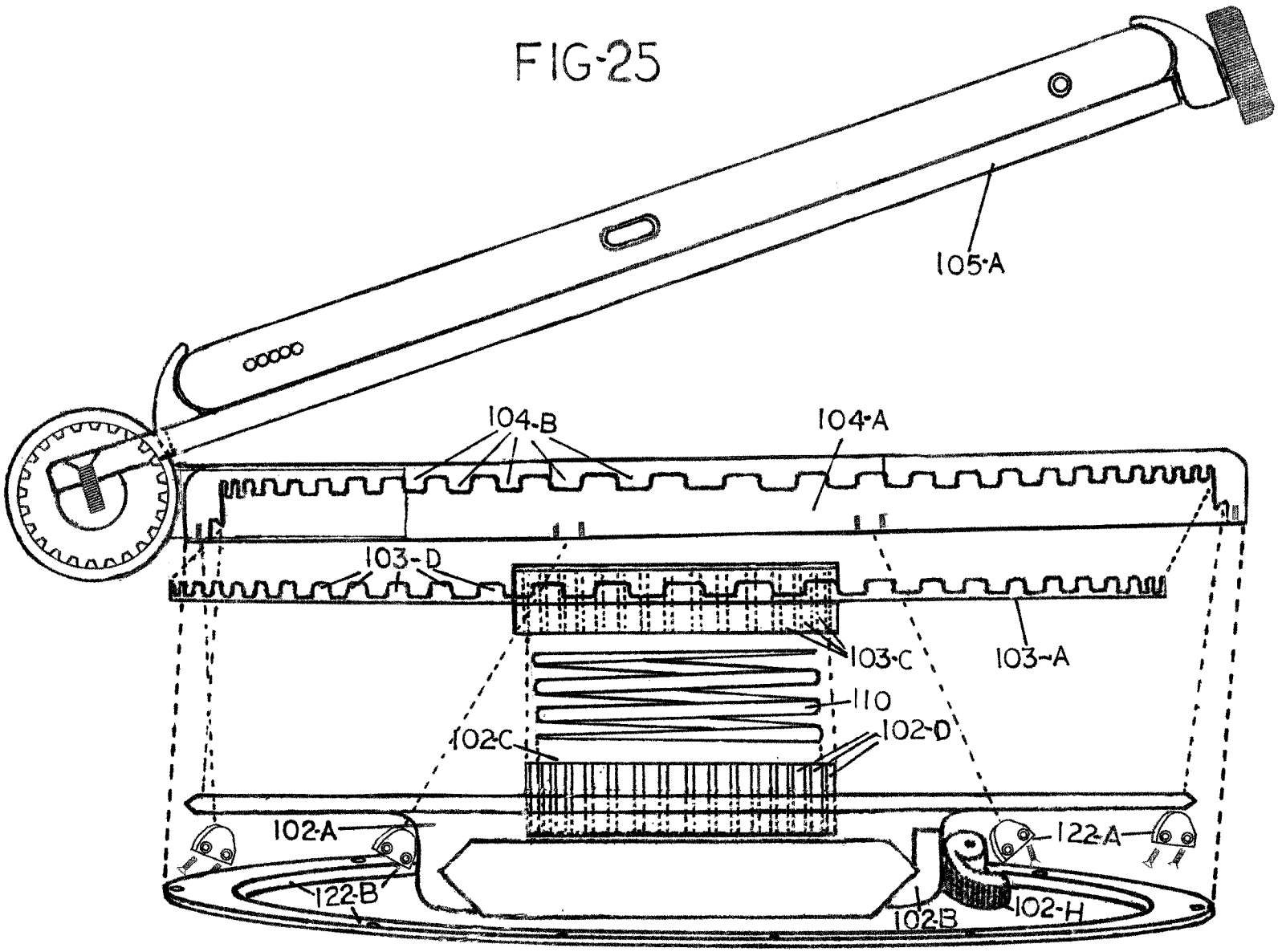

FIG. 25. Includes a drawing of a profile view, of the same tactical embodiment of a low profile and multi angularly and positionally adjustable display, device mount, as is included in FIG. 23. Through FIG. 32. This drawing Includes a blown up view, of same. #102-A. is the actual portion thereof, that is adapted for the mating with a weapons rail on a firearm and of which is secured to, or optionally removed from same by means of a mechanical securement member #102-H. common to quick release type rail mounts of various types that enables this embodiment of the tactical display mount to be quickly and easily installed and removed from the weapons rail portion of a firearm by means of pulling and re pressing on the finger pull portions of same. This lower rail mountable portion of the device #102-A is an integral portion of both a lower plate portion #102-B. As well as a lower portion of a spring housing #102-C. Notice the lower spring housing #102-C. includes both an inner portion that houses the lower portion of a spring #110. As well as an outer portion of the lower spring housing, that includes a plurality of vertical splines #102-D. stationed around the outer periphery portion of same. #103-A comprises a disk that includes an inner housing portion of same #103-B. included to house the upper portions of spring #110. #103-B. also comprising a plurality of vertical splines #103-C. comprising a plurality of raised and inset portions stationed around the inner periphery portion of same and adapted for the mating with the raised and inset portions of the vertical splines #102-D. stationed around the outer periphery portion of the lower portion of the spring housing #102-C. Enabling both the inner housing portion of #103-B. along with the the disk #103-A. portion of same to freely slide up and down vertically on the outer spline portions of the spring housing portion of the rail mount #102-A.

The upper portion of spring housing #103-B. additionally comprises a disk #103-A. Of which is an integral portion of portion the upper spring housing. #103-B. The upper surface portion of the disk includes a plurality of ridges and grooves #103-D. extending between the upper outer periphery portion of the spring housing #103-B. and the outer upper surface portion of the disk. #103-A.

#104-A. comprises a rotatable and angularly adjustable cowling portion of the tactical display mount, comprising an opening in the center portion of same. The inner surface portion of this embodiment of the cowling. #104-A. Additionally Includes a plurality of ridges and grooves #104-B. Extending between the inner surface portion of the opening in the cowling, and the inner, outer periphery portion of same, in a manner in which by means of #104-B mating with the plurality of ridges and grooves portions of #103-D. on the upper surface portion of of the disk, solidly locks both together. This also resulting in the upper, outer periphery portion of the upper spring housing #103-E. portion of the disk extend through the opening in the center portion of the of the cowling once fully assembled.

The assembly of this portion of this embodiment of a tactical display mount from this point including, the pressing of the cowling downward until the lower inner periphery portion, of the outer facia portion of same extends over edge the outer periphery portion of the plate of which is actually a portion of the rail mount, This embodiment thereof includes either a plurality of small tab slides #122-A. as is included in this drawing, or retaining ring slide #122-B. Also included in this drawing as alternately fastened to the lower outer edge facia portions of the cowing with either serving both to connect the cowling and the plate together in a manner that both solidly locks the plurality of ridges and groove portions #103-D. of the plate into the plurality of ridges and grooves #104-B portions of the inner cowling and of which are maintained solidly locked together, by means of the vertical compressive pressure maintained on the plate by means of the spring, housed within the spring housing portion of the plate once fully assembled.

Thus by means of the the user of same pressing downward of the upper surface portion of #103-B. Portion of the spring housing portion of the disk, extending through the upper center portion of the cowling disengages the mating of 103-D. From 104-B. and thus enables the cowling to be angularly positionable relative to the disk, portion of the upper spring housing. #103-B which is slidably coupled to the lower spring housing #102-C. by means of the plurality inner vertical splines #103-B. stationed around the inner periphery portions of same, being mated with the outer vertical splines #102-D. stationed around the in outer periphery portions the lower spring housing. Of which is also a portion of the rail mount and unmovable relative to same.

Thus maintaining the stationary alignment of the disk with the rail mount, at all times, while additionally enabling same to be vertically compressible relative to same. and thus both solidly lock the angular position of the cowling relative to the rail mount as well as disengaged from same. And Thus providing the user with the ability to adjust the angle of cowling along with all portions thereof and all additional components connected to same, including the display mounting platform and, or the display mounted on same to a plurality of angles relative to the rail mount and the firearm in which its attached to. by means of the pressing and the releasing of the upper surface portion #103-B. Of which is the upper surface portion, of the upper spring housing portion, of the disk extending through the upper center portion of the cowling. In accordance with the principles of the present embodiment.

FIG. 26-A. Includes a drawings of overhead view of the same embodiment of the portions of the of the tactical low profile and multi angularly and positionally adjustable display, device mount. that are all integral portions of the the actual portion of same, that is adapted for the mating with a weapons rail on a firearm and of which is secured to, or optionally removed from same by means of a mechanical securement member #102-I. Of which this embodiment thereof consists of a thumbscrew that by means of the rotation of the knob portion of same, enables this embodiment of the tactical display mount to be easily installed and removed from the weapons rail portion of the firearm. This lower rail mountable portion of the device #102-A is an integral portion of both a lower plate portion #102-B. As well as a lower portion of a spring housing #102-C.

Notice the lower portion of the spring housing #102-C. includes both an inner portion that houses the lower portion of a spring #110. As well as an outer portion of the lower spring housing, that includes a plurality of vertical splines #102-D. and of which same is also an integral portion of both the plate 102-B. as well as the lower rail mountable portion of the device #102-A. as is also included in all embodiments thereof included in FIG. 23 through FIG. 32. and described in detail in FIG. 25. In accordance with the principles of the present embodiment.

FIG. 26-B. Includes a drawings of overhead view of the upper portion of same embodiment the disk portion of the tactical low profile and multi angularly and positionally adjustable display, device mount. included in FIG. 23 through FIG. 32. and described in detail in FIG. 25. #103-A Comprises the disk portion of the device This disk also includes an inner housing portion of same #103-B. included to house the upper portions of spring #110. as seen in FIG. 26-A. 103-B. also comprising a plurality of vertical splines #103-C. comprising a plurality of raised and inset portions stationed around the inner periphery portion of same and adapted for the mating with the raised and inset portions of the vertical splines #102-D. stationed around the outer periphery portion of the lower portion of the spring housing #102-C. As is included in FIG. 26-A. Enabling both the inner housing portion of #103-B. along with the disk #103-A. portion of same to freely slide up and down vertically on the outer spline portions of the spring housing portion of the rail mount.

The upper portion of spring housing #103-B. additionally comprises a disk #103-A. Of which is an integral portion of portion #103-B. The upper surface portion of the disk includes a plurality of ridges and grooves #103-D extending between the upper outer periphery portion of the spring housing #102-C. and the outer upper surface portion of the disk. #103-A. In accordance with the principles of the present embodiment.

FIGS. 26-C. Includes a drawings of overhead view of the upper inside portion of same embodiment the cowling portion of the tactical low profile and multi angularly and positionally adjustable display, device mount. included in FIG. 23 through FIG. 32. and described in detail in FIG. 25. #104-A. comprises a rotatable and angularly adjustable cowling portion of the tactical display mount, comprising an opening #104-C. in the center portion of same. The inner surface portion of this embodiment of the cowling. #104-A. Additionally Includes a plurality of ridges and grooves #104-B. Extending between the inner surface portion of the opening in the cowling, and the inner, outer periphery portion of same, in a manner in which by means of #104-B mating with the plurality of ridges and grooves portions of #103-D. on the upper surface portion of of the disk, solidly locks both together. This also resulting in the upper, outer periphery portion of the upper spring housing #103-E. portion of the disk to extend through the opening in the center portion of the of the cowling once fully assembled. #104-D. are armature portions of the cowling that extend back to a point, just beyond the aft outer edge portion of the cowling. with the end portions of each including a housing #104-E as well as inner portions of each housing including a plurality of lateral splines. #104-F. extending around an inner periphery portion of each housing #104-E. Of which will be described in further detail in FIG. 27. FIG. 28. and FIG. 31. In accordance with the principles of the present embodiment.

Figure 27:
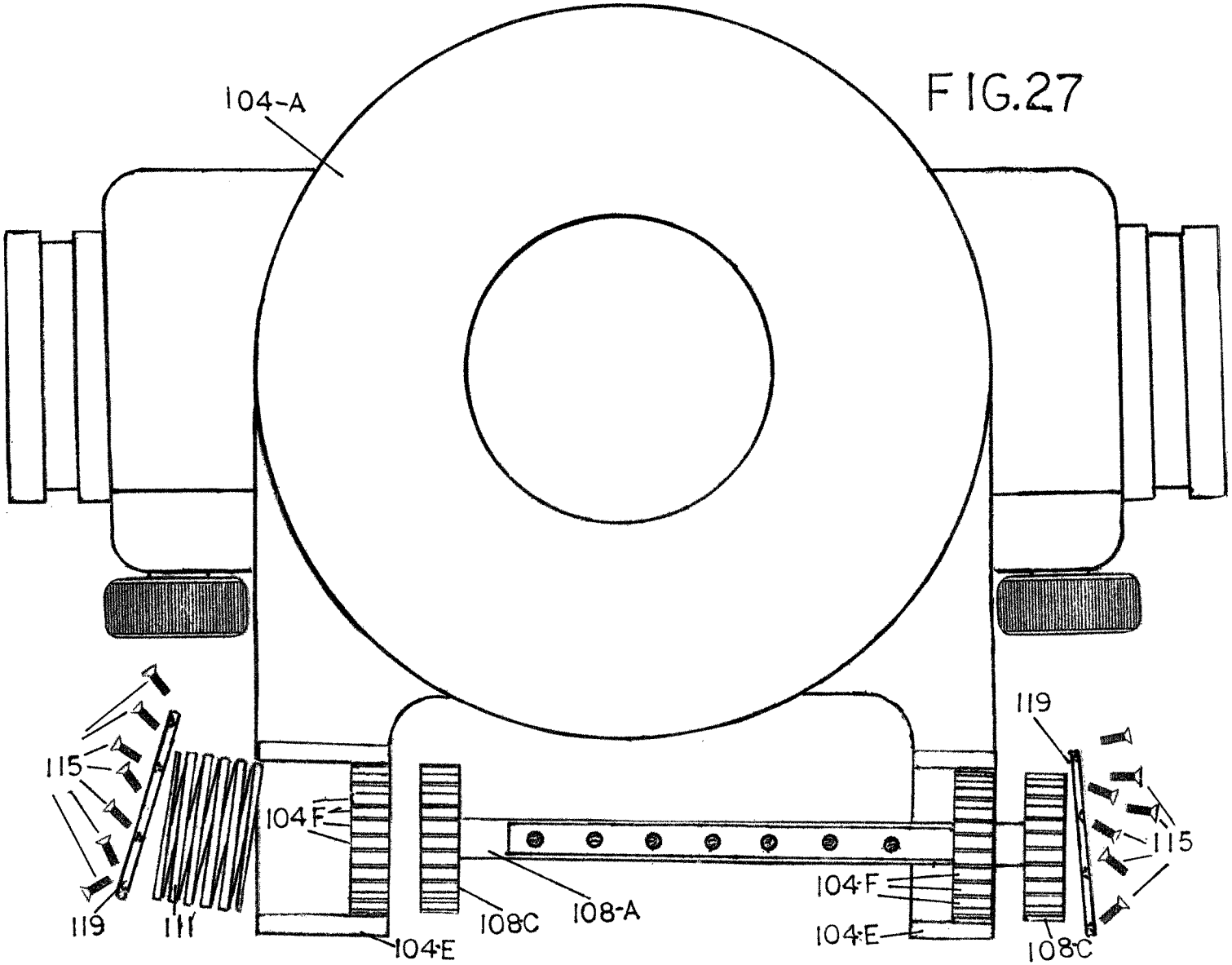
Figure 28:
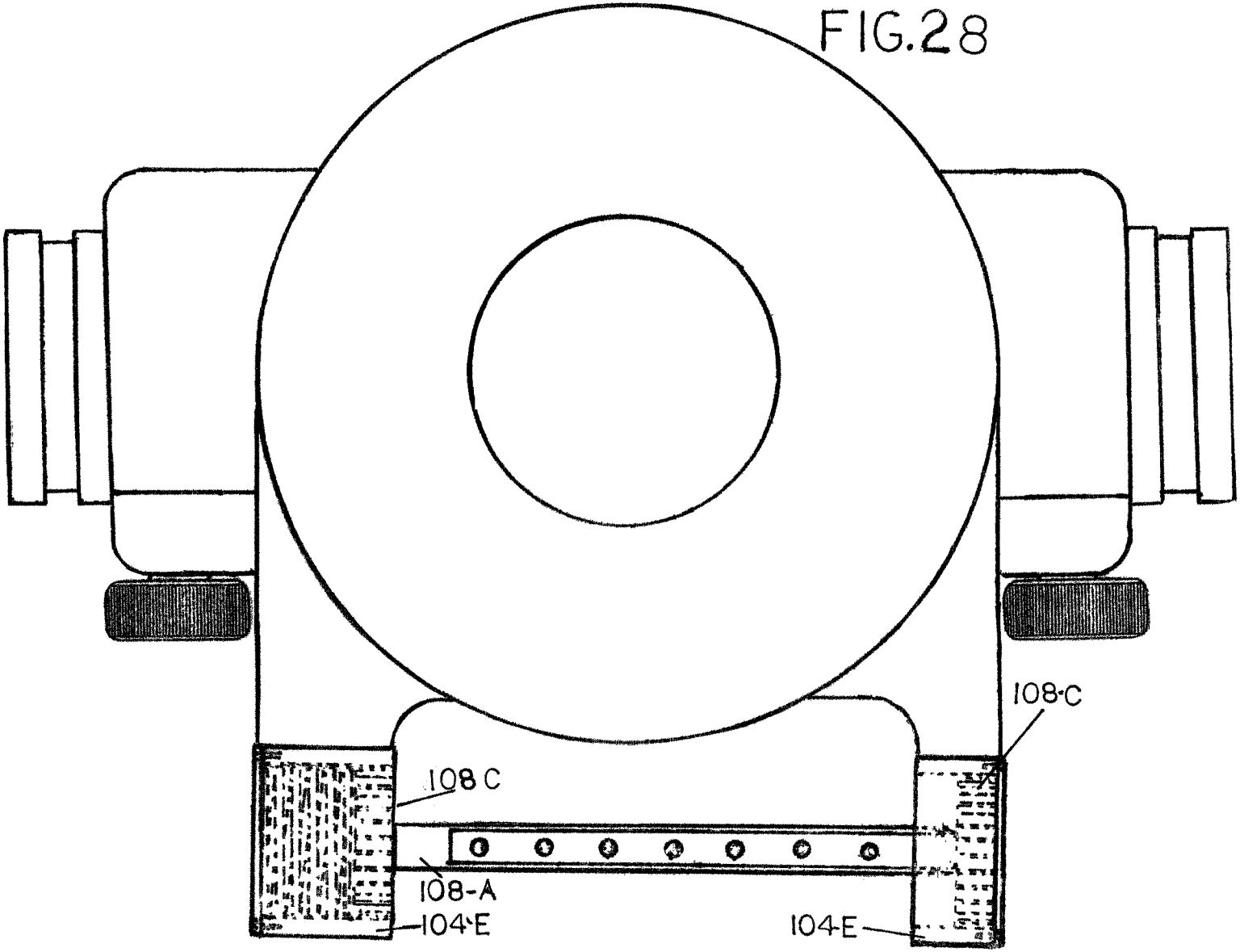

FIG. 27 includes a drawing of an overhead view of the same embodiment the cowling #104-A. and rail mount portions of the tactical low profile and multi angularly and positionally adjustable display, device mount. included in FIG. 23 through FIG. 33-D. and described in detail in FIG. 25. fully assembled and disposed upon the weapons rail #1 portion of a firearm. This as well as the armature portions of the cowling that extends back to a point, just beyond the aft outer edge portion of the cowling. with the end portions of each. including a gear housing #104-E. included in this drawing as if the gear housing #104-E. was transparent to make the inner portions of each gear housing easily viewable through same. This including a plurality of raised and inset portions comprising lateral splines. #104-F, stationed around the inner periphery portions of each housing #104-E. As is included and described in FIG. 26-C. This drawing additionally includes the inner components of each housing as well as the mode of the assembling of this embodiment of this portion of this device. #108-A. is an axel. #'s 108-C. are embodiments of a type of gear of which are portions of each end portion of the axel. these two gears also comprising of a plurality of lateral raised and inset portions, comprising the lateral teeth portions of the gears, stationed around the outer periphery portions of each and adapted for the mating with the raised and inset portions of the lateral splines. #104-F, stationed around the inner periphery portions of the gear housings. Notice the gear housing stationed on the left side of the cowling includes a spring #111. This spring is inserted into the outer portion of the housing and abuts the raised portions of the lateral spline portions of the gear housing at which time the outer cover plate #119. is fastened to the outer portions of the gear housing with this embodiment thereof accomplishing by means of a plurality of tiny machine screws #115. this embodiment thereof, also includes an additional cover plate #119. as well as the mechanical fasteners #115. provided for the securing of the cover plate to the outer edge portions of the gear housing stationed on the opposite side of the cowling and maintaining all inside both as seen in FIG. 28. In accordance with the principles of the present embodiment.

FIG. 28. includes a drawing of an overhead view of the same embodiment the cowling #4-A. and rail mount portions of the tactical low profile and multi angularly and positionally adjustable display, device mount. included in FIG. 23 through FIG. 32. and described in detail in FIG. 25. fully assembled and disposed upon the weapons rail #1 portion of a firearm. This as well as all internal components as is included in FIG. 27. Also fully assembled and Housed in the gear housings #104-F. and included in FIG. 23 through FIG. 34-C. with the cover plates #115. also installed, along with the spring #111. maintaining lateral pressure on the the axel and gears and thus maintaining same locked into the inner lateral spline #104-F, portions of the gear housings #104-F. for same. In accordance with the principles of the present embodiment.

FIGS. 29-A through FIG. 29-D. include embodiments. Of all of the basic composition of components comprising an embodiment of a display device mount devised for the purpose of securely mounting a display device to the tactical low profile and multi angularly and positionally adjustable display, device mount. included in many of the following drawings. In accordance with the principles of the present embodiments.

FIGS. 29-A. Includes a drawing of an embodiment of a tensioning knob #117-A. as well as a threaded rod #117-B. portion of same this drawing also includes a C-clip #117-C. insertable around a grove #117-D. in a lower smooth shank portion of the threaded rod stationed a short distance below the lower surface portion of the tensioning knob. In accordance with the principles of the present embodiment.

FIGS. 29-B. Includes a drawing of an embodiment of a display device securement member and internal slide portion of this embodiment of a display device mount. The installment of the tensioning knob #117-A. as well as a threaded rod #117-B. into the display device slide and securement member. as seen in FIG. 29-D. includes the extending of the threaded rod through the opening #107-C. in the upper center portion of the display device securement member and internal slide #107-A. Until the grove #117-D. in the lower smooth shank portion of the threaded rod comes out of the lower portion of the opening #107-C. Then by means of inserting the C-clip #117-C. around the grove #117-D. in a lower smooth shank portion of the threaded rod. The threaded rod along with the tensioning knob #117-A. Portion of same are both locked into the display device securement member and internal slide #107-A. as well as provided with the ability to freely rotate therein. In accordance with the principles of the present embodiment.

FIGS. 29-C. Includes a drawing of an overhead view of an embodiment of the display device mounting platform. #105-A. #105-B Is is an overhead view of the display device cradle. of which is an integral portion of the upper mounting platform portion of #105-A. of which the lower edge portion of the display device would be compressibly secured up against after mounted to same. #105-D. Is a threaded integral collet portion in an upper center portion of the inner housing portion of the display device mounting platform. #105-A. The process of installing the display device slide and securement member. 117-A. Into the inner housing portion of the display device mounting platform #105-A. including the threading of the lower portion of the threaded rod #117-B. portion of the tensioning knob #117-A. into the integral threaded collet #105-D. while inserting in the upper center portion of the display device securement member and internal slide #107-A. into the inner housing portion. 105-C of the display device mounting platform #105-A. As seen in FIG. 29-D. In accordance with the principles of the present embodiment.

FIG. 29-D. Includes a drawing of an embodiment. of #105-A. Of which is an upper display device mounting platform portion of the the display mount. Of which the backside portion of a digital display device would rest on and be attached to. in this embodiment thereof. #105-B. Is a display device cradle. of which is an integral portion of the upper mounting platform portion of #105-A. of which the lower edge portion of a display device would be compressibly secured up against during the mounting process of same, to the upper mounting platform portion of the the display mount. #107-B is the upper compressive securement member portion of an internal slide portion of the display device mounting platform #117-A. is a knob portion of the threaded rod #117-B. Employed to apply downward compressive pressure by means of the rotation of same, to the upper compressive display device securement member. positioned up against an upper outer edge portion of the display device. (not shown) employed, by means of the application of a clockwise rotation of the knob #117-A.

Thus both compressibly securing the display device employed between the upper compressive securement member and the display device cradle. as well as compressibly securing the back portion of the display device employed up against the upper surface portion of the display device mounting platform #105-A. as a result of the inner configuration of the upper compressive securement member, and display device cradle portions of this embodiment of a low profile and multi angularly and positionally adjustable display, or display device mount. #105-E. Is a plurality of openings included in a lower most portion of #105-A. provided for the mechanical fastening of this embodiment of a display device mounting platform to the plurality threaded holes in the axel. 108-A. As viewable in FIG. 28. By means of mechanical fasteners #115. In accordance with the principles of the present embodiment.

FIGS. 29-E. through FIG. 29-I. Include drawings of another embodiment of a combination internal slide #107-A, and upper compressive display device securement member #107-B. That would be housed inside the inner housing portion of the display device mounting platform #105-A. And of which would share almost all things common with the embodiment thereof. Included in FIG. 29-D. except for the uppermost portion of same that additionally includes a width adjustable display device sun-shield portion of same. This display device sun-shield portion of #107-A. Includes both a lower track plate that would either be made as an optionally employable accessory, that would be mechanically fastenable to the uppermost portion of #107-A and #107-B. Or made as an integral portion of #107-A. and #107-B. And made along with the width adjustable display device sun-shield portions #107-G. of same, as a complete unit that would be interchangeable with the embodiment thereof included in FIG. 29-D. In accordance with the principles of the present embodiment.

FIG. 29-E. Includes an embodiment just the uppermost portion of the combination internal slide #107-A, and upper compressive display device securement member #107-B. As well as the lower track plate #107-D. portion of this embodiment of same. With the laterally adjustable portions #107-G. of the display device sun-shield. removed from each side portion of track plate #107-D. Notice that this embodiment of #107-D. includes two raised tracks #107-F. These to track portions of this embodiment of track plate #107-D. are best seen in FIG. 29-G. Which includes a drawing of an outer end portion of the lower track plate #107-D. These two raised male track #107-F. Portions of #107-D. would be slidably coupled to the internal Female track portions of the embodiments of laterally adjustable sun shield portions #107-G. of the display device sun-shield. In accordance with the principles of the present embodiment.

FIG. 29-F. Includes an embodiment of the combination internal slide #107-A, and upper compressive display device securement member #107-B. As well as the lower track plate #107-D. portion of this embodiment of same, as well as the laterally adjustable portions #107-G. of the display device sun-shield. slidably coupled to each side portion of track plate #107-D. and adjusted all of the way into its narrowest width of adjustment thereon and secured in place by means of simple thumbscrews #107-J. included in this embodiment thereof, as simple securement members to apply friction between the lower surface portion of #107-G. and the upper surface portion of track plate #107-D.

This embodiment of simple thumbscrews #107-J. in this embodiment thereof would extend through open cut out slot #107-I. portions of the two upper embodiments of the two laterally adjustable sun shield portions #107-G. as seen in the drawings of same included in FIGS. 29-H. and FIG. 29-I. And the end threaded portions of same would be threaded into drilled out and threaded openings in this embodiment of the lower track plate portion of a combination internal slide #107-A, and upper compressive display device securement member #107-B. and compressibly secure the two laterally adjustable sun shield portions #107-G. into their adjusted positions with the side panel portions of same, up against the the upper side portions of the display device employed by means of the clockwise rotation of thumbscrews #107-J. In accordance with the principles of the present embodiment.

FIG. 29-G. Includes a drawing of the embodiment of the lower track plate #107-D. This drawing of same includes a view of an outer end portion of the lower track plate #107-D. to provide a view of the two raised male track #107-F. Portions of same. These track portions of the lower track plate #107-D. Are located on each side of the upper surface portions of same and run laterally from the center of the lower track plate #107-D. and extend outward to the outermost end portions of each outer side portions of same. These male track portions of the lower track plate #107-D, mate with internal female track portions of the embodiments of laterally adjustable sun-shield portions #107-G. included in FIGS. 29-H and FIG. 29-I. In accordance with the principles of the present embodiment.

FIGS. 29-H and FIG. 29-I. are drawings of an embodiment of the laterally adjustable sun-shield portions #107-G. turned upside down to provide a view of the inset female track portions #107-H, that consist of two cut out slots #107-H, in each of the bottom portions portions of the two upper embodiments of the two laterally adjustable sun shield portions #107-G, that extend from the innermost edges of each and extend outward to the inner most portions of the inner turning points of each portion of same, where the laterally adjustable sun-shield portions #107-G. extend back downward #107-I to cover the upper side portions of the display device employed.

These inset female track portions #107-H. Of the two laterally adjustable sun shield portions #107-G, of same are configured to mate with and slidably couple to the male track portions of the lower track plate. and thus be laterally adjustable on same. FIGS. 29-H and FIG. 29-I. Also provide a good view of the cut out slot #107-I. portions of each of the two upper embodiments of the laterally adjustable sun shield portions of #107-G. of which the lower threaded portions of the thumbscrews #107-J. in this embodiment thereof would extend through and be threaded into the into drilled out and threaded openings in the lower track plate and compressibly secure the two laterally adjustable sun shield portions #107-G. into their adjusted positions with the side panel portions of same, up against the the upper side portions of the display device employed by means of the clockwise rotation of thumbscrews #107-J. In accordance with the principles of the present embodiment.

Figure 30:
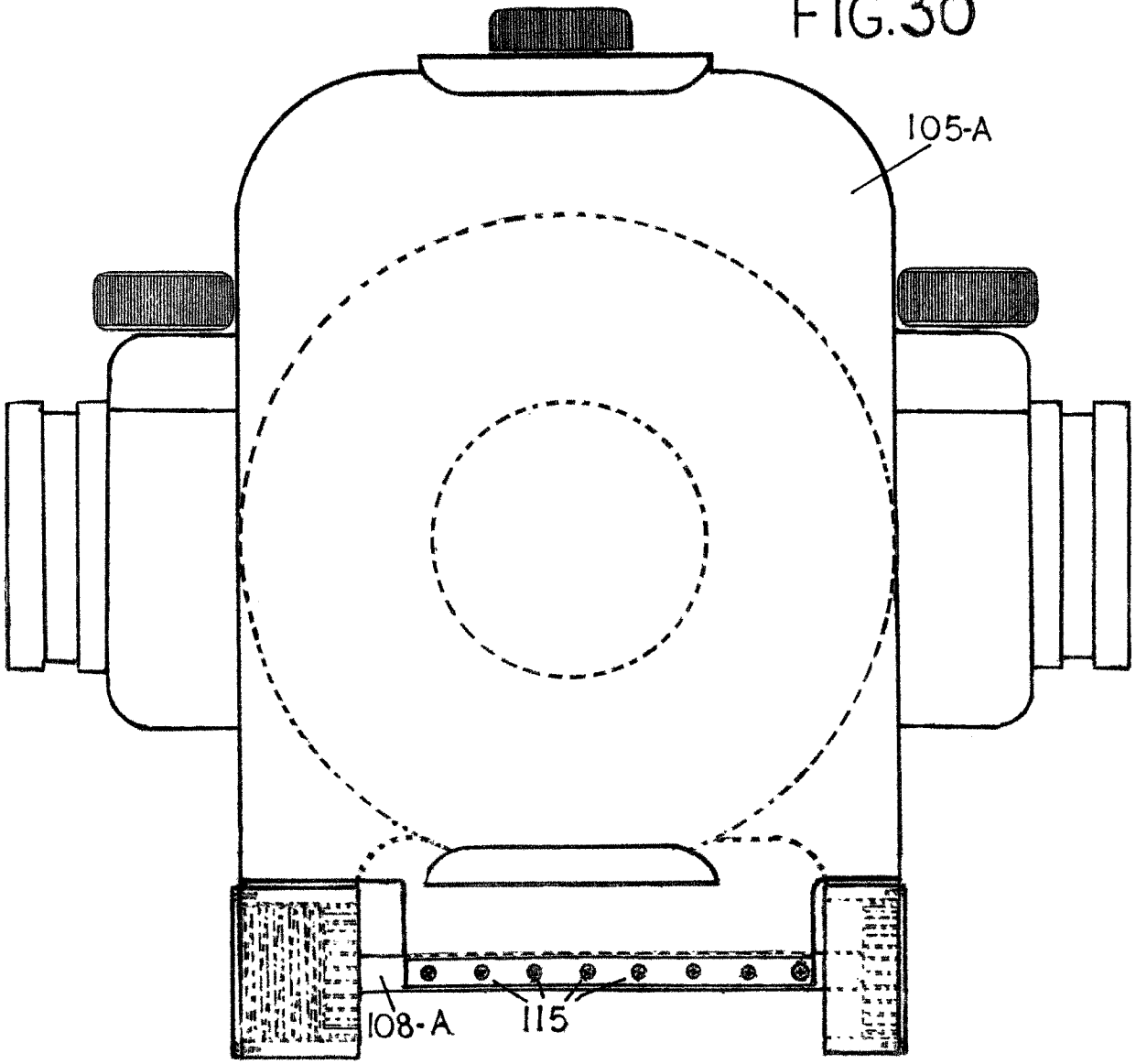

FIG. 30. Includes a drawing of overhead view of the embodiment of the tactical low profile and multi angularly and positionally adjustable display, device mount included in FIG. 23 through FIG. 32. fully assembled. with the display device mounting platform portion of the display mount. #105-A. Mechanically fastened to the plurality threaded holes in the axel. 108-A. As viewable in FIG. 28. By means of mechanical fasteners #115. In accordance with the principles of the present embodiment.

Figure 31:
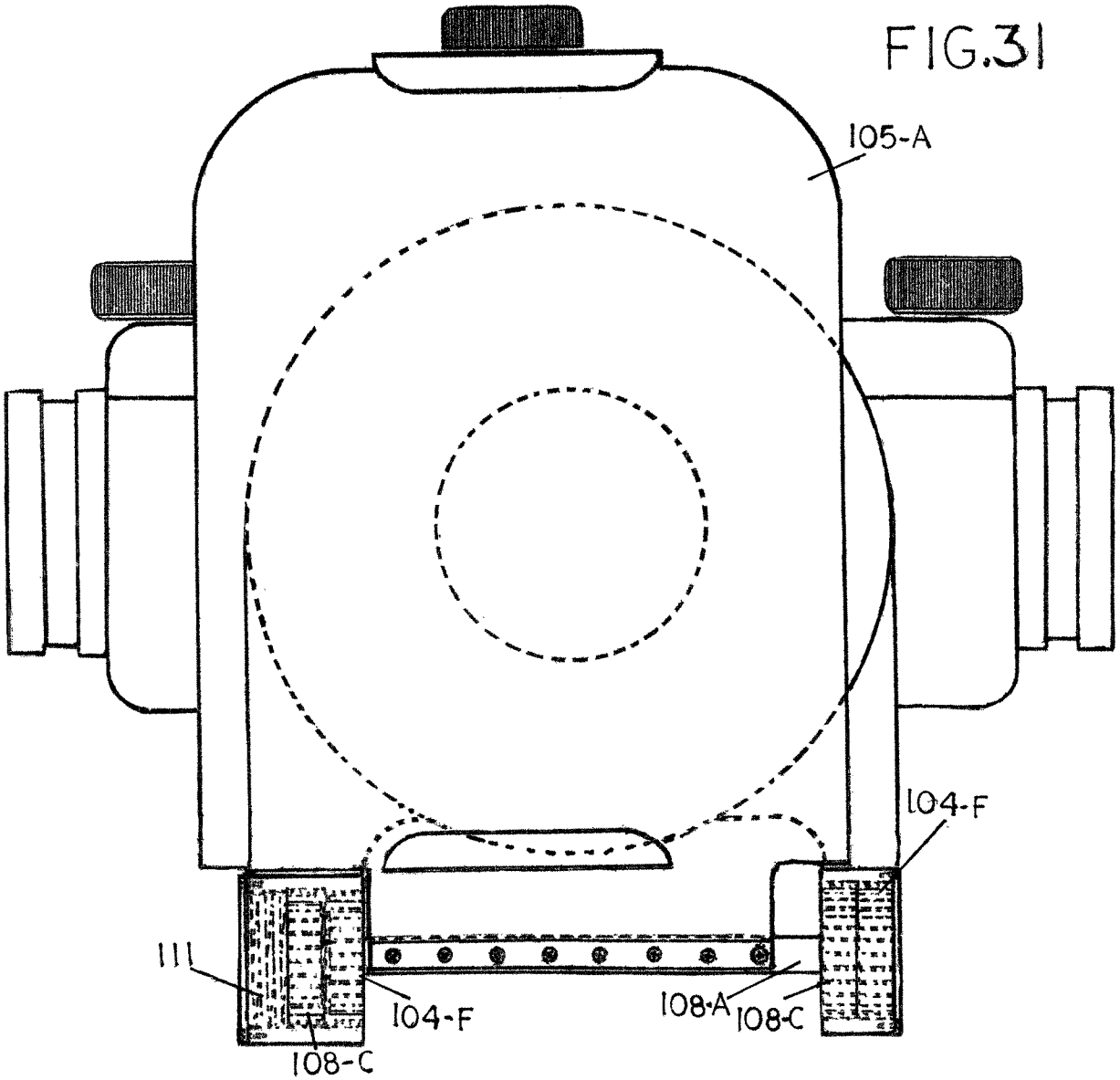

FIG. 31. Includes a drawing of overhead view of the embodiment of the tactical low profile and multi angularly and positionally adjustable display, device mount, fully assembled. As is included in FIG. 30. However notice that the display device mounting platform. #105-A. mechanically attached to the axel. 108-A. has been pushed over slightly to the left side of the cowling portion of the device. As a result thereof the plurality of lateral raised and inset portions, comprising the lateral teeth portions of the gears, #108-C. has compressed the spring #111. maintaining the gears stationed on each end portion of the axel. 108-A. to be disengaged from inner lateral spline portions #104-F, stationed around the inner periphery portions of each gear housing and are no longer mated with same.

This action both unlocks the display device mounting platform from its previous vertical angle of adjustment and allows the display devise and the screen portion of same to be re-positioned to its next desired vertical angle of adjustment, where when released by the user of same the display device and the screen of same solidly locks into its newly desired vertical angle of adjustment. By means of the spring #111. forcing the gears stationed on each end portion of the axel. 108-A. Back into the inner lateral spline portions #104-F, stationed around the inner periphery portions of each gear housing and maintaining same therein and the display device into its newly desired vertical angle of adjustment relative to the firearm once released by the user of same. In accordance with the principles of the present embodiment.

Figure 32:
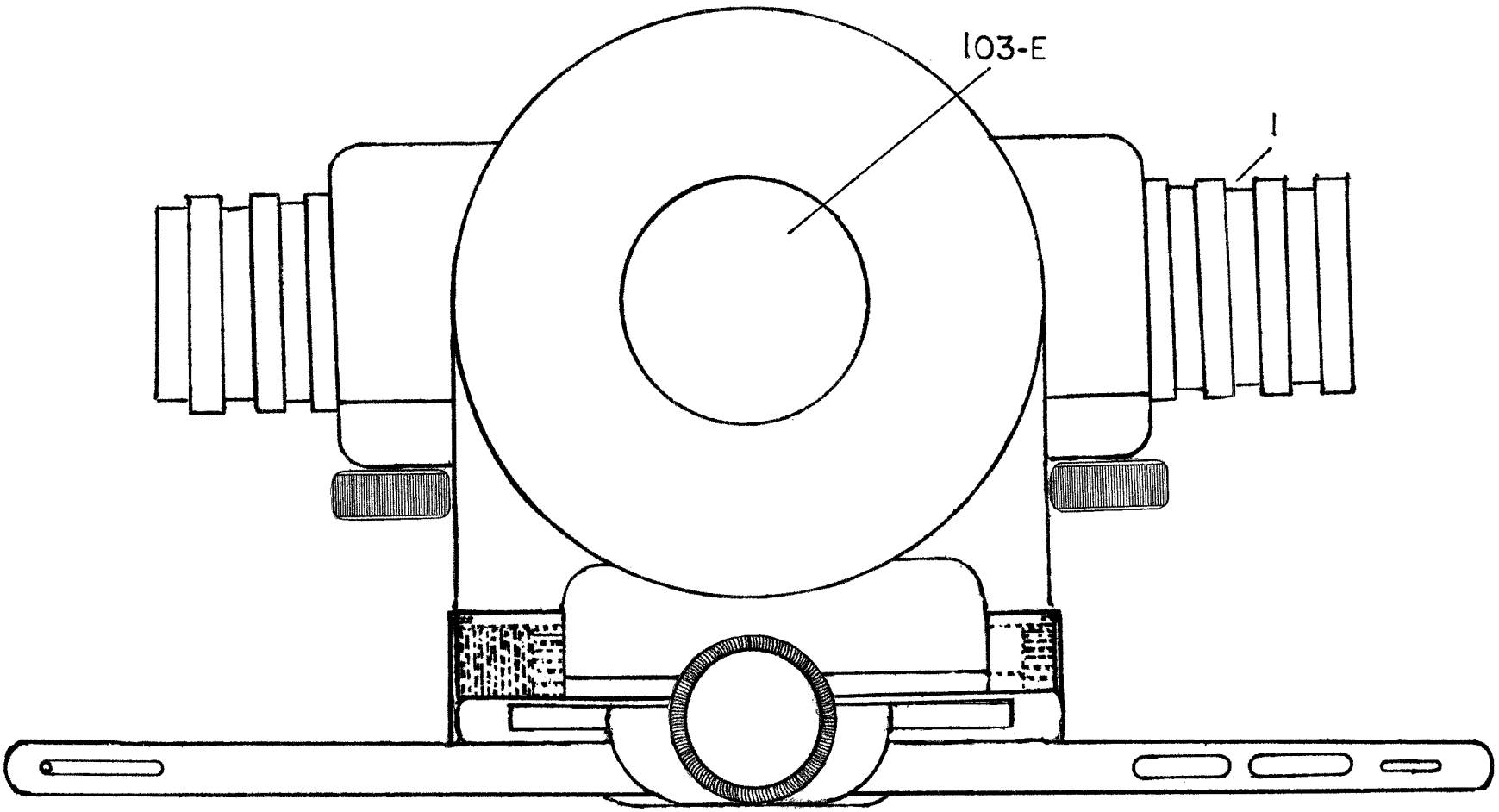

FIG. 32. Includes a drawing of overhead view of the embodiment of the tactical low profile and multi angularly and positionally adjustable display, device mount as is included in the drawing of same included in FIG. 30. After the user of same vertically adjusted the display device mount along with a digital display device, mounted in same. Also included in this drawing to an adjusted angle of adjustment of 90 degrees relative to the weapons rail #1 of the firearm. Of which is one of many vertical angles of adjustment, that this embodiment of the display device mount can be adjusted to by the user of same, in the same manner This drawing also provides a good view of the upper surface portion of the upper spring housing #103-E. stationed in the center of the upper surface portion of the cowling and employed as a button that when pressed unlocks the display device mount and the display device mounted thereon, from its previously adjusted lateral angle of adjustment relative to the weapons rail portion of the firearm and also solidly locks same into its newly desired angle of adjustment when released by the user of same in the same manner.

These two actions can also be very quickly and easily accomplished with one hand, by the user of same by means of the user grasping a portion of the display device with a couple of fingers and pushing same to the side, while simultaneously depressing the center the upper surface portion of the upper spring housing #103-E. with another finger. Of which provides the user of same with the ability to simultaneously re-position the display device and the screen portion of same, both to any newly desired vertical and lateral angle of adjustment relative to the firearm of which same is employed and solidly locks into once released by the user of same. In accordance with the principles of the present embodiment.

FIG. 33-A. Includes a drawing of profile view of an embodiment of a tactical low profile and multi angularly and positionally adjustable display, device mount. This embodiment thereof includes a couple of small differences to those included in. FIG. 23 through FIG. 32. This due to the fact, that this embodiment thereof does not actually include the lowermost portion, configured for the mating with a weapons rail on a firearm, but instead this embodiment thereof is equipped for the mounting of this embodiment of a tactical low profile and multi angularly and positionally adjustable display, device mount primarily on the inner wrist or on the inner forearm, of which quickly and easily adjust to provide and enable the user employing same with the ability to maintain the perfect vantage point of the screen of the digital display device employed in same regardless of the position the user has to position himself relative to the firearm, in the same manner as the strictly rail mountable embodiments thereof These differences enabling the employment of this embodiment of a tactical low profile and multi angularly and positionally adjustable display, device mount, to be additionally employed in this manner included in the lower mounting base #2-E. Portion of same. Notice that this embodiment thereof includes a strap #112 with sections of Velcro #114 on the lower portions of the strap. The employment of same would include the positioning of this embodiment of a tactical low profile and multi angularly and positionally adjustable display, device mount and then tightly wrapping both portions of the strap extending from each side of the mount around the users wrist forearm or portion of the firearm employed, with both end portions thereof over lapping and secured to each other and with this embodiment of a tactical low profile and multi angularly and positionally adjustable display, device mount with a display device mounted on same remaining primarily on the inner wrist or on the inner forearm portion of the user employing same.

However this embodiment thereof can also be tightly secured around the inner side portion of a forward portion of the stock or on a forward portion of the firearm employed and thus enabling this embodiment of a tactical low profile and multi angularly and positionally adjustable display, device mount, to be additionally employed in the same basic manner as all other firearm mountable embodiments thereof included in this application. In accordance with the principles of the present embodiment.

FIG. 33-B. Includes a drawing of profile view of the lower portion of the same embodiment of a tactical low profile and multi angularly and positionally adjustable display, device mount as is included in. FIG. 33-A. However this drawing includes only the lower mountable portion of the device that would replace #102-A in the weapons rail mountable embodiments thereof included in this application. Of which is replaced with 102-E. In this strap mountable version of same. Of which is also an integral portion of both a lower plate portion #102-B. As well as a lower portion of a spring housing #102-C. #102-F. is a strap securement plate in this embodiment thereof which includes an inner surface portion configured and adapted for the securement of strap #112 between the upper surface portion of the strap securement plate #102-F. and the bottom surface portion of this embodiment of a mounting base #102-E. portion of a tactical low profile and multi angularly and positionally adjustable display, device mount. Mechanical fasteners #115. are provided in this embodiment thereof, to provide one of many modes of securing the strap securement plate #102-F. and aiding in the securement of the strap portion of same to the bottom surface portion of this embodiment of a mounting base #102-E. In accordance with the principles of the present embodiment.

FIG. 33-C. Includes a drawing of a profile view of an embodiment of a tactical low profile and multi angularly and positionally adjustable display. This embodiment thereof includes a couple of small differences to those included in. FIG. 23 through FIG. 32. This due to the fact, that this embodiment thereof does not actually include an actual display mount of any sort in that this embodiment thereof includes its own dedicated display #109. that includes a lower mounting portion similar to the lower mounting portions of the display device mounting platform portion of the display mount. included in the embodiments thereof included in. FIG. 23 through FIG. 32. Of which this embodiment of the dedicated display includes a lower extended portion of same comprising a plurality of holes that align up with the plurality threaded holes in the axel. 108-A. As viewable in FIG. 28. allowing the dedicated display to be mechanically fastened to same, by means of the mechanical fasteners #115. much in the same manner as the display device mounts are fastened to same in other embodiments thereof included in this application.

Notice this dawning of profile view of an embodiment of a tactical low profile and multi angularly and positionally adjustable display, device, as well as the drawing of the strap mountable embodiment thereof included in FIG. 33-A. are drawn as if the cowling portions of same are transparent. These drawings were drawn in this manner to provide a fully assembled view of the components housed therein and described in detail in FIG. 25. both in the manner in which same would appear with all components enabling the lateral angle of adjustability of the display device mount or display device portion thereof, relative to the weapons rail #1 both in their locked position. As is included in the drawing of FIG. 33-A with the lateral angle of same locked into a particular angle of adjustment with the plurality of ridges and grooves #103-D. portions of the upper surface portion of the disk, #103-A. pressed into and mated with the plurality of ridges and groove #104-B. portions of the inner surface portion of the cowling #104-A, as seen in FIG. 33-A.

This dawning of profile view of an embodiment of a tactical low profile and multi angularly and positionally adjustable display, device mount like the drawing of same in FIG. 33-A. Includes the upper spring housing #103-E. Portion of the disk, stationed in the center of the upper surface portion of the cowling and employed as a button, with this drawing of same is drawn as if same had been pressed. Of which separates the plurality of ridges and grooves #103-D. portions of the upper surface portion of the disk, #103-A. From the plurality of ridges and groove #104-B. portions of the inner surface portion of the cowling. #104-A. and thus separating the mating of same and the unlocking of same from each other. Of which allows the cowling along with the tactical display device mount and the display device mounted thereon, or the dedicated display as is included in this drawing of an embodiment thereof, from its previously adjusted lateral angle of adjustment relative to the weapons rail portion of the firearm as is included in this drawing of this embodiment thereof. And of which would be solidly locked into the newly desired lateral angle of adjustment once the compressive pressure applied by the user of same is released from #103-E. causing #103-D. to be re-mated with #104-B. as seen in FIG. 33-A.

This drawing includes the dedicated display portion of the embodiment thereof included in this drawing, adjusted and locked into place, at a desired vertical angle relative to the weapons rail #1 of the firearm and with same solidly locked into its newly desired angle of adjustment when released by the user of same, with the plurality of lateral raised and inset portions, comprising the lateral teeth portions of the gears, stationed around the outer periphery portions of each gear #108-C, mated with the raised and inset portions of the lateral splines. #104-F, stationed around the inner periphery portions of each gear housing #104-E. As is described in detail FIG. 27, FIG. 28 and FIG. 31. the drawing included in FIG. 33-A. Also include the display device mount as is included in FIG. 33-A. locked into its position of non use, in the same manner. In accordance with the principles of the present embodiment.

FIG. 33-D. Includes a drawing of a profile view of the same embodiment of a tactical low profile and multi angularly and positionally adjustable display device mount. As is also included in FIG. 23 through FIG. 32. similar to the manner in which this embodiment thereof would appear mounted on the weapon rail of a firearm with the display device mounting platform portion of same #105-A, along with the display device mounted in same. #120-B. locked down into its position of non-use, up against the cowling #104-A. Portion of this embodiment of a tactical low profile and multi angularly and positionally adjustable display device mount. In accordance with the principles of the present embodiment.

FIG. 34-A. Through FIG. 34-C. includes a non-tactical embodiment of a low profile display device or display device mount, mountable to a weapons rail on a firearm, The main difference between the tactical and the non-tactical embodiments of same, being that the non-tactical embodiments thereof possess only vertical angular adjustability of the display device mount #105-A and, or the display device relative to the weapons rail portion of the firearm in which same is mounted. As a result thereof. This non-tactical embodiment thereof included in these drawings, do not include a cowling or any of the components housed therein that additionally provide the tactical embodiments thereof included in FIG. 23 through FIG. 33-D. with lateral angle adjustability. But instead are equipped with only the components housed in the gear housings #104-E. that enable vertical angular adjustability of the display device mount 105-A or the dedicated display portion of same to be adjusted and locked into place at a desired vertical angle relative to the weapons rail #1 of the firearm and with same solidly locked into its newly desired angle of adjustment when released by the user of same, with the plurality of lateral raised and inset portions, comprising the lateral teeth portions of the gears, stationed around the outer periphery portions of each gear that's mated with the raised and inset portions of the lateral splines. stationed around the inner periphery portions of each gear housing #104-E. As seen and described in detail in FIG. 27, FIG. 28 and FIG. 31. In that the portion of this non-tactical embodiment of a display device or display device mount, mountable to a weapons rail on a firearm would employ the same components enabling vertical adjustability of the display device as is provided for the tactical embodiments thereof included in this application. In accordance with the principles of the present embodiment.

FIG. 34-A. Includes a drawing of an overhead view the aforementioned low profile non-tactical embodiment of a multi vertical angularly adjustable display device or display device mount, mountable to a weapons rail on a firearm, with a display device. #120-B. Mounted on the display device mounting platform #105-A. portion of the display device mounting platform portion of same. With same adjusted and locked into a desired vertical angle of adjustment relative to the weapons rail #1. The dotted lines are included to include an overhead view of the rail mount #102-G. portion of this non-tactical embodiment of a display device or display device mount, that's adapted for the mating and mechanical securement of same to the weapons rail portion of a firearm. #102-H. are mechanical securement members common to quick release type rail mounts of various types that enables this embodiment of the tactical display mount to be quickly and easily installed and removed from the weapons rail portion of a firearm by means of pulling and re pressing on the finger pull portions of same. #102-J. is an upper plate portion of the rail mount portion of this embodiment of a non-tactical embodiment of a display device or display device mount. provided as a non employment resting platform for the display of display device mounting platform portion of same. In accordance with the principles of the present embodiment.

FIG. 34-B. Includes a drawing of a profile view of the same embodiment of a low profile non-tactical embodiment of a multi vertical angularly adjustable display device or display device mount, mounted to a weapons rail #1. With the display device mounted on the display device mounting platform #105-A. Also adjusted and locked into the same 90 degree angle of adjustment relative to the weapons rail #1. as is included in FIG. 34-A. This drawing provides a good profile view of the rail mount #102-G. and the upper plate portion of same #102-J. In accordance with the principles of the present embodiment.

FIG. 34-C. Also includes Includes a drawing of a profile view of the same embodiment of a low profile non-tactical embodiment of a multi vertical angularly adjustable display device or display device mount, mounted to a weapons rail #1. after the display device mounting platform #105-A along with the display device 120-B. mounted on same had been pushed to the side and the display device mounting platform #105-A. portion and the display device mount. had been laid down and locked into its position of non employment on top of the upper plate #102-J. portion of the rail mount #102-G. by means of the user releasing the lateral pressure applied to the display device mounting platform #105-A. or the display device mounted therein. In accordance with the principles of the present embodiment.

The descriptions set forth above are meant to be illustrative and not limiting. Various modifications to the disclosed embodiments, in addition to those described herein, will be apparent to those skilled in the art from the foregoing description. Such modifications are also intended to fall within the scope of the concepts described herein. The disclosures of each patent, patent application, and publication cited or described in this document are hereby incorporated herein by reference, in their entireties.

The foregoing description of possible implementations consistent with the present disclosure does not represent a comprehensive list of all such implementations or all variations of the implementations described. The description of some implementations should not be construed as an intent to exclude other implementations described. For example, artisans will understand how to implement the disclosed embodiments in many other ways, using equivalents and alternatives that do not depart from the scope of the disclosure. Moreover, unless indicated to the contrary in the preceding description, no particular component described in the implementations is essential to the invention. It is thus intended that the embodiments disclosed in the specification be considered illustrative, with a true scope and spirit of invention being indicated by the following claims.

I claim:

1. A digital video camera sighting device for a firearm comprising:

a targeting reticle unit mountable to a firearm in a first position; and a digital video camera unit separately mountable behind the targeting reticle unit on the firearm in a second position that's different from the first position;

wherein the digital video camera unit includes a plurality of digital video cameras with each possessing fields of view that are different relative to each other.

2. The digital video camera sighting device for a firearm of claim 1, wherein an upper portion of the targeting reticle unit is both vertically and laterally adjustable relative to the digital video camera unit of the sighting device.

3. The digital video camera sighting device for a firearm of claim 1, wherein a lower portion of the reticle unit comprises lateral tracks that are capable of engaging an upper portion of the rail mount.

4. The digital video camera sighting device for a firearm of claim 1, wherein the targeting reticle unit comprise a targeting reticle that is illuminable.

5. The digital video camera sighting device for a firearm of claim 4, wherein the reticle unit further comprises an illumination intensity control knob capable of adjusting the illumination of the targeting reticle.

6. The digital video camera sighting device for a firearm of claim 1, wherein the targeting reticle unit further comprises a barrel mount attachable to a barrel portion of a firearm.

7. The digital video camera sighting device for a firearm of claim 6, wherein the barrel mount comprises a clamping member.

8. The digital video camera sighting device for a firearm of claim 1, wherein both the targeting reticle unit and the digital video camera unit, are mounted to a rail mount, such that the rail mount is capable of securing both the targeting reticle unit and the digital video camera unit to the firearm.

9. A camera sighting device for a firearm comprising:

a targeting reticle mounted in a first position on a weapons rail of the firearm; and at least one video camera comprising a field of view separately mounted in a second position on the weapons rail of the firearm at a distance behind the targeting reticle, wherein the at least one video camera comprise a plurality of video cameras wherein the field of view of each camera in the plurality of video cameras is different from the field of view of the other cameras in the plurality of cameras.

10. The camera sighting device for a firearm of claim 9, further comprising at least one adjustment member for adjusting a first position of a first video camera of the at least one video camera to align a lens portion of the first digital video camera relative to the targeting reticle.

11. The camera sighting device for a firearm of claim 9, wherein a portion of at least one video camera is housed in a component housing.

12. The camera sighting device for a firearm of claim 11, wherein a lens portion of the at least one video camera is not housed in the component housing.

13. The camera sighting device for a firearm of claim 9, wherein the targeting reticle comprises a firearm sight or scope separately mounted in front of the at least one digital video camera.

14. The camera sighting device for a firearm claim 9, wherein the targeting reticle is illuminable.

15. The camera sighting device for a firearm of claim 9, wherein the targeting reticle of the comprises a power supply.

16. The camera sighting device for a firearm of claim 9, comprising a rail mount attachable to a weapons rail of the firearm.

17. The camera sighting device for a firearm of claim 16, wherein the rail mount connects to targeting reticle or to the at least one video camera using lateral tracks.

* * * * *